US012577846B2

(12) United States Patent
DeBerry et al.

(10) Patent No.: US 12,577,846 B2
(45) Date of Patent: Mar. 17, 2026

(54) TUBING HANGER ALIGNMENT DEVICE AND SPACE-OUT MECHANISM

(71) Applicant: Innovex International, Inc., Houston, TX (US)

(72) Inventors: Blake T. DeBerry, Houston, TX (US); Morris B. Wade, Houston, TX (US); Flavio Santos, Houston, TX (US); Gregory Norwood, Boerne, TX (US); Robert Buxton, Cypress, TX (US); Justin Rye, Houston, TX (US); Todd L. Scaggs, Houston, TX (US); Andrew B. Mitchell, Houston, TX (US)

(73) Assignee: Innovex International, Inc., Houston, TX (US)

( * ) Notice: Subject to any disclaimer, the term of this patent is extended or adjusted under 35 U.S.C. 154(b) by 0 days.

(21) Appl. No.: 19/026,924

(22) Filed: Jan. 17, 2025

(65) Prior Publication Data

US 2025/0154846 A1 May 15, 2025

Related U.S. Application Data

(63) Continuation-in-part of application No. 18/928,370, filed on Oct. 28, 2024, and a continuation-in-part of (Continued)

(51) Int. Cl.

| | |
|---|---|
| ***E21B 33/04*** | (2006.01) |
| ***E21B 33/03*** | (2006.01) |
| ***E21B 33/043*** | (2006.01) |

(52) U.S. Cl.

CPC ..... *E21B 33/04* (2013.01); *E21B 33/03* (2013.01); *E21B 33/0407* (2013.01); *E21B 33/043* (2013.01)

(58) Field of Classification Search

CPC .... E21B 33/04; E21B 33/043; E21B 33/0415; E21B 33/0407

See application file for complete search history.

(56) References Cited

U.S. PATENT DOCUMENTS

| | | | |
|---|---|---|---|
| 4,067,385 | A | 1/1978 | Schwager et al. |
| 4,109,712 | A | 8/1978 | Regan |

(Continued)

FOREIGN PATENT DOCUMENTS

| | | | |
|---|---|---|---|
| GB | 2200154 | A1 | 7/1988 |
| GB | 2256664 | A1 | 12/1992 |

(Continued)

OTHER PUBLICATIONS

Substantive Examination Adverse Report (Section 30(1) / 30(2) with Search Report, Malaysian patent application No. PI 2022005655 filed Oct. 4, 2018, date of issuance Mar. 28, 2025, 4 pages.

(Continued)

*Primary Examiner* — Giovanna Wright
(74) *Attorney, Agent, or Firm* — Baker Botts L.L.P.

(57) ABSTRACT

Systems and methods for landing a tubing hanger in a wellhead and then orienting a tree (or spool, or flowline connection body) relative to the tubing hanger while landing the tree on the wellhead are provided. This alignment is accomplished without the use of either a tubing spool or a BOP stack with an orientation pin. The tubing hanger alignment devices may be used to orientate the tree as the tree is landed so that the couplings and stabs between the tree and the tubing hanger line up with each other just at the moment of landing. A space-out mechanism is provided to take up any gaps formed axially by being picked up, thus rigidizing the tubing hanger and casing hanger within the wellhead.

19 Claims, 28 Drawing Sheets

Related U.S. Application Data application No. 18/597,246, filed on Mar. 6, 2024, now Pat. No. 12,234,702, said application No. 18/928,370 is a continuation of application No. 17/957,921, filed on Sep. 30, 2022, now Pat. No. 12,152,456, said application No. 18/597,246 is a continuation of application No. 17/874,235, filed on Jul. 26, 2022, now Pat. No. 11,952,854, which is a continuation of application No. 17/201,465, filed on Mar. 15, 2021, now abandoned, said application No. 17/957,921 is a continuation-in-part of application No. 17/118,100, filed on Dec. 10, 2020, now Pat. No. 11,459,843, said application No. 17/201,465 is a continuation of application No. 17/067,590, filed on Oct. 9, 2020, now Pat. No. 10,947,805, which is a continuation of application No. 16/111,987, filed on Aug. 24, 2018, now Pat. No. 10,830,015.

(60) Provisional application No. 62/947,506, filed on Dec. 12, 2019, provisional application No. 62/574,491, filed on Oct. 19, 2017.

(56) References Cited

U.S. PATENT DOCUMENTS

| | | | |
|---|---|---|---|
| 4,372,563 | A | 2/1983 | Diehl et al. |
| 4,408,783 | A | 10/1983 | Gruller |
| 4,595,063 | A | 6/1986 | Jennings et al. |
| 4,770,248 | A | 9/1988 | Houlgrave et al. |
| 4,903,774 | A | 2/1990 | Dykes et al. |
| 5,060,724 | A | 10/1991 | Brammer et al. |
| 5,076,356 | A | 12/1991 | Reimert |
| 5,082,060 | A | 1/1992 | Johnson et al. |
| 5,145,006 | A | 9/1992 | June |
| 5,205,356 | A | 4/1993 | Bridges et al. |
| 5,247,997 | A | 9/1993 | Puccio |
| 5,503,230 | A | 4/1996 | Osborne et al. |
| 6,050,339 | A | 4/2000 | Milberger |
| 6,488,083 | B2 | 12/2002 | Bartlett et al. |
| 7,040,412 | B2 | 5/2006 | Deberry |
| 8,256,506 | B2 | 9/2012 | Dyson et al. |
| 8,376,057 | B2 | 2/2013 | Dyson et al. |
| 8,387,708 | B2 | 3/2013 | Anderson et al. |
| 8,739,883 | B2 | 6/2014 | Aarnes et al. |
| 10,066,456 | B2 | 9/2018 | Berryhill |
| 10,100,595 | B2 | 10/2018 | Nguyen et al. |
| 10,287,839 | B2 | 5/2019 | Lugtmeier et al. |
| 10,648,243 | B1 | 5/2020 | Burrows |
| 10,830,015 | B2 | 11/2020 | Deberry et al. |
| 10,947,805 | B2 | 3/2021 | Deberry et al. |
| 11,072,984 | B2 | 7/2021 | Queiroz et al. |
| 11,180,968 | B2 | 11/2021 | Mitchell et al. |
| 11,199,066 | B2 | 12/2021 | Deberry et al. |
| 11,421,499 | B2 | 8/2022 | Mora et al. |
| 11,459,843 | B2 | 10/2022 | Bartlett et al. |
| 11,952,853 | B2 | 4/2024 | Deberry et al. |
| 2006/0260799 | A1 | 11/2006 | Broussard |
| 2009/0211761 | A1 | 8/2009 | Broussard |
| 2010/0078176 | A1 | 4/2010 | Christie |
| 2010/0089590 | A1 | 4/2010 | Dyson et al. |
| 2010/0101800 | A1 | 4/2010 | June et al. |
| 2010/0307764 | A1 | 12/2010 | Buckle |
| 2012/0043094 | A1 | 2/2012 | Anderson et al. |
| 2013/0126181 | A1 | 5/2013 | Bell |
| 2015/0041151 | A1 | 2/2015 | Cocker, III et al. |
| 2015/0114669 | A1 | 4/2015 | Mansukh et al. |
| 2015/0144360 | A1 | 5/2015 | Shearer |
| 2015/0159458 | A1 | 6/2015 | Tan et al. |
| 2015/0247371 | A1 | 9/2015 | Kekarainen |
| 2015/0259990 | A1 | 9/2015 | June |
| 2016/0186523 | A1 | 6/2016 | Nguyen |
| 2016/0265298 | A1 | 9/2016 | Nguyen |
| 2016/0326824 | A1 | 11/2016 | Lugtmeier et al. |
| 2017/0058622 | A1 | 3/2017 | Nguyen et al. |
| 2017/0152721 | A1 | 6/2017 | Bories et al. |
| 2017/0167218 | A1 | 6/2017 | Cheah et al. |
| 2017/0198540 | A1 | 7/2017 | Chirko et al. |
| 2017/0254166 | A1 | 9/2017 | Berryhill |
| 2017/0342805 | A1 | 11/2017 | Minnock et al. |
| 2018/0163491 | A1 | 6/2018 | Nguyen et al. |
| 2018/0258726 | A1 | 9/2018 | Levert, Jr. et al. |
| 2019/0120008 | A1 | 4/2019 | Deberry et al. |
| 2020/0040686 | A1 | 2/2020 | Yousef et al. |
| 2020/0399973 | A1 | 12/2020 | Mitchell et al. |
| 2021/0010340 | A1 | 1/2021 | Queiroz et al. |
| 2021/0062603 | A1 | 3/2021 | Cheng et al. |
| 2021/0087899 | A1 | 3/2021 | Deberry et al. |
| 2021/0180425 | A1 | 6/2021 | Bartlett et al. |
| 2021/0317718 | A1 | 10/2021 | Mora et al. |
| 2023/0026935 | A1 | 1/2023 | Mitchell |
| 2024/0151116 | A1 | 5/2024 | Mitchell et al. |

FOREIGN PATENT DOCUMENTS

| | | | |
|---|---|---|---|
| GB | 2233364 | B2 | 2/1993 |
| GB | 2262298 | A1 | 6/1993 |
| GB | 2397312 | B2 | 7/2005 |
| WO | 2009014795 | A2 | 1/2009 |
| WO | 2018226239 | A1 | 12/2018 |
| WO | 2019093997 | A1 | 5/2019 |
| WO | 2019209298 | A1 | 10/2019 |
| WO | 2020204729 | A1 | 10/2020 |

OTHER PUBLICATIONS

Substantive Examination Adverse Report (Section 30(1) / 30(2) with Search Report, Malaysian patent application No. PI 2022005656 filed Oct. 4, 2018, date of issuance Mar. 28, 2025, 4 pages.

Draft VXTe ITW Stack-Up Drawing, Dril-Quip, Inc., Jun. 9, 2020, 1 page.

Draft VXTe Tubing Hanger Drawing, Dril-Quip, Inc., Mar. 16, 2020, 1 page.

Dril-Quip, Inc. VXTe presentation given to Walter Oil & Gas on Apr. 11, 2019, 9 pages.

OTC Publication: "VXTe Deepwater Tree Development—Cost and Risk Reduction Through New and Advanced Technology," May 4, 2020, 8 pages.

Patents Act 1977: Examination Report under Section 18(3), Application No. GB2106268.2, mailed Sep. 29, 2023, 5 pages.

Sales Order (H12)3017492 Rev. 4 from Dril-Quip, Inc. to Walter Oil & Gas, Revision Date Jun. 26, 2019, 5 pages.

Sales Order (H20)3018325 from Dril-Quip, Inc. to Walter Oil & Gas, Order Date Jun. 4, 2019, 3 pages.

View 1, Photograph of VXTe prototype, Dril-Quip, Inc., Jul. 2019, 1 page.

View 2, Photograph of VXTe prototype, Dril-Quip, Inc., Jul. 2019, 1 page.

View 3, Photograph of VXTe prototype, Dril-Quip, Inc., Jul. 2019, 1 page.

View 4, Photograph of VXTe prototype, Dril-Quip, Inc., Jul. 2019, 1 page.

International Search Report and Written Opinion issued in PCT Application No. PCT/US2018/054309, dated Mar. 27, 2019, 22 pages. cited by applicant.

Substantive Examination Adverse Report (Section 30(1) / 30(2) with Search Report, Malaysian patent application No. PI 2022005657 filed Oct. 4, 2018, date of issuance Mar. 28, 2025, 4 pages.

Substantive Examination Adverse Report (Section 30(1) / 30(2) with Search Report, Malaysian patent application No. PI 2022005658 filed Oct. 4, 2018, date of issuance Mar. 28, 2025, 4 pages.

Araujo, Gustavo Bellot de Almeida, and Zaragoza Labes. "New subsea X tree generation brings innovative features providing efficiency for ultra deep waters." (2008), 4 pages.

Connector Subsea Solutions, "Hydraulic and Chemical Couplers" (no date), 2 pages.

Dril-Quip, Inc., "Dril-Quip BigBore-lle Wellhead—OTC Spotlight 2017" (2017), 1 page.

(56) References Cited

OTHER PUBLICATIONS

Hunting Subsea Technologies, "UO-Series Male Hydraulic Coupling Data Sheet and UO-Series Female Hydraulic Coupling Data Sheet" (no date), 3 pages.
ISO, ISO. "13628-4: Petroleum and Natural Gas Industries—Design and Operation of Subsea Production Systems—Subsea Wellhead and Tree Equipment." ISO—International Organization for Standardization (2011), 276 pages.
Patents Act 1977: Search report under section 17(5), Application No. GB2314260.7, Feb. 27, 2024, 3 pages.
Search Report issued in related United Kingdom Patent Application No. GB2019380.1 dated May 27, 2021, 1 page.
Notice for eligibility of grant with search report and examination report from Intellectual Property Office of Singapore, mailed Jan. 12, 2026, SG Application No. 10202203972Y, 6 pages.

TUBING HANGER ALIGNMENT DEVICE AND SPACE-OUT MECHANISM

CROSS REFERENCE TO RELATED PATENT APPLICATIONS

The present application is a continuation-in-part claiming the benefit of U.S. patent application Ser. No. 18/597,246, entitled "Tubing Hanger Alignment Device," filed Mar. 6, 2024, which is a continuation claiming the benefit of U.S. patent application Ser. No. 17/874,235, entitled "Tubing Hanger Alignment Device with Plug-Based Alignment Mechanism," filed on Jul. 26, 2022, now U.S. Pat. No. 11,952,854, which is a continuation claiming the benefit of U.S. patent application Ser. No. 17/201,465, entitled "Tubing Hanger Alignment Device," filed on Mar. 15, 2021, now abandoned, which is a continuation claiming the benefit of U.S. patent application Ser. No. 17/067,590, entitled "Tubing Hanger Alignment Device," filed on Oct. 9, 2020, now U.S. Pat. No. 10,947,805, which is a continuation claiming the benefit of U.S. patent application Ser. No. 16/111,987, entitled "Tubing Hanger Alignment Device," filed on Aug. 24, 2018, now U.S. Pat. No. 10,830,015, which claims priority to and the benefit of Provisional Patent Application Ser. No. 62/574,491, entitled "Tubing Hanger Alignment Device," filed on Oct. 19, 2017, the entire disclosures of which are incorporated herein by reference.

This application further is a continuation-in-part claiming the benefit of U.S. application Ser. No. 18/928,370, filed Oct. 28, 2024, entitled "Rigidized Seal Assembly Using Automated Space-Out Mechanism", which is a continuation of U.S. application Ser. No. 17/957,921, filed Sep. 30, 2022, entitled "Rigidized Seal Assembly Using Automated Space-Out Mechanism", now U.S. Pat. No. 12,152,456, which is a continuation-in-part of U.S. application Ser. No. 17/118,100, entitled "Tubing Hanger Space-Out Mechanism", filed on Dec. 10, 2020, now U.S. Pat. No. 11,459,843, which claims the benefit of U.S. Provisional Patent Application No. 62/947,506, entitled "Tubing Hanger Space-Out Mechanism", filed on Dec. 12, 2019, the entire disclosures of which are incorporated herein by reference.

TECHNICAL FIELD

The present disclosure relates generally to wellhead systems and, more particularly, to tubing hanger alignment devices used to properly align a tree to a tubing hanger in a wellhead regardless of the orientation in which the tree is positioned in the wellhead.

BACKGROUND

Conventional wellhead systems include a wellhead housing mounted on the upper end of a subsurface casing string extending into the well bore. During a drilling procedure, a drilling riser and BOP are installed above a wellhead housing (casing head) to provide pressure control as casing is installed, with each casing string having a casing hanger on its upper end for landing on a shoulder within the wellhead housing. A tubing string is then installed through the well bore. A tubing hanger connectable to the upper end of the tubing string is supported within the wellhead housing above the casing hanger for suspending the tubing string within the casing string. Upon completion of this process, the BOP is replaced by a Christmas tree installed above the wellhead housing, with the tree having a valve to enable the oil or gas to be produced and directed into flow lines for transportation to a desired facility.

The tubing hanger contains numerous bores and couplings, which require precise alignment with corresponding portions of the tree. Conventionally, there are two ways to achieve orientation of a tree relative to a tubing hanger. The first uses a tubing spool assembly, which latches to the wellhead and provides landing and orientation features. The tubing spool is very expensive, however, and adds height to the overall stack-up. Additionally, the tubing spool is so heavy that few work class vessels can install it, and it frequently requires installation by expensive drilling vessels. Furthermore, the drilling riser must be removed to install the tubing spool.

The second method of orienting a tree relative to a tubing hanger involves the use of a blowout preventer ("BOP") stack hydraulic pin and orientation adapter joint. This method requires detailed knowledge of the particular BOP stack in order to accurately install a hydraulically actuated pin, which protrudes into the BOP stack bore. An orientation helix is attached above the tubing hanger running tool, and, as the tubing hanger lands, the helix engages the hydraulic pin and orientates the tubing bores to a defined direction. This method requires accurate drawings of the BOP stack elevations and spacing between the main bore and the outlet flanges, which may require hours of surveying and multiple trips to make measurements. Room for error exists with this method, particularly in older rigs. Thus, this method requires significant upfront planning. Additionally, setting the lock-down sleeve in the wellhead generally requires a rig because the BOP must remain in place as a reference point for orientation of the tubing hanger and corresponding lock-down sleeve.

For various reasons, a tubing hanger or casing hanger within the wellhead may move axially upward, particularly when the wellhead is part of a production system where downhole fluids at elevated temperatures thermally expand the casing string and thus exert a substantial upward force on the casing hanger. Since the casing hanger seal is intended for sealing at a particular location on the wellhead, upward movement of the casing hanger and the seal assembly is detrimental to reliably sealing the casing annulus. Further, for various reasons, the casing hanger may stack higher than intended. Thus, it must be ensured that the tubing hanger is properly sized to lock to the wellhead and that the casing hanger is prevented from moving axially in response to such axial forces.

Various tubing hanger designs and methods have been conceived of for ensuring the tubing hanger is locked to the wellhead housing and the tubing hanger system and casing hanger are rigidized (locked axially) within the wellhead housing. A tubing hanger, once run in and locked into the wellhead, is intended to prevent axial movement of the uppermost casing hanger and seal assembly with respect to the wellhead. Typically, a tubing hanger is run into the wellhead, landed on the casing hanger, and locked to a locking profile on an inner wall of the wellhead housing, which also acts to secure the casing hanger within the wellhead. To install existing tubing hangers, it is first necessary to run a lead impression tool into the wellhead to measure the distance between the top of the casing hanger and the housing locking profile. The lead impression tool is a small block of soft metal, usually lead, which is lowered into the wellhead to take an impression to determine the internal profile of the wellhead, which after being retrieved can be measured to determine the distance between the top of the casing hanger and the housing locking profile. With this information, the tubing hanger can be adjusted at the surface so that once the tubing hanger is run in and secured to the wellhead, it provides a zero-gap connection between the tubing hanger, the casing hanger, and the wellhead housing and creates any desired pre-load.

This process of taking measurements in the wellhead via a lead impression tool, retrieving the tool to the surface, and then adjusting and installing a tubing hanger into the wellhead is a time-consuming installation process requiring multiple trips into the wellhead. It is now recognized that a need exists for a tubing hanger system that allows for a single-trip installation process.

BRIEF DESCRIPTION OF THE DRAWINGS

For a more complete understanding of the present disclosure and its features and advantages, reference is now made to the following description, taken in conjunction with the accompanying drawings, in which.

DETAILED DESCRIPTION

Figure 1:
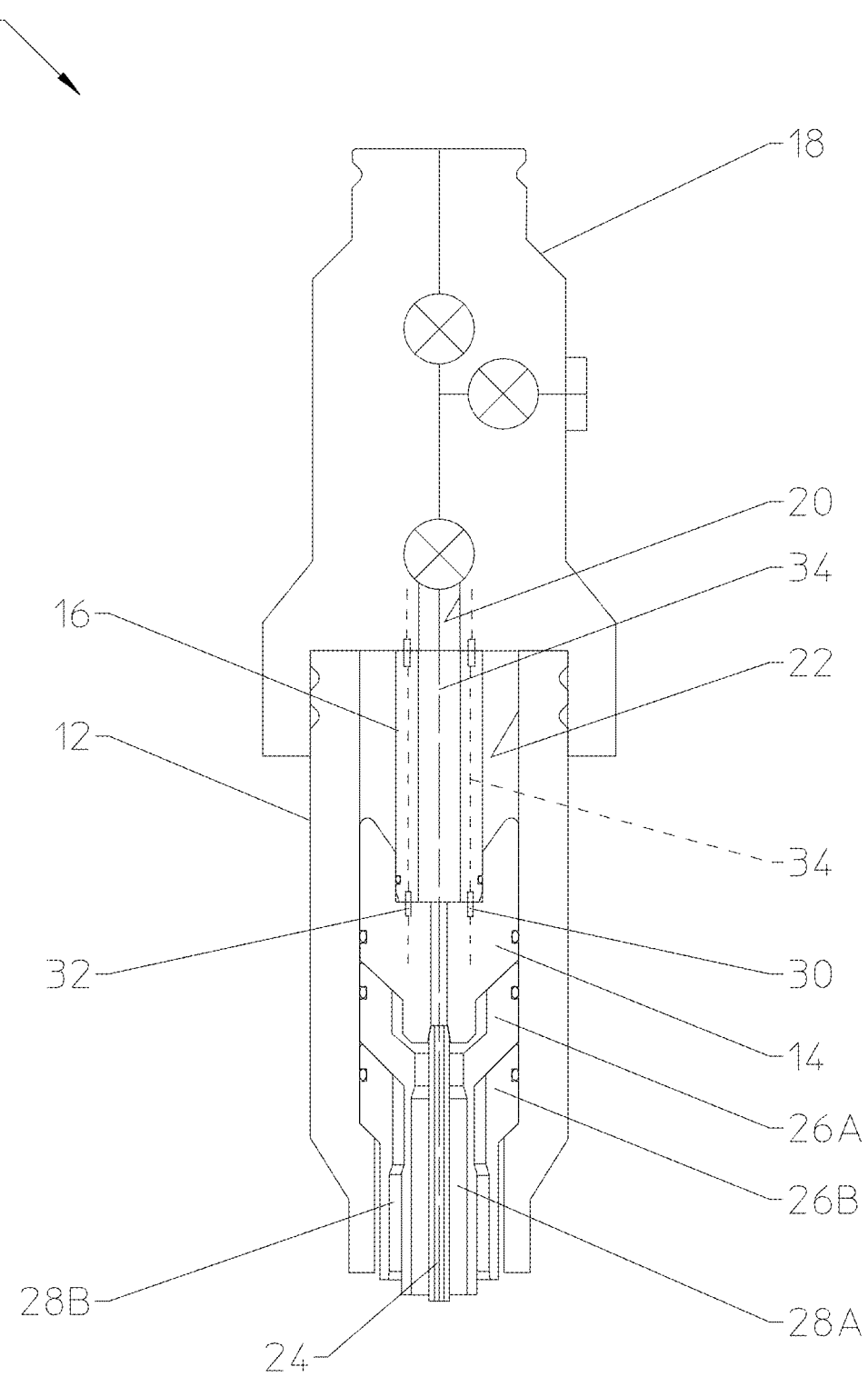
FIG. 1 is a schematic cutaway view of components of a production system having a tubing hanger alignment device, in accordance with an embodiment of the present disclosure.

Illustrative embodiments of the present disclosure are described in detail herein. In the interest of clarity, not all features of an actual implementation are described in this specification. It will of course be appreciated that in the development of any such actual embodiment, numerous implementation specific decisions must be made to achieve developers' specific goals, such as compliance with system related and business related constraints, which will vary from one implementation to another. Moreover, it will be appreciated that such a development effort might be complex and time consuming, but would nevertheless be a routine undertaking for those of ordinary skill in the art having the benefit of the present disclosure. Furthermore, in no way should the following examples be read to limit, or define, the scope of the disclosure.

Certain embodiments of the present disclosure may be directed to a tubing hanger system that may be installed within a wellhead system in a single trip. The tubing hanger system may include multiple pieces that are coupled together such that the tubing hanger may be locked to an inner wall of a high-pressure wellhead housing while applying a preload on a casing hanger, thereby rigidizing the tubing hanger system and casing hanger within the wellhead housing. The tubing hanger system may be run into the wellhead system until the tubing hanger system abuts the casing hanger. Then, the tubing hanger system may be picked up until the tubing hanger system is locked against an inner wall of the high-pressure housing. Lastly, a space-out mechanism of the tubing hanger system may actuate such that it takes up any gaps formed axially by being picked up, thus rigidizing the tubing hanger system and casing hanger within the wellhead housing. The installation process for the tubing hanger system may be accomplished entirely during a single trip into the wellhead as opposed to a first trip with a lead impression tool followed by an adjustment of the tubing hanger system at the surface and a subsequent trip downhole to install the adjusted tubing hanger system. The disclosed systems and method provide both time savings (since only one trip into the wellhead is necessary) and cost savings (since an additional lead impression tool is not required) compared to existing tubing hanger installation techniques.

Certain embodiments according to the present disclosure may be directed to a tubing hanger alignment device used to properly orient a tree (or spool, or flowline connection body) that is being landed on a wellhead relative to a tubing hanger that is set in the wellhead.

Certain embodiments of the present disclosure may also be directed to a seal assembly having enhanced rigidity. The seal assembly may be configured such that fluid may apply pressure to the inner diameter of the seal assembly's lower body, thereby pushing the lower body down. When the lower body is pushed down, a pressure-actuated release mechanism (such as a shear pin) may be actuated (e.g., broken), allowing the lower body to descend further while a ramp ring and spring reduce the size of any existing gap between the casing hanger and wellhead. Such embodiments allow for enhanced rigidization of the wellhead system with minimal cost.

In the following discussion, the term "tree" will be used to refer to any type of component that is landed on a wellhead, has one or more flowlines extending therethrough, and has one or more communication flow paths (e.g., electric, fiber optic, or hydraulic) for communicating with communication flow paths in the associated tubing hanger. The term "tree" will be used throughout this application to refer to any one of a tree body, a spool, or a flowline connection body.

In wellhead systems, a tree (or spool, or flowline connection body, connector) that is positioned on the wellhead must be properly oriented with respect to the tubing hanger that is set in the wellhead. This is because there are a number of couplings or stabs that have to be made up between the tubing string and the tree so as to allow electric, hydraulic, and/or fiber optic signals to be communicated from the tree to the tubing hanger and various downhole components. Existing methods for orienting a tree relative to a tubing hanger in the wellhead involve the use of either an expensive tubing spool or a BOP stack hydraulic pin and orientation adapter joint, which can be difficult to properly place on the wellhead and expensive to adjust if improperly placed.

Certain embodiments of the present disclosure are directed to systems and methods for landing a tubing hanger in a wellhead without regard to its orientation and landing a tree at any orientation desired by the operator. The tree can land at any orientation and the systems and methods according to the present invention can be used to orientate the various couplings (e.g., the electric, hydraulic, and/or fiber optic) relative to the tubing hanger while landing the tree on the wellhead. This is accomplished without the use of either a tubing spool or a BOP stack with an orientation pin. This can save the operator a large amount of money (on the order of millions of dollars) since no tubing spool is necessary to perform the orientation. In addition, the disclosed systems and methods will save the operator money because they avoid the possibility of costly remediation associated with an improperly positioned BOP. The tubing hanger alignment devices are able to align the tree to the tubing hanger independent of the original tree orientation at the beginning of the landing process. Essentially, the disclosed tubing hanger alignment devices enable the tree to function as a "self-orienting tree". The tree can be landed in any orientation desired by the operator. The present invention thus provides a self-alignment and orientation of couplings or stabs that have to be made up between the tubing string and the tree so as to allow electric, hydraulic, and/or fiber optic signals to be communicated from the tree to the tubing hanger and various downhole components.

Turning now to the drawings, FIG. 1 illustrates certain components of a subsea production system 10 in which the disclosed tubing hanger alignment devices may be utilized. The production system 10 depicted in FIG. 1 may include a wellhead 12, a tubing hanger 14, a tubing hanger alignment device 16, and a tree 18 (which may be a tree body, a spool, or a flowline connection body). As those of ordinary skill in the art will appreciate, the tubing hanger alignment device 16 may be coupled to the tubing hanger 14 or tree 18 (not shown) prior to landing or alternatively landed independent of both devices (not shown). The tree 18 may include various valves for fluidly coupling a vertical bore 20 formed through the tree 18 to one or more downstream production flow paths, such a well jumper, for example. The tree 18 may be connected to and sealed against the wellhead 12. The tubing hanger 14 may be fluidly coupled to the bore 20 of the tree 18.

As shown, the tubing hanger alignment device 16 may connect the tree 18 to the tubing hanger 14. In other embodiments, the tubing hanger alignment device may include a plug that is removably placed within the tubing hanger 14 at one or more times throughout a completion process, as described below. In such cases, the tubing hanger 14 may be connected to and sealed against the tree 18 via an isolation sleeve that is integral with the tree 18.

The tubing hanger 14 may be landed in and sealed against a bore 22 of the wellhead 12, as shown. The tubing hanger 14 may suspend a tubing string 24 into and through the wellhead 12. Likewise, one or more casing hangers (e.g., inner casing hanger 26A and outer casing hanger 26B) may be held within and sealed against the bore 22 of the wellhead 12 and used to suspend corresponding casing strings (e.g., inner casing string 28A and outer casing string 28B) through the wellhead 12.

In the illustrated embodiment, the tubing hanger alignment device 16 may include one or more communication lines (e.g., hydraulic fluid lines, electrical lines, and/or fiber optic cables) 30 disposed therethrough and used to communicatively couple the tree 18 to the tubing hanger 14. The tubing hanger 14 may include couplings or stabs 32 located at the top of the tubing hanger 14 in a specific orientation with respect to a longitudinal axis 34. The tubing hanger alignment device 16 is configured to facilitate a mating connection that communicatively couples the tree 18 to the couplings/stabs 32 on the tubing hanger 14 as the tree 18 is landed onto the wellhead 12, regardless of the orientation in which the tree 18 is initially positioned during the landing process.

Different arrangements of a tubing hanger alignment device 16 will now be disclosed in the following sections of this description. The tubing hanger alignment device may utilize a coiled tubing alignment mechanism, a helical slot alignment mechanism, a torsional spring alignment mechanism, or a plug-based alignment mechanism.

Coiled Tubing Alignment Mechanism

A tubing hanger alignment device 16 having a coiled tubing mechanism will be described with reference to FIGS. 2 and 3. The tubing hanger alignment device 16 of FIG. 2 includes a mule shoe sub 110, an alignment key 112, a production stab sub 114, and one or more lengths of coiled hydraulic tubing and/or electrical conduits 116. The arrangement and interaction of these components will now be described.

The mule shoe sub 110 may house standard hydraulic, electric, and/or fiber optic couplings 118 that interface with the corresponding couplings/stabs 32 at a top end of the tubing hanger 14 upon landing of the tree 18. The mule shoe sub 110 is generally mounted to the production stab sub 114, as shown. The mule shoe sub 110 may include hydraulic fluid ports and/or electrical cables 120 extending therethrough. The ports and/or cables 120 may be connected to or through the coiled hydraulic tubing and/or electrical conduits 116 at the top of the mule shoe sub 110 to allow the mule shoe sub 110 to rotate relative to the body of the tree 18. Electrical cables and/or hydraulic ports 120 disposed through the mule shoe sub 110 are terminated to a series of dry mate electric contacts and/or hydraulic connectors (i.e., the hydraulic, electric, and/or fiber optic couplings 118) that interface with the tubing hanger 14 at the bottom of the mule shoe sub 110.

The mule shoe sub 110 is able to rotate relative to the tree body 18 and the production stab sub 114. A mule shoe profile drives the mule shoe sub 110 to rotate as it is lowered through the wellhead 12. The mule shoe profile 122 is illustrated in FIG. 3. The mule shoe profile 122 is a profile formed about the outer circumference of the mule shoe sub 110, as shown. The mule shoe profile 122 may feature a protruding edge that slopes in a relatively downward direction (arrow 124) from one side of the mule shoe sub 110 in both directions circumferentially around the mule shoe sub 110 (arrows 126) to an opposite side 128 of the mule shoe sub 110. At the lowest point on the side 128 of the mule shoe profile 122, the profile 122 may include an alignment slot 130. The alignment slot 130 may be oriented in the downward direction (arrow 124).

Figure 2:
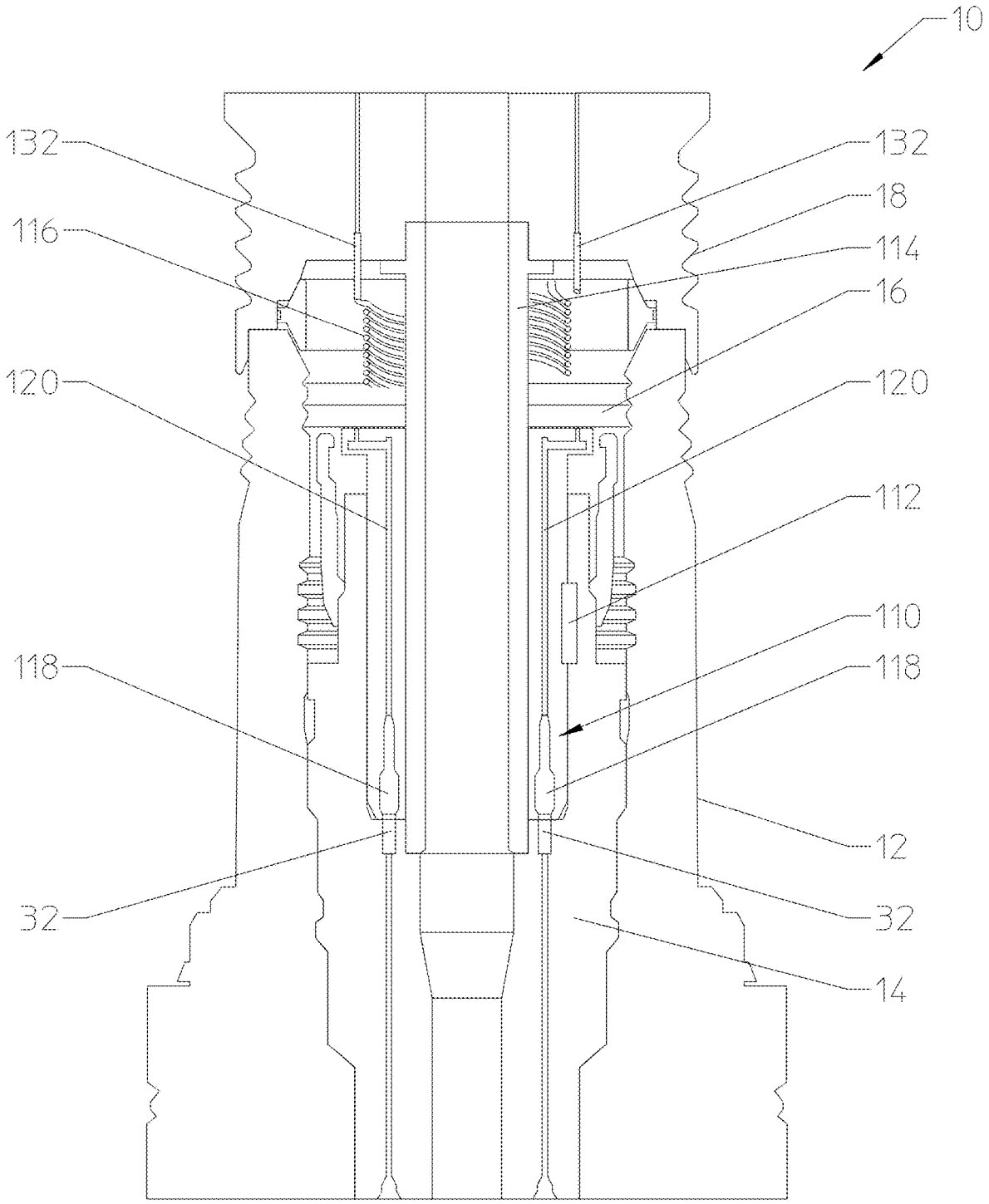
FIG. 2 is a cross-sectional view of a production system comprising a tubing hanger alignment device with a coiled tubing alignment mechanism, in accordance with an embodiment of the present disclosure.

As shown in FIG. 2, the alignment key 112 may be mounted directly to the tubing hanger 14. The mule shoe profile 122 may drive the mule shoe sub 110 to rotate against the alignment key 112 until the alignment key 112 is set into the alignment slot 130. At this point, the mule shoe sub 110 will be properly oriented relative to the tubing hanger 14 so as to make the desired mating connections at the interface of couplings 118 and 32. As such, rotation of the mule shoe sub 110 stops when the couplings 118 of the mule shoe sub 110 are aligned to the couplings 32 on the tubing hanger 14.

The production stab sub 114 may be mounted to the tree body 18. The mule shoe sub 110 is disposed around an outer circumference of the production stab sub 114. The production stab sub 114 may retain the mule shoe sub 110 thereon while allowing the mule shoe sub 110 rotational freedom about the production stab sub 114. As such, the production stab sub 114 rotationally couples the mule shoe sub 110 to the tree 18. The mule shoe sub 110 is able to rotate relative to the production stab sub 114 and the tree 18 as the tree 18 is being lowered into the wellhead 12.

The coiled hydraulic tubing (116) provides a communication path for hydraulic fluid being communicated from fluid ports in the tree 18 to corresponding fluid ports in the mule shoe sub 110 and ultimately the tubing hanger 14. The coiled arrangement of the hydraulic tubing (116) allows the tubing to flex as the mule shoe sub 110 rotates in either direction to align the couplings 118 with those of the tubing hanger 14 while the tree 18 is being lowered.

The electrical conduits (116) provide a communication path for electrical and/or fiber optic signals being communicated from cables in the tree 18 to corresponding cables in the mule shoe sub 110 and ultimately the tubing hanger 14. The coiled arrangement of the electrical conduits (116) allows the conduit to flex as the mule shoe sub 110 rotates in either direction to align the couplings 118 with those of the tubing hanger 14 while the tree 18 is being lowered.

A general description of a method for operating the tubing hanger alignment device 16 of FIGS. 2 and 3 will now be described. The production stab sub 114 may be installed onto a lower portion of the tree 18. The production stab sub 114 may be coupled to the tree 18 via threads, a lock ring, or any other known method. The production stab sub 114 may be connected to the tree 18 in a manner that does not allow rotation of the production stab sub 114 relative to the tree 18. In other embodiments, the production stab sub 114 may be formed integral with the tree 18.

The method may also include installing the mule shoe sub 110 onto the production stab sub 114. The mule shoe sub 110 may be disposed around the outside circumference of the generally cylindrical production stab sub 114, and the mule shoe sub 110 may be rotatably coupled to the production stab sub 114. The mule shoe sub 110, for example, may be connected to the outside of the production stab sub 114 via a bearing interface that enables free rotation of the mule shoe sub 110 around the production stab sub 114 while these components are lowered through the wellhead 12.

The one or more lengths of hydraulic tubing and/or electrical conduits 116 may be connected between the bottom of the tree body 18 and the top of the mule shoe sub 110. The electrical conduits and/or hydraulic tubing 116 may be coiled around the outer diameter of the production stab sub 114 in a space located longitudinally between the tree 18 and the mule shoe sub 110. In some embodiments, the conduits and/or tubing 116 may be extended upward from the connected cables and/or ports 120 in the mule shoe sub 110, coiled one or more times each around the production stab sub 114, and connected to contacts 132 at a lower end of the tree body 18. In other embodiments, the conduits and/or tubing 116 may be extended from an interface at the lower end of the tree body 18, coiled one or more times each around the production stab sub 114, and connected to cables and/or ports 120 in the mule shoe sub 110 via contacts at an upper end of the mule shoe sub 110.

During assembly of the tubing hanger assembly, the alignment key 112 is installed along an inner diameter of the tubing hanger 14. The alignment key 112 may be installed securely within a recess formed in the tubing hanger 14 along the inner diameter. As shown, the alignment key 112 is disposed in a particular position along the circumference of the inner surface of the tubing hanger 14. The alignment key 112 does not extend about the entire circumference of the inner surface of the tubing hanger 14. The alignment key 112 may be installed via a fastener such as a bolt or screw into the recess of the tubing hanger 14. The alignment key 112 may have a width that is sized to be received into the vertical portion of alignment slot 130 of the mule shoe profile 122 associated with the mule shoe sub 110.

Upon assembly of the above components, the tubing hanger 14 may be run into the wellhead 12 in any orientation, locked into place, and sealed within the wellhead 12. The tree assembly having the tree body 18 and the tubing hanger alignment device 16 (i.e., production stab sub 114, mule shoe sub 110, and coiled tubing/conduits 116) is then run and oriented into a desired location in the wellhead 12 prior to landing within the wellhead 12.

While the tree 18 is landed from an initial position in the wellhead 12 to its final connected position, the mule shoe sub 110 may engage the alignment key 112 so as to orientate the couplings 32 and 118 associated with the tubing hanger 14 and the mule shoe sub 110, respectively. The mule shoe profile 122 on the outer edge of the mule shoe sub 110 may directly engage the alignment key 112 on the tubing hanger 14. Lowering the tree 18 further causes the mule shoe sub 110 to rotate about the production stab sub 114 and align with the tubing hanger 14. That is, the stationary alignment key 112 forces the mule shoe sub 110 to rotate in one direction or the other (depending on the direction of the slope of the mule shoe profile 122 at the point of initial contact with the alignment key 112) as the tree 18 is lowered until the alignment key 112 is received into the alignment slot 130 of the mule shoe profile 122. At this point, the mule shoe sub 110 will be in a proper alignment with the tubing hanger 14.

The tree 18 may then be landed and locked to the wellhead 12. All couplings between the mule shoe sub 110 and the tubing hanger 14 will be engaged at this point. The hydraulic, electric, and/or fiber optic couplings between the tree 18 and the tubing hanger 14 will then be tested to ensure a proper connection has been made.

Figure 3:
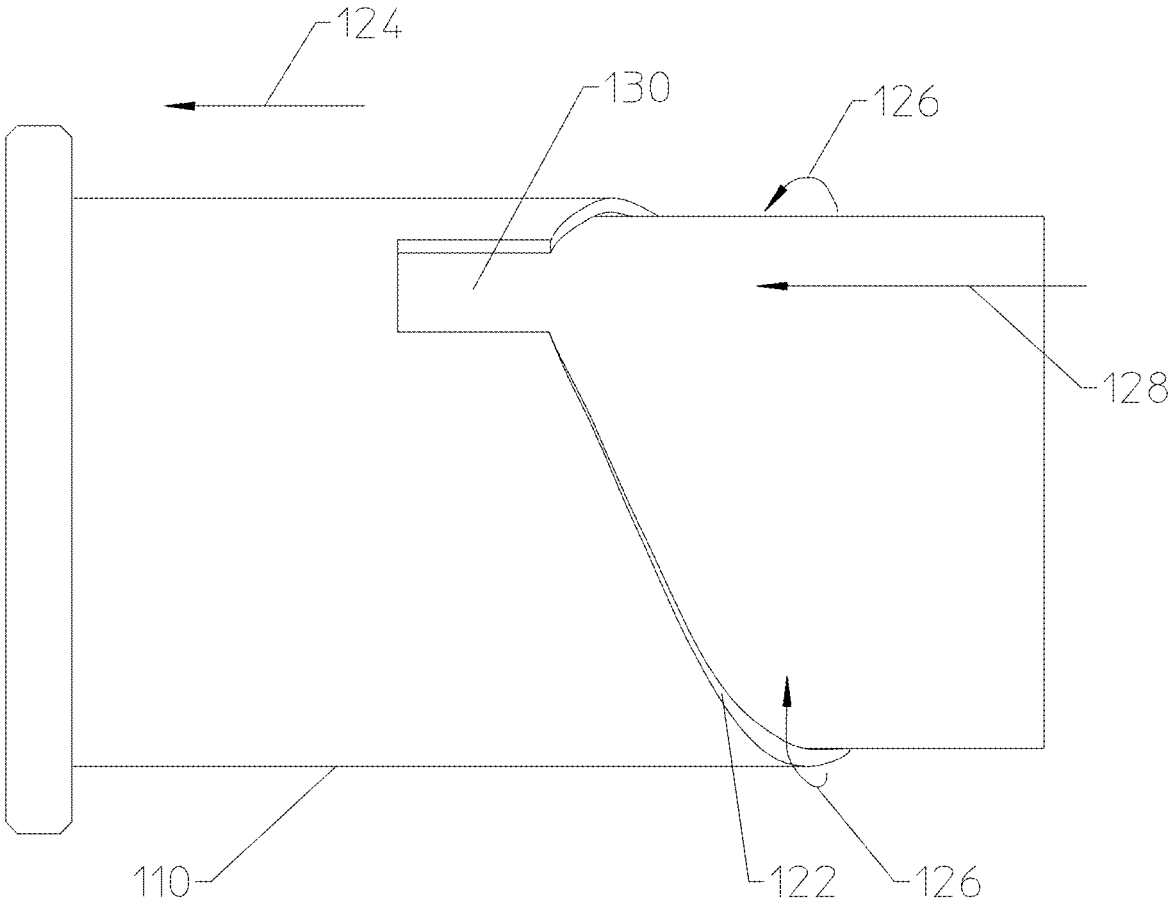
FIG. 3 is a perspective view of a mule shoe sub used in the tubing hanger alignment device of FIG. 2, in accordance with an embodiment of the present disclosure.

The disclosed tubing hanger alignment device 16 of FIGS. 2 and 3 may achieve the goal of aligning the tubing hanger penetrations (i.e., couplings/stabs 32 and 118) independent of the orientation about the longitudinal axis in which the tree 18 is landed. The alignment process is passive and resets without manual intervention subsea or on the surface. Existing vendor seals, hydraulic couplers, and electrical connectors of the tubing hanger 14 may be utilized in implementations of the disclosed alignment device 16. Existing tree body designs may need some modification to remove and replace existing couplers with tubing/conduit connections leading to the tubing/conduits 116. Existing tubing hangers may be utilized with only a minor modification to add the alignment key 112. Existing tubing hanger running tools may be utilized without modification.

Coiled Tubing Alignment Mechanism with Multi-Start Alignment Threads

Another embodiment of a tubing hanger alignment device 16 having a coiled tubing mechanism will be described with reference to FIGS. 4A-8B. The tubing hanger alignment device 16 of FIGS. 4A-8B includes a production stab sub 610, an alignment sub 612, an outer timing ring 614, and one or more lengths of coiled hydraulic tubing and/or electrical and/or fiber optic conduits 616. The arrangement and interaction of these components will now be described.

Figure 9:
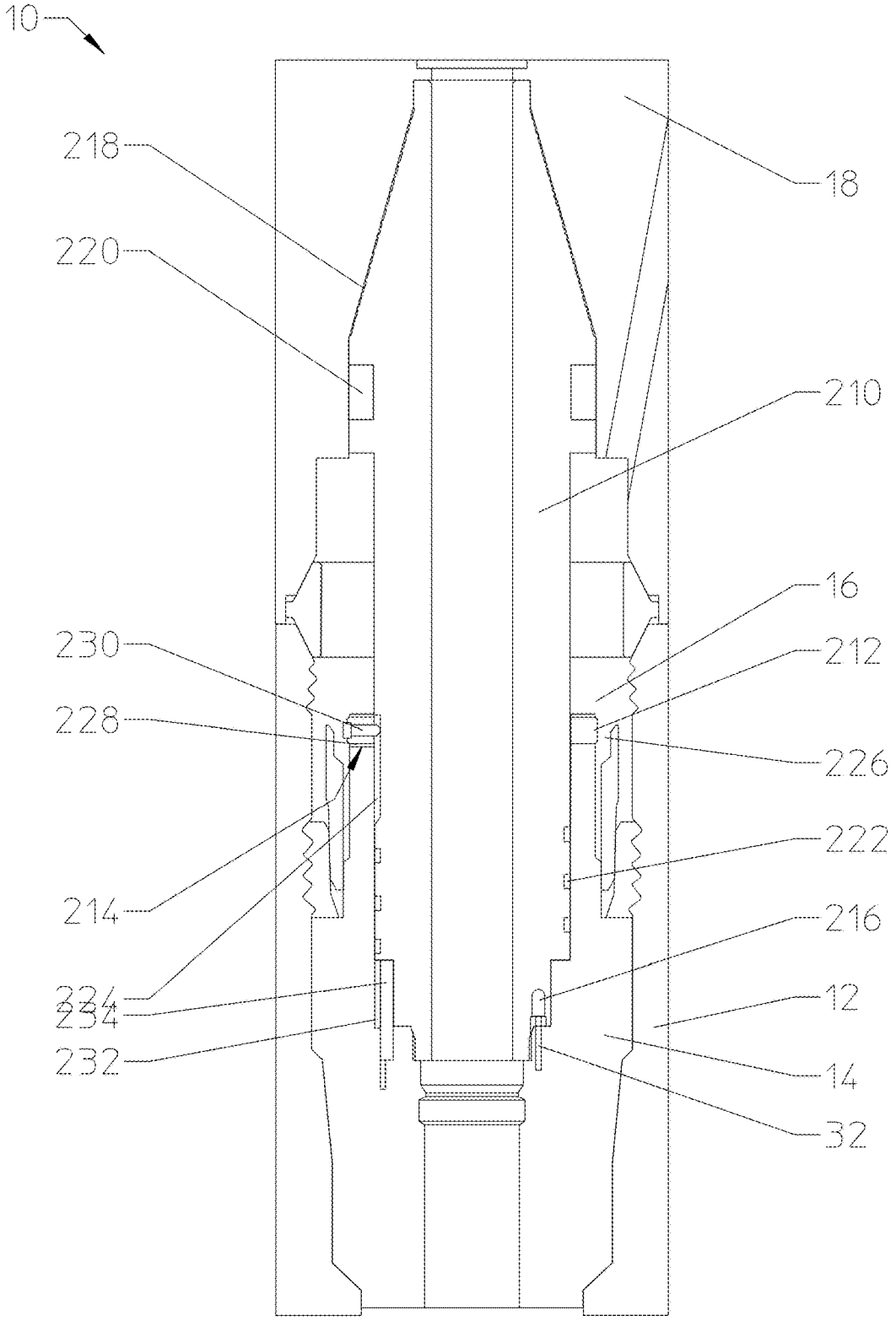
FIG. 9 is a cross-sectional view of a production system comprising a tubing hanger alignment device with a helical slot alignment mechanism, in accordance with an embodiment of the present disclosure.

Similar to the mule shoe sub 110 of FIG. 2 and the alignment body of FIG. 9, the alignment sub 612 may house standard hydraulic, electric, and/or fiber optic couplings 118 that interface with the corresponding couplings/stabs at a top end of the tubing hanger (not shown) upon landing of the tree (not shown). The alignment sub 612 is generally mounted to the production stab sub 610, as shown. In the running position, the alignment sub 612 extends downward to approximately the same ultimate position as that of the production stab sub 610, so that the alignment sub 612 provides a protective barrier between seals 618 at a lower end of the production stab sub 610 and external components.

The alignment sub 612 includes hydraulic fluid ports and/or electrical cables 120 extending therethrough. The ports and/or cables 120 may be connected to or through the coiled hydraulic tubing and/or electrical and/or fiber optic conduits 616 at the top of the alignment sub 612 to allow the alignment sub 612 to rotate relative to the body of the tree. Electrical cables and/or hydraulic ports 120 disposed through the alignment sub 612 may be terminated to a series of electric/fiber contacts and/or hydraulic connectors (i.e., such as the hydraulic, electric, and/or fiber optic couplings 118) that interface with the tubing hanger at the bottom of the alignment sub 612.

Similar to the embodiments of FIG. 2 and FIG. 9, the alignment sub 612 is able to rotate relative to the tree body (not shown) and the production stab sub 610. Similar to the embodiment of FIG. 9, this rotation is driven by the outer timing ring 614. As illustrated, an external surface of the alignment sub 612 features a plurality of alignment threads 620 formed therein. These alignment threads 620 are a series of helical shaped slots or grooves formed into the alignment sub 612 and spaced about the circumference of the alignment sub 612. Each alignment thread 620 includes an independent starting point at the bottom thereof, each starting point designed to receive a corresponding pin 622 of the outer timing ring 614. In the illustrated embodiment, the alignment threads 620 include a six-pitch alignment thread, meaning there are six starting points corresponding to six threads. Other numbers of threads are possible in other embodiments as well. The outer timing ring 614 includes a plurality of pins 622, which extend from an internal diameter of the outer timing ring 614 in a radially inner direction and are located in corresponding alignment threads 620 of the alignment sub 612. As such, the outer timing ring 614 generally functions as a nut riding on the threads 620 of the alignment sub 612. At an upper portion of the alignment sub 612, the alignment threads 620 transition into vertical alignment slots 624 located around the circumference of the alignment sub 612.

The outer timing ring 614 includes one or more key features designed to interact with complementary key features of the tubing hanger (not shown). For example, as shown, the outer timing ring 614 may feature lugs 626 extending in a downward direction from a lower surface of the outer timing ring 614. These lugs 626 are designed to interface with corresponding grooves or slots formed in an upward facing surface of the tubing hanger (not shown) to time the start of alignment rotation so that couplings 118 at the bottom of the alignment sub 612 will be aligned with the corresponding couplings/stabs at the top of the tubing hanger. The lugs 626 may include three lugs, four lugs, or some other number of lugs. The lugs 626 on the outer timing ring 614 may be unevenly spaced from each other around the circumference of the outer timing ring 614, unevenly spaced in a radial direction from a longitudinal axis of the outer timing ring, extending different lengths in the longitudinal direction, or a combination thereof. The corresponding grooves or slots extending into the tubing hanger may be arranged in a similar unevenly positioned manner. That way, the lugs 626 of the outer timing ring 614 are received into the corresponding grooves or slots of the tubing hanger only when the outer timing ring 614 is in a particular orientation with respect to the tubing hanger about a longitudinal axis.

It should be noted that, in other embodiments, the key features on the outer timing ring and the tubing hanger may be reversed, such that the outer timing ring includes keyed slots or grooves formed therein to be received on upwardly extending lugs of the tubing hanger.

The outer timing ring 614 seats the tubing hanger alignment device 16 in a desired orientation within the tubing hanger, regardless of how the tubing hanger is oriented within the wellhead. Once the outer timing ring 614 is keyed into the tubing hanger, it cannot be rotated with respect to the tubing hanger. The alignment sub 612 then moves downward, rotating with respect to the stationary outer timing ring 614 until it reaches an aligned position relative to the tubing hanger (not shown) for making the desired fluid, electric, and/or fiber optic connections. At this point, the alignment sub 612 will be properly oriented relative to the tubing hanger so as to make the desired mating connections at the interface of couplings 118 and (32 of FIG. 1). As such, rotation of the alignment sub 612 stops when the couplings 118 of the alignment sub 612 are aligned to the couplings 32 on the tubing hanger.

The production stab sub 610 may be mounted to the tree body (not shown), similar to the production stab sub 114 of FIG. 2. The alignment sub 612 is disposed around an outer circumference of the production stab sub 610. The production stab sub 610 may retain the alignment sub 612 thereon while allowing the alignment sub 612 rotational freedom about the production stab sub 610. As such, the production stab sub 610 rotationally couples the alignment sub 612 to the tree. The alignment sub 612 is able to rotate relative to the production stab sub 610 and the tree as the tree is lowered onto the wellhead.

The alignment sub 612 may be equipped with an actuation mechanism 628 used to release the production stab sub 610 from the alignment sub 612 so that the production stab sub 610 can move in a longitudinal direction with respect to the alignment sub 612. The actuation mechanism 628 is designed so that it can only be activated once the alignment sub 612 is in an aligned position with respect to the tubing hanger. In the illustrated embodiment, the actuation mechanism 628 includes one or more actuation buttons 630 and a split ring 632. The split ring 632 is held in position within a circumferential groove formed along a radially inner diameter of the alignment sub 612. The split ring 632 is biased in a radially outward direction so that it retains the alignment sub 612 at a particular longitudinal position relative to the production stab sub 610. Although not shown, the split ring 632 may be coupled to the production stab sub 610 via a shoulder or some other attachment feature. The actuation buttons 630 may extend from a radially outer diameter of the alignment sub 612 to the radially inner diameter of the alignment sub 612 where the split ring 632 is retained. A force applied in a radially inward direction to the one or more buttons 630 presses the buttons 630 into the split ring 632, thereby collapsing the split ring 632 so that the alignment sub 612 is no longer held in a fixed longitudinal position with respect to the production stab sub 610. This enables the production stab sub 610 to move further downward so that the seals 618 at the bottom thereof can be extended to interface with the tubing hanger.

While in the retracted position, gallery seals are not energized, allowing for free rotation of the alignment sub 612 around the production stab sub 610. Once the gallery seals are engaged, they will prevent further rotation such that the tree can be removed and reinstalled in the same orientation.

The coiled hydraulic tubing (616) provides a communication path for hydraulic fluid being communicated from fluid ports in the tree to corresponding fluid ports in the alignment sub 612 and ultimately the tubing hanger. The coiled arrangement of the hydraulic tubing (616) allows the tubing to flex as the alignment sub 612 rotates to align the couplings 118 with those of the tubing hanger while the tree is being lowered.

The electrical conduits (616) provide a communication path for electrical and/or fiber optic signals being communicated from cables in the tree to corresponding cables in the alignment sub 612 and ultimately the tubing hanger. The coiled arrangement of the electrical conduits (616) allows the conduit to flex as the alignment sub 612 rotates to align the couplings 118 with those of the tubing hanger while the tree is being lowered.

Figure 4A:
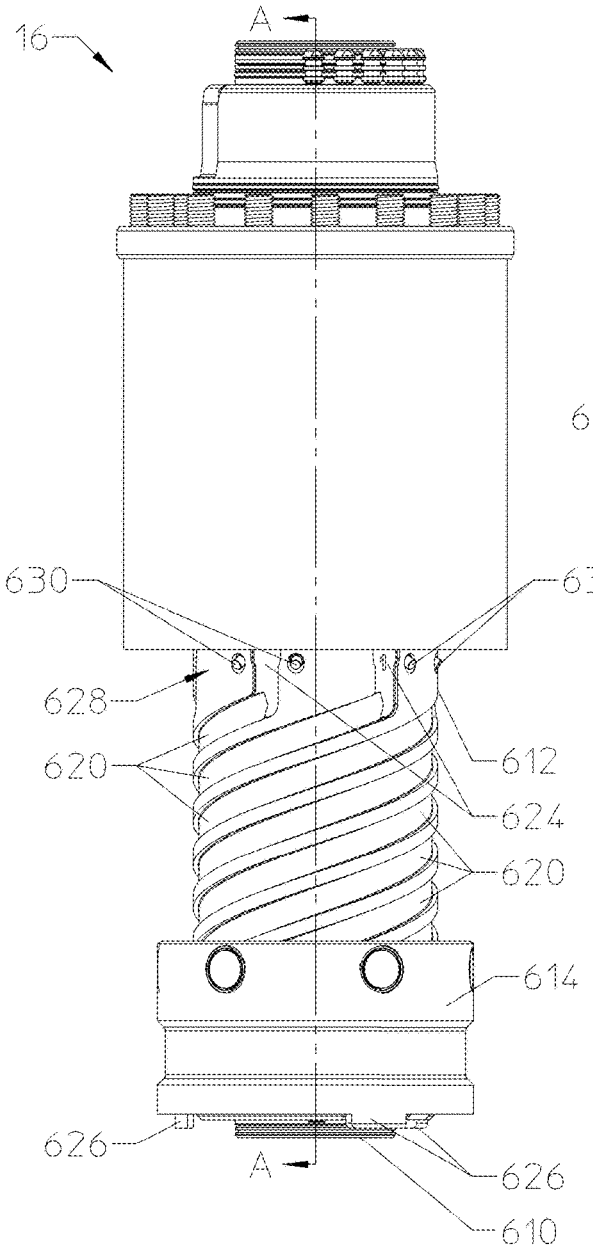
FIGS. 4A and 4B are a perspective view and a cross-sectional view, respectively, of a tubing hanger alignment device in a running configuration with a coiled tubing alignment mechanism, in accordance with an embodiment of the present disclosure.
Figure 4B:
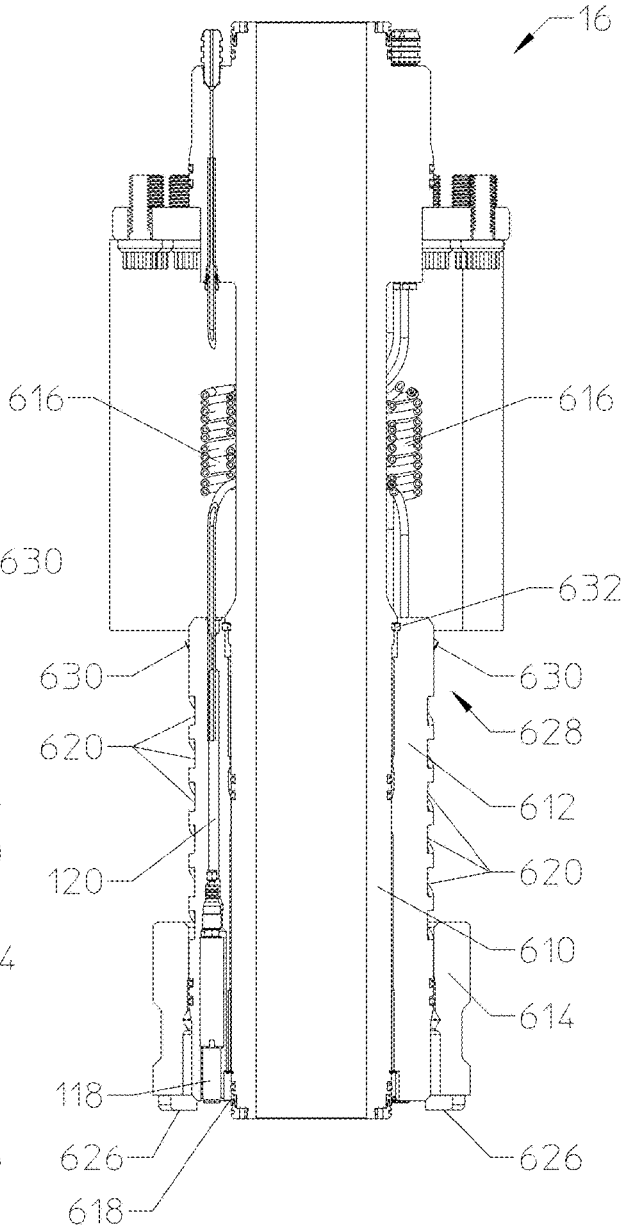

A general description of a method for operating the tubing hanger alignment device 16 of FIGS. 4A-8B will now be provided. FIGS. 4A and 4B show the tubing hanger alignment device 16 in a running configuration. This is the configuration of the tubing hanger alignment device 16 during the initial stage of lowering the tubing hanger alignment device 16 with the tree toward the wellhead. In this configuration, the outer timing ring 614 is located at the lower end of the alignment sub 612, with the pins 622 positioned in their corresponding alignment threads 620 where the threads begin. The components of the tubing hanger alignment device 16 remain in this position until the tubing hanger alignment device 16 is positioned in the wellhead just above the tubing hanger. Once the tubing hanger alignment device 16 is lowered far enough that the outer timing ring 614 contacts the tubing hanger in the wellhead, the outer timing ring 614, the alignment sub 612, or both, may rotate relative to the tree until the key features (e.g., lugs 626) at the bottom of the outer timing ring 614 are received into the corresponding features (e.g., grooves or slots) of the tubing hanger.

Figure 5A:
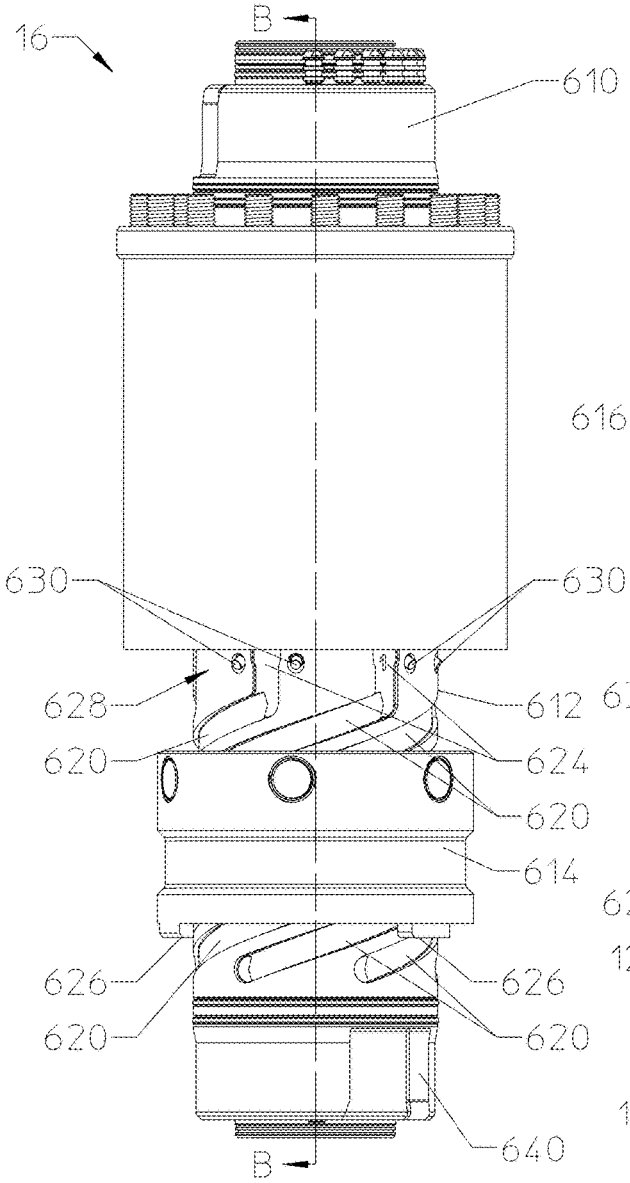
FIGS. 5A and 5B are a perspective view and a cross-sectional view, respectively, of the tubing hanger alignment device of FIGS. 4A and 4B in an aligning configuration, in accordance with an embodiment of the present disclosure.
Figure 5B:
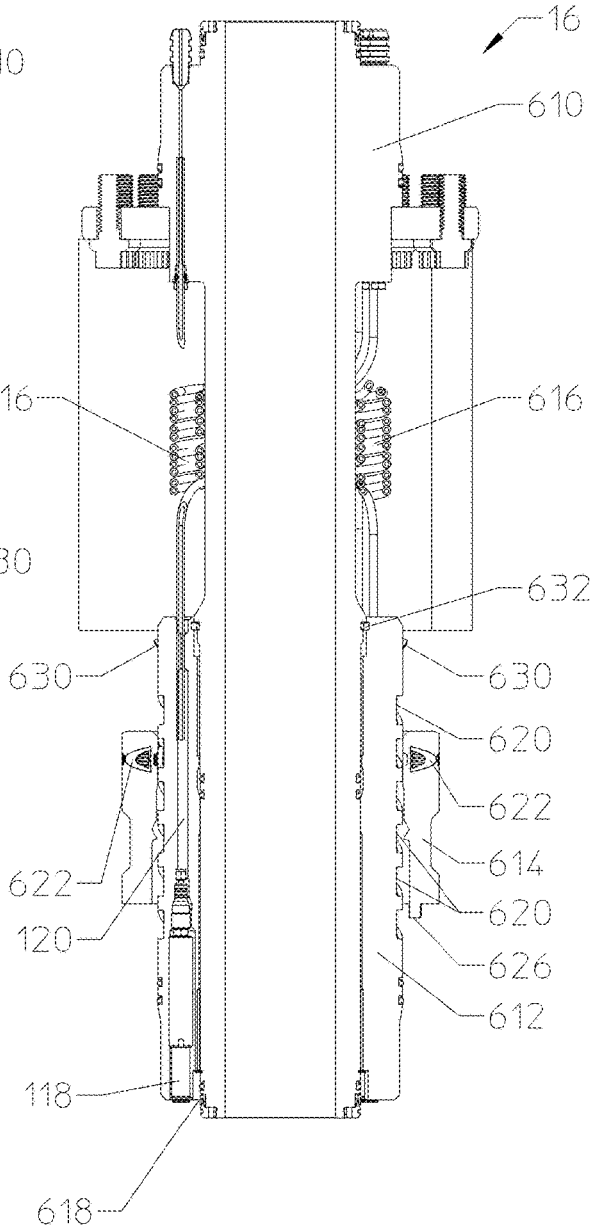

Once the outer timing ring 614 is firmly seated within the tubing hanger, further downward force applied to the tree causes the alignment sub 612 to rotate relative to the outer timing ring 614 and the tubing hanger. This is illustrated in FIGS. 5A and 5B. The tree and production stab sub 610 are being lowered relative to the tubing hanger and the outer timing ring 614, while the outer timing ring 614 is held stationary within the tubing hanger. With its pins 622 engaged in the alignment threads 620 of the alignment sub 612, the outer timing ring 614 drives the alignment sub 612 to rotate toward an aligned position relative to the tubing hanger where the hydraulic, electric, and/or fiber optic couplings 118 of the alignment sub 612 are aligned with those of the tubing hanger. As this is happening, the coiled tubing 616 flexes to maintain the connections between the tree and the alignment sub 612 while the alignment sub 612 rotates relative to the tree.

Figure 6A:
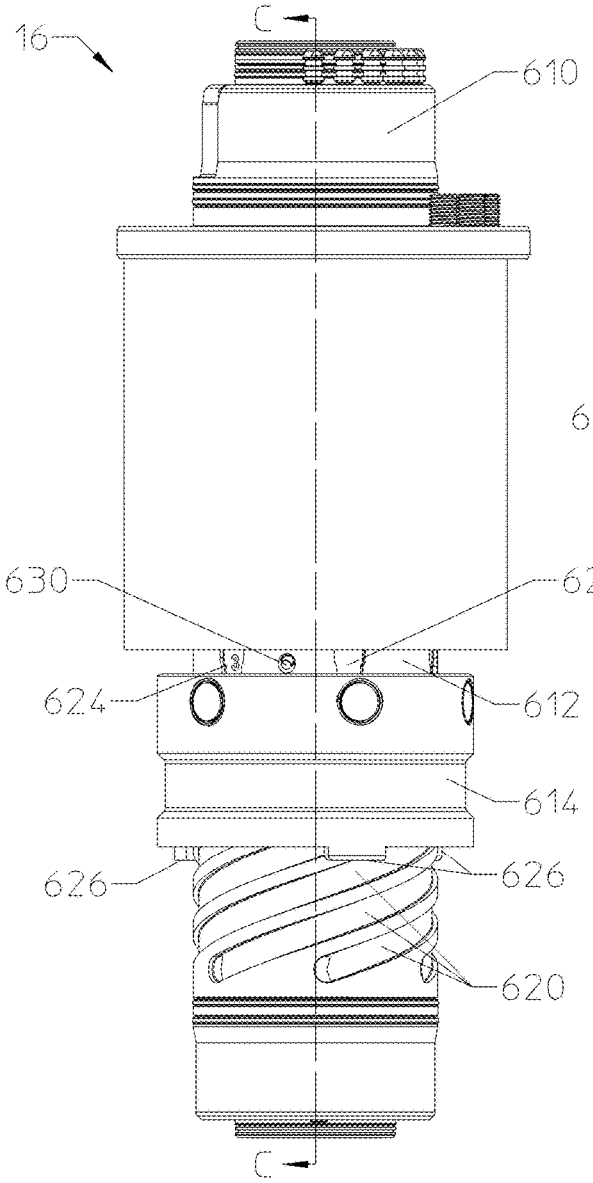
FIGS. 6A and 6B are a perspective view and a cross-sectional view, respectively, of the tubing hanger alignment device of FIGS. 4A-5B in an aligned configuration, in accordance with an embodiment of the present disclosure.
Figure 6B:
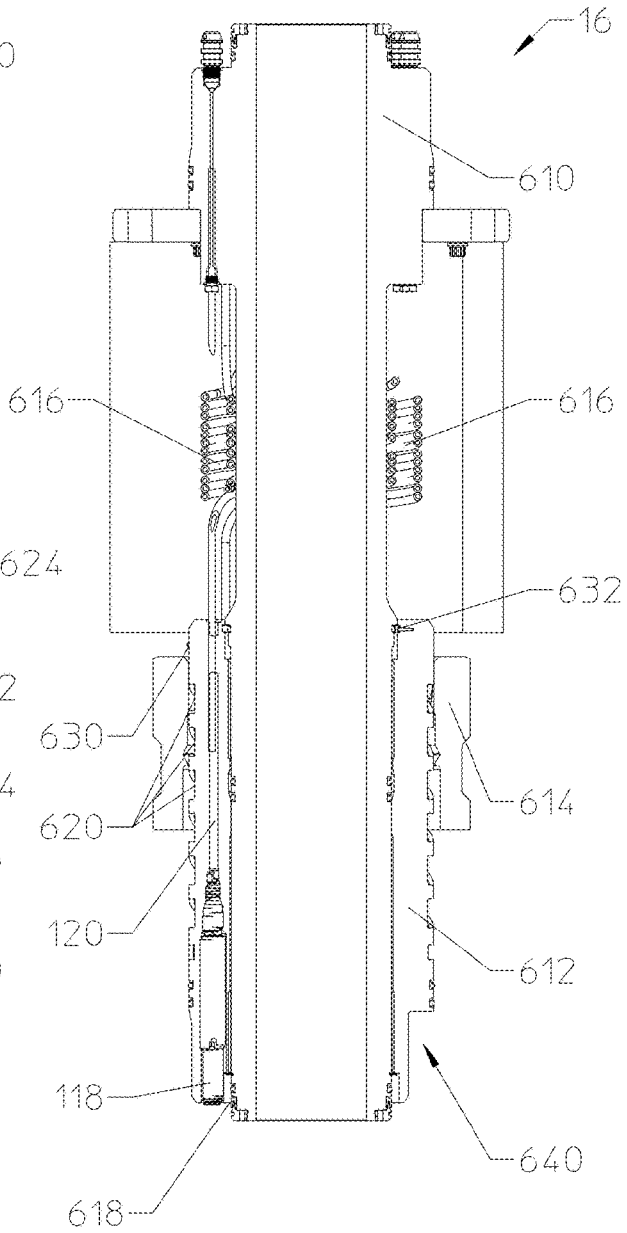
Figure 7A:
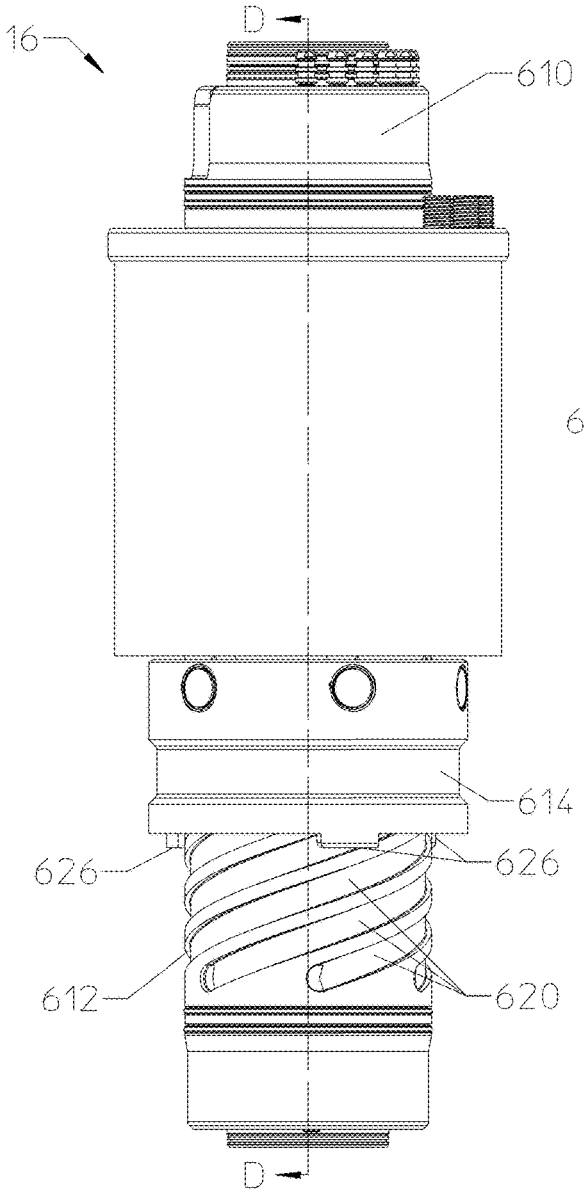
FIGS. 7A and 7B are a perspective view and a cross-sectional view, respectively, of the tubing hanger alignment device of FIGS. 4A-6B in a configuration with the lower body released, in accordance with an embodiment of the present disclosure.
Figure 7B:
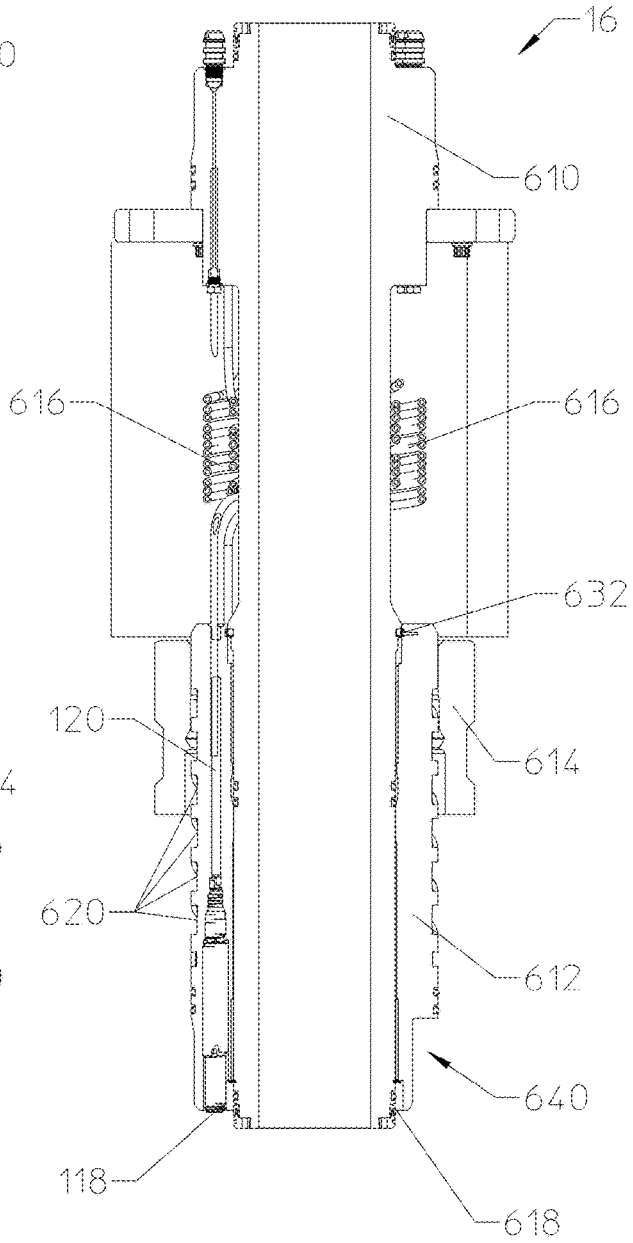

When the outer timing ring 614 reaches the top of the alignment threads 620, the alignment sub 612 and its couplings 118 will be rotationally aligned with the connectors of the tubing hanger, and the pins 622 of the outer timing ring 614 will enter the vertical alignment slots 624. This aligned configuration is shown in FIGS. 6A and 6B. From here, further downward force on the tree and tubing hanger alignment device 16 will cause the alignment sub 612, the production stab sub 610, and the tree to move vertically downward relative to the outer timing ring 614 and the tubing hanger. This position is shown in FIGS. 7A and 7B. In this position, the couplings 118 of the alignment sub 612 are just above the corresponding connectors of the tubing hanger, and the outer timing ring 614 is in a position where it is covering/depressing the actuation buttons 630 at the top of the alignment sub 612. These actuation buttons 630, once depressed, push the split ring 632 radially inward to release the production stab sub 610 so that it can travel longitudinally with respect to the alignment sub 612.

In some embodiments, the alignment sub 612 may be equipped with a final/fine alignment slot 640, and the tubing hanger may be equipped with a corresponding final/fine alignment key. The layout and description of these final/fine alignment features is discussed at length below with reference to final alignment key 232 and final alignment slot 234 of FIG. 9. Similar final/fine alignment features (e.g., alignment slot 640 and a corresponding key on the tubing hanger) may be implemented in the embodiment of FIGS. 4A-8B as well. The final alignment would be made via the alignment slot 640 and corresponding key while the alignment sub 612 is moving vertically downward relative to the outer timing ring 614 engaged with the vertical alignment slots 624.

Figure 8A:
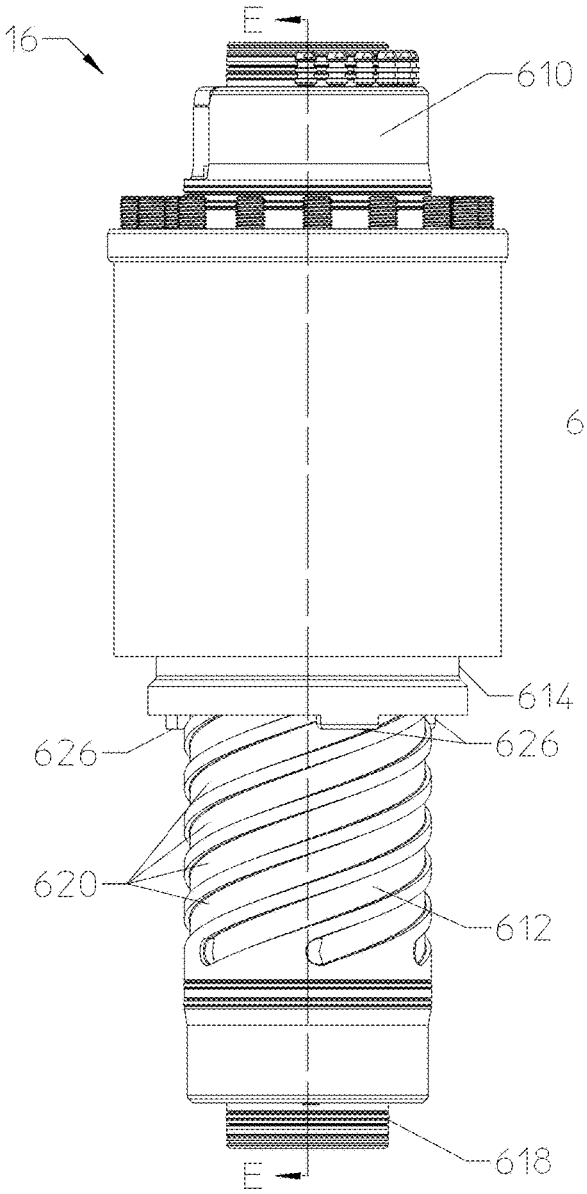
FIGS. 8A and 8B are a perspective view and a cross-sectional view, respectively, of the tubing hanger alignment device of FIGS. 4A-7B in a landed configuration, in accordance with an embodiment of the present disclosure.
Figure 8B:
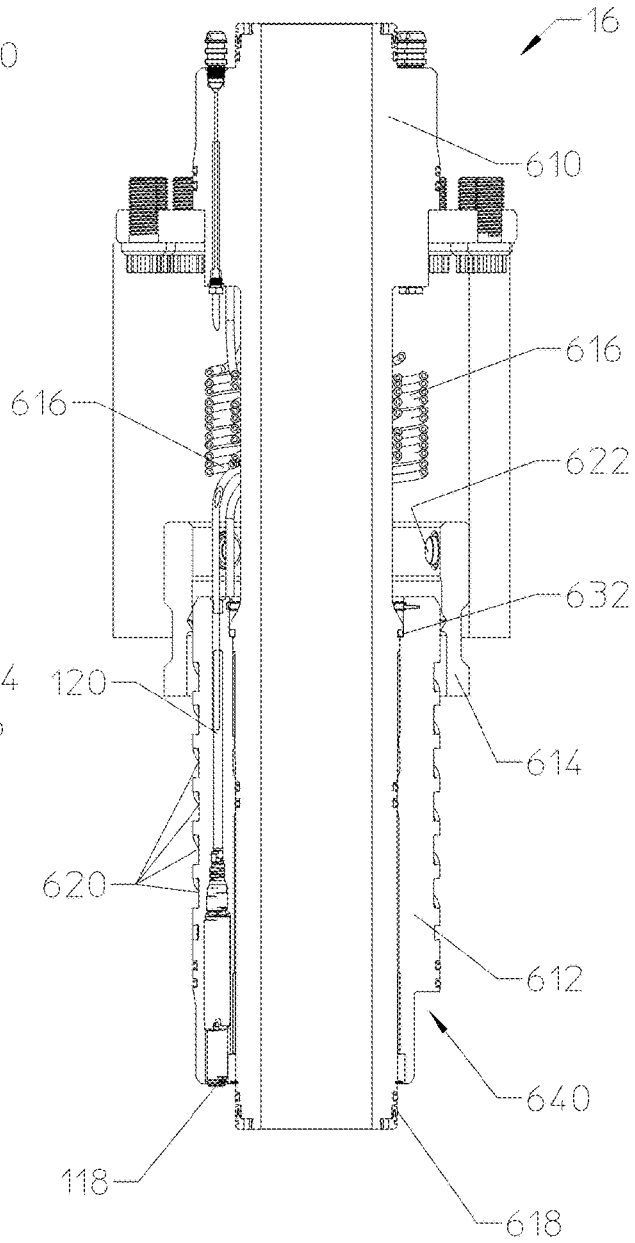

At this point, further lowering of the tree causes the production stab sub 610 to move downward relative to the alignment sub 612, uncovering the seals 618 at the lower end thereof and engaging gallery seals. The production stab sub 610 will move downward, stabbing into the tubing hanger and activating the seals 618 against the tubing hanger interface. The alignment sub 612 may also be lowered a certain amount to complete the stabbing connections between the couplings 118 and the corresponding connectors of the tubing hanger. This brings the tubing hanger alignment device 16 to the fully landed position within the wellhead, as shown in FIGS. 8A and 8B.

The tubing hanger alignment device 16 of FIGS. 4A-8B is similar to the embodiment of the tubing hanger alignment device 16 of FIGS. 2 and 3, except for the addition of the outer timing ring 614 used to rotate the alignment sub 612 and to actuate the split ring 632, enabling downward movement of the production stab sub 610 relative to the alignment sub 612. This arrangement, which allows for the downward movement of the production stab sub 610 relative to the alignment sub 612, facilitates protection of the seals 618 at the bottom of the production stab sub 610 during initial lowering of the system through the wellhead.

The disclosed tubing hanger alignment device 16 of FIGS. 4A-8B may achieve the goal of aligning the tubing hanger penetrations (i.e., couplings/stabs 32 and 118) independent of the orientation about the longitudinal axis in which the tree 18 is landed. The alignment process is passive. Existing vendor seals, hydraulic couplers, and electrical connectors of the tubing hanger 14 may be utilized in implementations of the disclosed alignment device 16. Existing tree body designs may need some modification to remove and replace existing couplers with tubing/conduit connections leading to the tubing/conduits 616. Existing tubing hangers may be utilized with only a minor modification to add the keyed features for interfacing with the outer timing ring 614. Existing tubing hanger running tools may be utilized without modification Helical Slot Alignment Mechanism A tubing hanger alignment device 16 having a helical slot mechanism will be described with reference to FIGS. 9 and 10. The tubing hanger alignment device 16 of FIG. 9 includes an alignment body 210, a timing ring 212, and a timing hub 214. The arrangement and interaction of these components will now be described.

The alignment body 210 may be a single, solid piece that houses standard type (or actuated type) hydraulic, electric, and/or fiber optic couplings 216 that interface with the corresponding couplings/stabs 32 at a top end of the tubing hanger 14. In this embodiment, the alignment body 210 may function as the production stab sub that is coupled directly to the tree body 18. In other embodiments, however, a separate annular production stab sub captured within the alignment body 210 may be used.

The alignment body 210 may include a hydraulic port (not shown) extending therethrough and routed to a hydraulic gallery 218. The hydraulic gallery 218 is open to and in fluid communication with a hydraulic port (not shown) formed through the tree 18 as well. The hydraulic gallery 218 is located in an annular space between the tree body 18 and the alignment body 210, and the hydraulic gallery 218 extends entirely around the circumference of the alignment body 210. The hydraulic gallery 218 allows for rotation of the alignment body 210 relative to the tree 18 while maintaining fluid communication between the hydraulic port in the tree body 18 and the hydraulic port in the alignment body 210.

The alignment body 210 may include electric and/or fiber optic cables (not shown) extending therethrough and routed to an electrical/fiber optic gallery 220. The electric and/or fiber optic cables may be coiled in the electrical/fiber optic gallery 220 between the alignment body 210 and the tree 18. The electric and/or fiber optic cables may extend from the alignment body 210, through the gallery 220, and into the tree body 18. Containing the electric and/or fiber optic cables in a coiled arrangement within the gallery 220 may enable the alignment body 210 to rotate relative to the tree body 18 since the cables are able to flex in response to such movements of the alignment body 210. The cables located within the alignment body 210 may terminate at a series of dry mate electric contacts (couplings 216) on a lower end of the alignment body 210 designed to rotate relative to the tree 18.

The alignment body 210 includes one or more helical slots 222 formed along an outer surface thereof. The helical slot 222 can be seen more clearly in the illustration of FIG. 10. The helical slot 222 drives the alignment body 210 to rotate relative to the tree body 18 as it is lowered with the tree 18. Rotation of the alignment body 210 may stop when the hydraulic, electric, and/or fiber optic couplings 216 are aligned to the couplings/stabs 32 on the tubing hanger 14. The one or more helical slots 222 may each have a straight portion 224 at one end to allow for a non-rotating landing of the alignment body couplings 216 onto the tubing hanger couplings/stabs 32.

The timing hub 214 is coupled to the tubing hanger 14, as shown. The timing hub 214 may be directly coupled to the tubing hanger 14 via an attachment mechanism such as a bolt or screw. The timing hub 214 may include specific keying features 226 formed on an upwardly facing surface thereof. These keying features 226 on the timing hub 214 are designed to capture the timing ring 212 when the ring 212 is clocked to a unique position and orientation relative to the tubing hanger 14. The keying features 226 on the timing hub 214 may include slots or holes formed on the upper face of the timing hub 214. The timing ring 212 may include complementary keying features 228 designed to be received directly into the timing hub 214. The illustrated timing hub 214 includes timed slots machined on the upper face thereof. These slots (i.e., keying features 226) are positioned such that only one clocked alignment is possible between the timing ring 212 and the timing hub 214. That is, the timing ring 212 will not lock into the timing hub 214 via engagement by the keying features 226 until the timing ring 212 has rotated to a position relative to the timing hub 214 where the features 228 of the timing ring 212 are received into engagement with the corresponding keying features 226 of the timing hub 214.

The timing ring 212 may be attached to the alignment body 210 via one or more alignment pins 230 that land in corresponding helical slots 222 of the alignment body 210. As mentioned above, the timing ring 212 may include uniquely clocked features 228 that interface with the upper face of the timing hub 214. During lowering of the tree 18 (along with the attached alignment body 210 and timing ring 212), the timing ring 212 may land on the timing hub 214. Once landed, continued lowering of the tree body 18 into the wellhead 12 causes the timing ring 212 to rotate until it is stopped by the timing hub 214 and received into mating engagement with the keying features 226 of the timing hub 214. Once the timing ring 212 has been stopped in the timing hub 214, continued lowering of the tree 18 may cause the alignment body 210 to rotate relative to the tree 18 via movement of the alignment pin 230 along the helical slot 222 of the alignment body 210. This rotation will continue until the couplings 216 of the alignment body 210 are aligned with the couplings 32 on the tubing hanger 14.

Once aligned in this manner, the alignment pin(s) 230 coupled to the timing ring 212 may move out of the helical slot 222 and into the straight vertical portion 224. In some embodiments, the alignment body 210 may engage with the tubing hanger 14 via a final alignment key 232 received in a final alignment slot 234. The final alignment slot 234 may be formed in the alignment body 210, and the final alignment key 232 may extend vertically from an engagement surface of the tubing hanger 14. In other embodiments, this arrangement may be reversed, such that the final alignment key extends from the alignment body 210 so as to be received into a final alignment slot formed in the tubing hanger 14. The final alignment key 232 and slot 234 may provide protection to the couplings 216 and 32 and increase machining tolerances of the helical slot 222, the vertical portion 224, the alignment pins 230, and the keying features of the timing ring 212 and hub 214.

A general description of a method for operating the tubing hanger alignment device 16 of FIGS. 9 and 10 will now be described. The alignment body 210 may be installed into a lower portion of the tree 18, similar to the way a production stab sub is installed in a traditional tree. The timing ring 212 may be installed onto the alignment body 210. Specifically, the timing ring 212 may be disposed around an outer circumference of the alignment body 210, and the alignment pin(s) 230 may be attached directly to the timing ring 212 and extended into the helical slot 222 formed in the alignment body 210.

During construction of the tubing hanger assembly, the timing hub 214 may be installed onto the tubing hanger 14. Specifically, the timing hub 214 may be connected to an upwardly extending portion of the tubing hanger 14 so as to provide a place for seating the timing ring 212 as the tree 18 and alignment body 210 are lowered relative to the tubing hanger 14. The tubing hanger 14 with the connected timing hub 214 may be run in any orientation relative to the wellhead 12 and locked into place within the wellhead 12.

During landing of the tree 18 on the wellhead 12, the timing ring 212 on the alignment body 210 may first land on the timing hub 214. Depending on the initial orientation of the alignment body 210 relative to the tubing hanger 14 and timing hub 214, the timing ring 212 may or may not land directly into a locked position within the timing hub 214. Assuming the timing ring 212 is not in full engagement with the keying features 226 of the timing hub 214 at first, further lowering of the tree 18 may cause the timing ring 212 to rotate relative to the alignment body 210. This rotation of the timing ring 212 relative to the alignment body 210 may be guided by the alignment pin 230 in the helical slot 222. After some rotation, the timing ring 212 may be properly oriented to drop into the slots or other features on the timing hub 214. After dropping into the features on the timing hub 214, the timing ring 212 can no longer rotate with respect to the timing hub 214 and tubing hanger 14.

Lowering the tree 18 further may now cause the alignment body 210 to rotate relative to the tree 18, guided by the helical slot 222 interacting with the stationary alignment pin 230 extending from the timing ring 212. This guiding of the alignment body via the clocked timing ring 212 will cause the alignment body 210 to rotate and align with the tubing hanger 14. Once the alignment body 210 is properly aligned with the tubing hanger 14, the final alignment key 232 may be received into the final alignment slot 234 to finalize the rotational alignment of the couplings 216 on the alignment body 210 to those on the tubing hanger 14.

The tree 18 and alignment body 210 may then be landed and locked to the wellhead 12. All couplings between the alignment body 210 and the tubing hanger 14 will be engaged at this point. The hydraulic, electric, and/or fiber optic couplings between the tree 18 and the tubing hanger 14 will then be tested to ensure a proper connection has been made.

Figure 10:
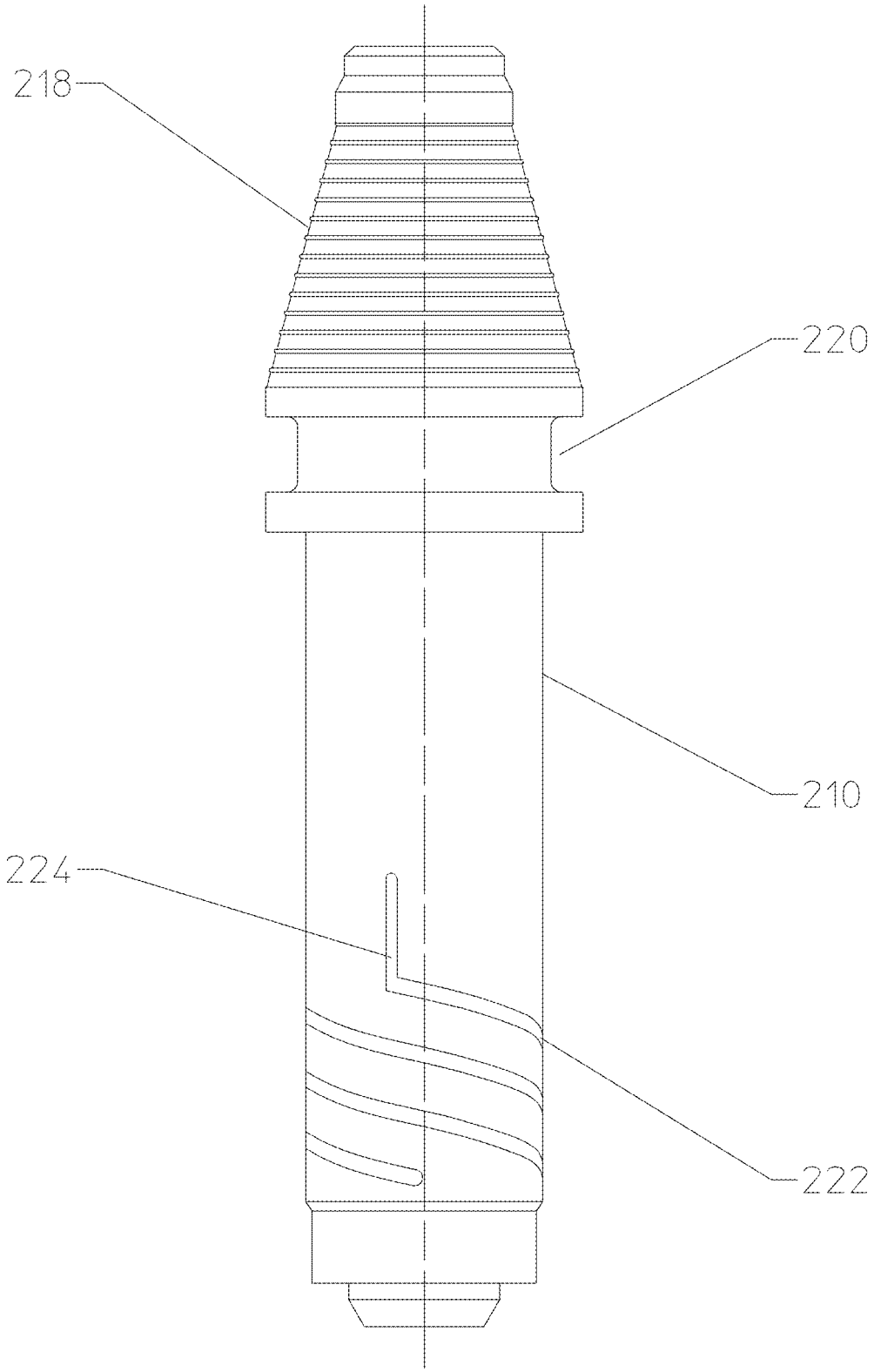
FIG. 10 is a side view of an alignment body used in the tubing hanger alignment device of FIG. 9, in accordance with an embodiment of the present disclosure.

The disclosed tubing hanger alignment device 16 of FIGS. 9 and 10 may achieve the goal of aligning the tubing hanger penetrations (i.e., couplings/stabs 32 and 216) independent of the orientation about the longitudinal axis in which the tree 18 is landed. The alignment process is passive and resets without manual intervention subsea or on the surface. Existing vendor seals, hydraulic couplers, and electrical connectors of the tubing hanger 14 may be utilized in implementations of the disclosed alignment device 16. Existing tree body designs may need some modification to add a gallery seal for the alignment body 210 and/or production stab integration into the lower tree body. Existing tubing hangers may be utilized with only a minor modification to the actuator trap plate. Existing tubing hanger running tools may be utilized without modification.

Torsional Spring Alignment Mechanism

A tubing hanger alignment device 16 having a torsional spring mechanism will be described with reference to FIGS. 11 and 12. The tubing hanger alignment device 16 of FIGS. 11 and 12 includes an upper body 310, a lower body 312, a torsional spring 314, and a trigger assembly 316. The arrangement and interaction of these components will now be described.

The upper body 310 may be a solid piece that houses standard hydraulic, electric, and/or fiber optic couplings 318 that interface with the bottom of the tree 18 to connect hydraulic ports and/or cables in the tree 18 to those in the upper body 310. In this embodiment, the upper body 310 may function as a production stab sub that is coupled directly to the tree body 18. The lower body 312 may be generally disposed around an outer diameter of the upper body 310, as shown. The lower body 312 may be locked in a particular rotational orientation with respect to the upper body 310 prior to release of the lower body 312 via the trigger assembly 316.

The upper body 310 may include one or more hydraulic ports 320 extending therethrough and routed to a hydraulic gallery 322. The hydraulic gallery 322 is open to and in fluid communication with one or more hydraulic ports 324 formed through the lower body 312 as well. The hydraulic gallery 322 may be located in an annular space located between the upper body 310 and the lower body 312, or the hydraulic gallery 322 may be located entirely within the lower body 312 as shown. The hydraulic gallery 322 may extend entirely around the circumference of the upper body 310. The hydraulic gallery 322 allows for rotation of the lower body 312 relative to the upper body 310 while maintaining fluid communication from the between the hydraulic port 320 in the upper body 310 and the hydraulic port 324 in the lower body 312.

The electric couplings (318) may be wired through the upper body 310 to a series of dry mate electric contacts (not shown) that sit between the upper body 310 and the lower body 312. These electric contacts may allow rotation of the lower body 312 with respect to the upper body 310. The upper body 310 may be mounted directly to the tree 18 (e.g., via threads, bolts, or other attachment features) such that the upper body 310 is not rotatable with respect to the tree body 18. As shown in FIG. 12, the upper body 310 may house at least a portion of the trigger assembly 316.

The torsional spring 314 is disposed in an annular space between the upper body 310 and the lower body 312. The torsional spring 314 may be wound during assembly of the tubing hanger alignment device 16 and locked into place via the trigger assembly 316. The torsional spring 314 may be released from its wound position at a desired time in response to actuation by the trigger assembly 316. Such release of the torsional spring 314 may cause the lower body 312 to rotate with respect to the upper body 310.

Figure 12:
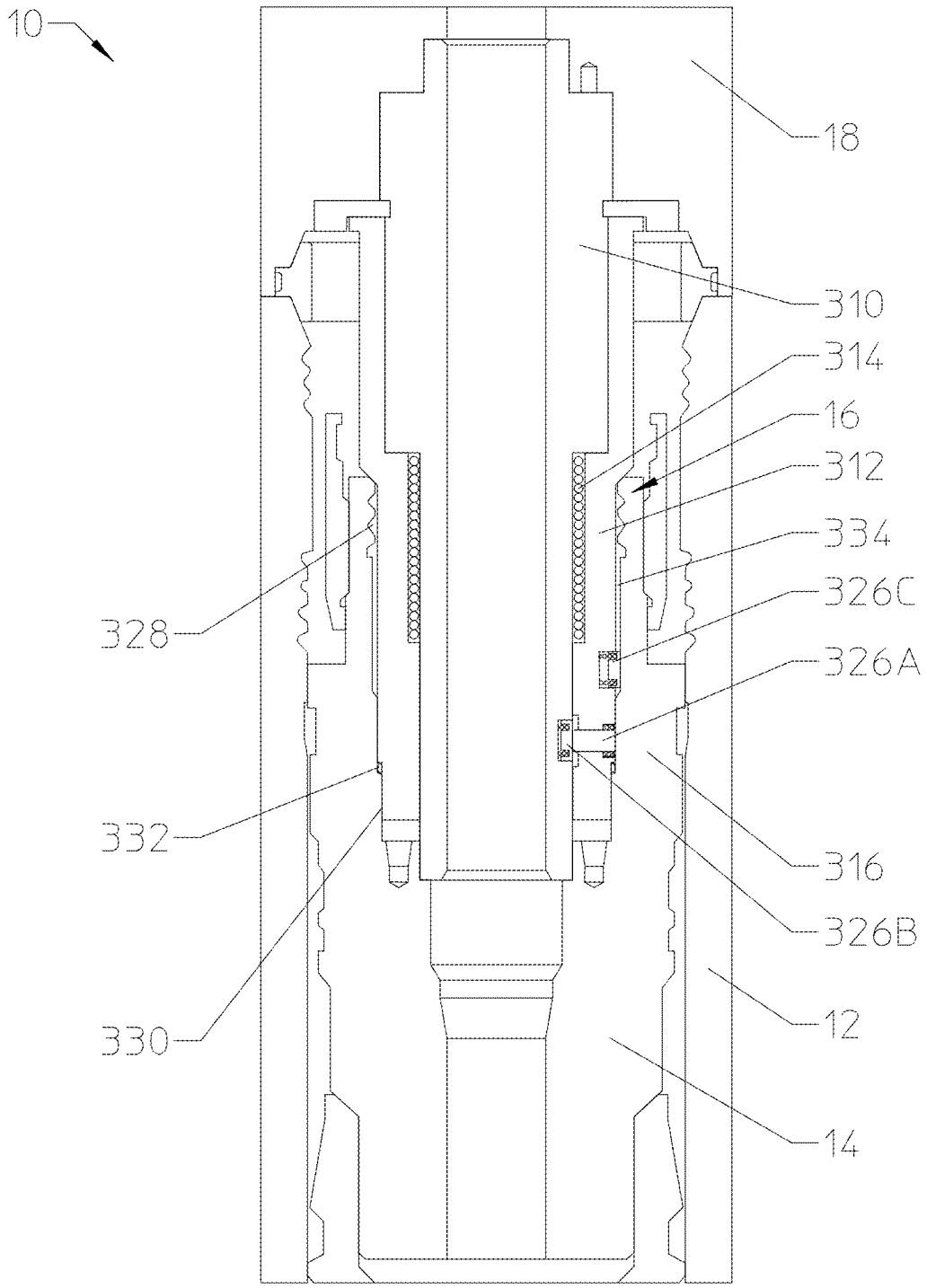
FIG. 12 is another cross-sectional view of the production system of FIG. 11, taken along a different cross section, in accordance with an embodiment of the present disclosure.
Figure 13:
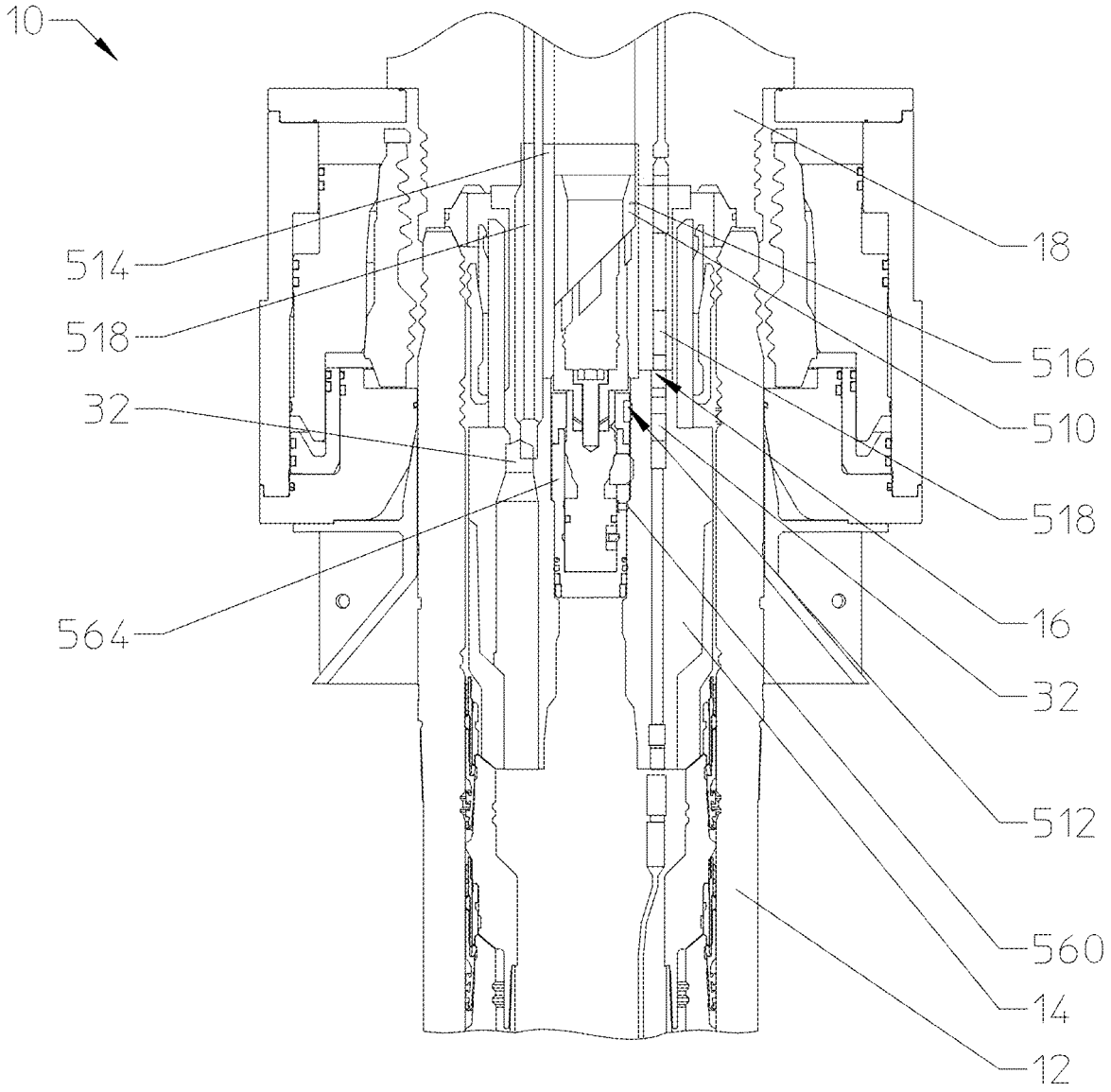
FIG. 13 is a partial cross-sectional view of a production system comprising a tubing hanger alignment device with a plug-based alignment mechanism, in accordance with an embodiment of the present disclosure.

As shown in FIG. 12, the trigger assembly 316 may include a series of spring loaded keys 326A, 326B, and 326C. It should be noted, however, that other possible arrangements of the trigger assembly 316 may be utilized in other embodiments.

The first pair of spring loaded keys 326A and 326B may together function as a trigger for releasing the torsional spring 314 to rotate the lower body 312 once tripped out to a specific elevation within the tubing hanger 14. The spring loaded key 326A may function as a trip key for the trigger assembly 316. This trip key 326A may be attached to the lower body 312 and biased in a radially outward direction. Before actuation of the trigger assembly 316, the trip key 326A may extend at least partially outward from the outer diameter of the lower body 312.

The spring loaded key 326B may function as a retention key for the trigger assembly 316. This retention key 326B may be attached to the upper body 310 and biased in a radially outward direction. Before actuation of the trigger assembly 316, the retention key 326B may extend outward from the outer diameter of the upper body 310 into a recess formed along an inner diameter of the lower body 312. This retention key 326B extending into the recess in the lower body 312 may hold the lower body 312 in a particular orientation relative to the upper body 310 during the initial landing of the tree 18 and before the release of the spring 314. As shown, the retention key 326B extending into the recess of the lower body 312 may be aligned in a radial direction with the trip key 326A in the lower body 312.

As the tree 18 (along with the upper body 310 and lower body 312) is lowered toward the wellhead 12, the upper body 310 and lower body 312 are received through an initial opening 328 of the tubing hanger 14. This initial opening 328 may have a bore with a diameter that is slightly larger than the outer diameter of the lower body 312. As such, the trip key 326A is able to stay in the outwardly extended position. As the tree 18 continues lowering, the upper body 310 and lower body 312 may pass from the opening 328 into a portion 330 of the tubing hanger 14 having a relative smaller diameter bore that is just large enough to receive the lower body 312. The tubing hanger 14 may feature a trip shoulder 332 at the boundary between the larger bore initial opening 328 and the smaller bore portion 330. As the lower body 312 passes into the smaller bore portion 330 of the tubing hanger 14, the trip key 326A may be brought into contact with the trip shoulder 332, which presses the trip key 326A radially inward. This radially inward movement of the trip key 326A simultaneously forces the retention key 326B out of the recess in the lower body 312 such that the retention key 326B no longer holds the lower body 312 in rotational alignment with the upper body 310. This allows the lower body 312 to now rotate relative to the upper body 310 as urged by the previously set torsional spring 314.

The final spring loaded key 326C may function as an alignment key to stop rotation of the lower body 312 when the lower body 312 reaches the proper orientation relative to the tubing hanger 14. The alignment key 326C may be attached to the lower body 312 and biased in a radially outward direction. During rotation of the lower body 312 relative to the upper body 310 in response to force exerted by the torsional spring 314, the alignment key 326C may be held in place within a recess in the lower body 312 by the inner wall of the relatively smaller bore portion 330 of the tubing hanger 14. The lower body 312 may rotate until the alignment key 326C reaches a position that is rotationally aligned with a slot 334 formed in the inner diameter of the tubing hanger 14. The slot 334 may be vertically oriented, as shown. Once the alignment key 326C is aligned with the slot 334, the key 326C is biased radially outward into the slot 334, thereby halting rotation of the lower body 312 at a desired position relative to the tubing hanger 14.

The lower body 312 may be a solid piece that houses hydraulic, electric, and/or fiber optic couplings 336 designed to interface directly with those couplings 32 on the tubing hanger 14. The couplings 336 may be a standard design, or they may be an actuated design so that they can make up linear differences in elevations between the bottom of the lower body 312 and the top of the tubing hanger 14. As mentioned above, the lower body 312 may include one or more hydraulic ports 324 routed to the hydraulic gallery 322 so as to allow rotation of the lower body 312 relative to the upper body 310. Electric couplings at the bottom of the lower body 312 may be wired to a series of dry mate electric contacts (not shown) that sit between the upper body 310 and the lower body 312. These electric contacts may allow rotation of the lower body 312 with respect to the upper body 310. The lower body 312 may also house the alignment key 326C and the retention key 326B of the trigger assembly 316.

In the embodiments of FIGS. 2-12, fiber optic communications between fiber optic cables in the tubing hanger 14 and tree 18 may be converted to an electric signal inside the tubing hanger alignment device 16 and then reconverted to fiber optic (light) communication on the output side of the tubing hanger alignment device 16.

A general description of a method for operating the tubing hanger alignment device 16 of FIGS. 11 and 12 will now be described. The upper body 310 (along with the attached lower body 312, torsional spring 314, and trigger assembly 316) may be installed into a lower portion of the tree 18, similar to the way a production stab sub is installed in a traditional tree. During assembly, the torsional spring 314 is wound and the trigger assembly 316 is set, effectively storing rotational energy in the alignment assembly.

The tubing hanger 14 may be run in any orientation and locked into place within the wellhead 12. The tree 18 (with connected alignment device 16) may then be run and oriented into a desired location prior to landing. While landing the tree 18, the trigger assembly 316 of the alignment device 16 trips out on the trip shoulder 332 in the inner diameter of the tubing hanger 14 to release the spring 314, as described at length above. Once the torsional spring 314 is released, the lower body 312 is able to rotate until the spring loaded alignment key 326C enters the mating slot 334 in the inner diameter of the tubing hanger 14. Once the lower body 312 is rotationally locked into the alignment slot 334, the hydraulic, electric, and/or fiber optic couplings 336 may be engaged with the corresponding couplings 32 of the tubing hanger 14. The hydraulic, electric, and/or fiber optic couplings between the tree 18 and the tubing hanger 14 will then be tested to ensure a proper connection has been made.

Figure 11:
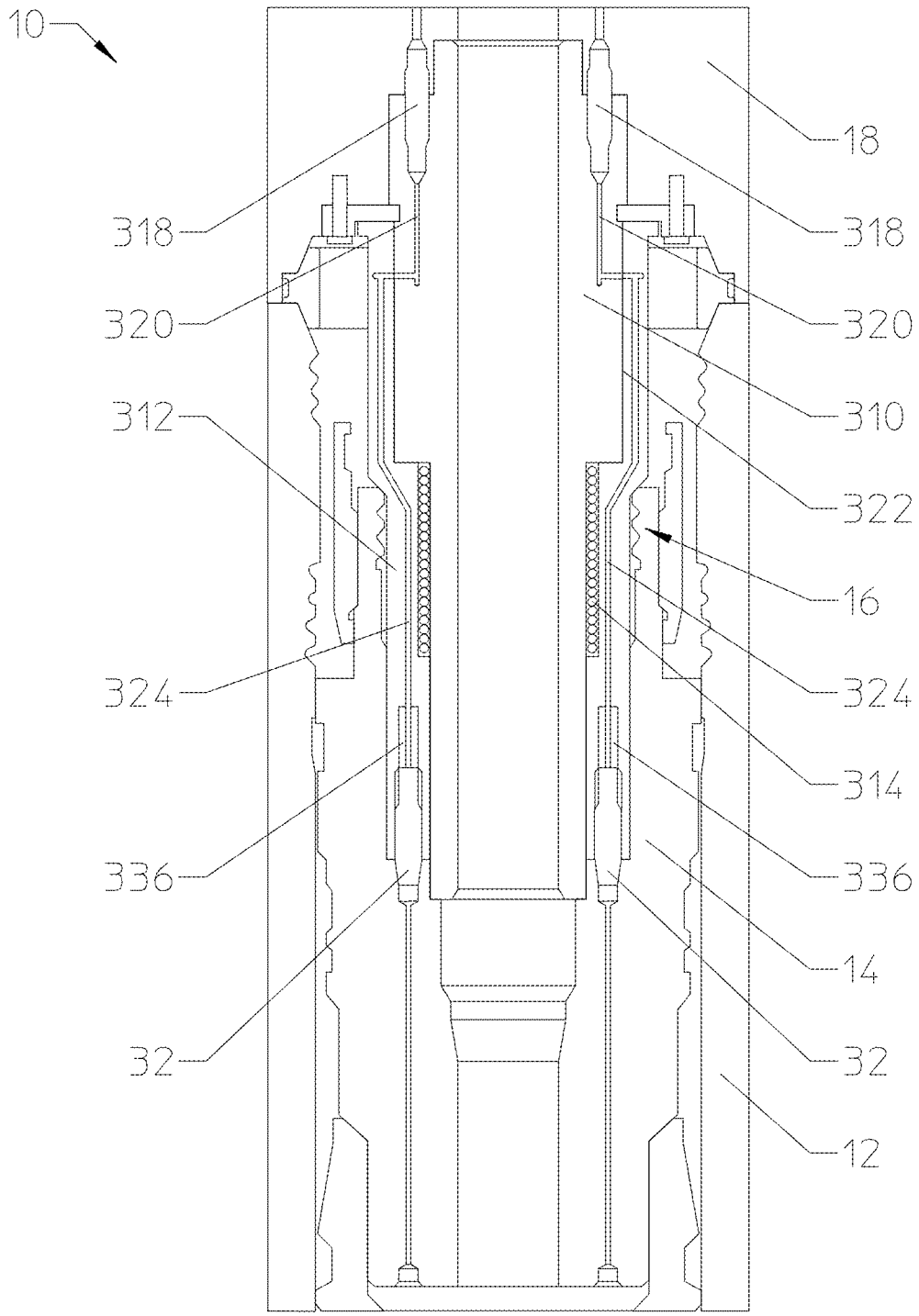
FIG. 11 is a cross-sectional view of a production system comprising a tubing hanger alignment device with a torsional spring alignment mechanism, in accordance with an embodiment of the present disclosure.

The disclosed tubing hanger alignment device 16 of FIGS. 11 and 12 may achieve the goal of aligning the tubing hanger penetrations (i.e., couplings/stabs 32 and 336) independent of the orientation about the longitudinal axis in which the tree 18 is landed. Existing tree body designs do not have to be modified to accommodate the disclosed tubing hanger alignment device 16. Existing tubing hangers may be utilized with only a minor modification to add the alignment slot 334, but otherwise this alignment device 16 utilizes standard interfaces to the tree 18 and the tubing hanger 14.

Plug-Based Alignment Mechanism

A tubing hanger alignment device 16 having a plug-based alignment mechanism will be described with reference to FIGS. 13-18. The tubing hanger alignment device 16 of FIG. 13 includes an alignment sleeve 510 and a plug assembly 512, among other things. The arrangement and interaction of these components will now be described.

The alignment sleeve 510 may be a solid piece that is located within and interfaces with an inner surface of a main bore of the tree 18. The alignment sleeve 510 may be directly coupled to a production stab sub 516 of the tree 18 and held in place relative to the sub 514 via a shear pin 536 or other type of shear mechanism. The tree 18 may include standard hydraulic, electric, and/or fiber optic couplings 518 designed to interface directly with the couplings 32 on the tubing hanger 14.

Turning to FIGS. 14-18, the plug assembly 512 may include an inner plug body 520, an outer plug body 522, an orientation sleeve 524, a retaining bolt 526, a locking mechanism 528, an actuation mechanism 530, a seal or packing element 532, a tapered gear/spline 534, an anti-rotation key 535, and shear pins 536 and 538. The plug assembly 512 may be entirely separate from the tree 18 and the tubing hanger 14 and may be utilized to orient the tree 18 relative to the tubing hanger 14 after being placed, locked, and/or adjusted within a bore of the tubing hanger 14.

The inner plug body 520 is generally disposed within the outer plug body 522, as shown. The outer plug body 522 may include two components that are connected (e.g., via threads 540) together to define a cavity 542 within which the inner plug body 520 is partially captured. A distal portion 544 of the inner plug body 520 may extend outside the cavity 542 in one direction, and this distal portion 544 may have a bore formed therethrough. A connecting portion 546 of the orientation sleeve 524 may be received within the bore in the distal portion 544 of the inner plug body 520, and the retaining bolt 526 may be positioned through the connecting portion 546 of the orientation sleeve 524 and coupled directly to the inner plug body 520 via threads. As such, the retaining bolt 526 may couple the orientation sleeve 524 to the inner plug body 520. It should be noted that other arrangements of an orientation sleeve and one or more plug bodies may be utilized in other embodiments of the disclosed plug assembly 512.

The locking mechanism 528 may include a set of locking dogs or a split ring, or any other type of lock as known to one of ordinary skill in the art. The locking mechanism 528 may be disposed at least partially around an outer edge of the inner plug body 520 and may extend into and/or through at least one slot 548 formed radially through the outer plug body 522. This allows the locking mechanism 528 to be actuated into locking engagement with a radially inner surface of the tubing hanger 14 so as to lock the plug assembly 512 in place within the tubing hanger 14. A generally sloped surface 550 forming a radially outer edge of the inner plug body 520 may be used to hold the locking mechanism 528 into its extended locking position until it is time to remove the plug assembly 512 from the tubing hanger 14.

The actuation mechanism 530 may be used to actuate the plug and thereby set the locking mechanism 528 within the tubing hanger 14. The actuation mechanism 530 may include an actuation button 552 and a split ring 554 (or similar type of actuation ring). The actuation mechanism 530 may function as follows. The split ring 554 may be biased in a radially outward direction. When the plug assembly 512 is being run in, the split ring 554 may be held within two opposing recesses 556 and 558 formed in a radially outer surface of the inner plug body 520 and a radially inner surface of the outer plug body 522, respectively. In this position, the split ring 554 may generally prevent the inner plug body 520 and outer plug body 522 from moving relative to each other in an axial direction. The actuation button 552 may be positioned through the wall of the outer plug body 522 and have a flat surface extending into the recess 558 of the outer plug body 522.

When the plug assembly 512 is run into the tubing hanger 14, a shoulder 560 (FIG. 13) on the inner edge of the tubing hanger 14 may abut the actuation button 552, forcing the button 552 radially inward such that the button 552 compresses the split ring 554 fully into the recess 556 of the inner plug body 520. With the split ring 554 in this collapsed position, the inner plug body 520 is free to move axially downward relative to the outer plug body 522 in response to setting pressure placed on the plug assembly 512 by a running tool 574. This downward movement causes the sloped surface 550 of the inner plug body 520 to push radially outward against the locking mechanism 528, thereby setting the locking mechanism 528 into a locking groove 564 (FIG. 13) on the internal surface of the tubing hanger 14. The downward movement of the inner plug body 520 may also set the spring loaded shear pin 536 into a recess formed along the inner surface of the outer plug body 522. This shear pin 536 may keep the inner plug body 520 in the same axial position relative to the outer plug body 522 to maintain the plug assembly 512 in this locked position within the tubing hanger 14 until it is time to remove the plug assembly 512.

The seal or packing element 532 located at the lower end of the outer plug body 522 is used to provide a high pressure seal within the bore of the tubing hanger 14. When the plug assembly 512 enters the locked position, the seal or packing element 532 is energized. The seal or packing element 532 may seal the tubing hanger 14 so that the BOP can be removed from the wellhead, and replaced by the tree 18, while maintaining two high pressure seals in the system (one via a downhole safety valve and a backup via the plug assembly 512).

The tapered gear/spline 534 may be disposed at the intersection of the connecting portion 546 of the orientation sleeve 524 and the inner plug body 520. The tapered gear/spline 534 may include threads that enable an incremental adjustment of the orientation (e.g., by 1 degree, 2 degrees, or some other amount) of the orientation sleeve 524 about the longitudinal axis relative to the rest of the plug assembly 512. The outer plug body 522 may be held rotationally in place via the anti-rotation key 535 fitted in a corresponding slot of the tubing hanger 14 when the plug assembly 512 is in the locked position. At this point, a running and/or adjustment tool disposed inside and engaged with running/adjustment grooves 566 of the orientation sleeve 524 may pick up the orientation sleeve 524 and rotate the orientation sleeve 524 relative to the outer and inner bodies of the plug. This rotation may be performed in an incremental fashion in accordance with the relative size and number of threads present in the tapered gear/spline 534. The retaining bolt 526 may be sized and positioned such that the orientation sleeve 524 can move axially back and forth as needed during this adjustment process. The orientation of the sleeve 524 is so that the sleeve 524 can be brought into a desired rotational alignment with respect to the wellhead 12. An ROV based tool or some other type of tool may be used to determine how far the orientation sleeve 524 has been adjusted within the wellhead.

The orientation sleeve 524 includes an orientation profile 568 formed along a distal end of the orientation sleeve 524. The orientation profile 568 may include, for example, a slanted end surface and a series of different sized slots 570 extending through the orientation sleeve 524. The alignment sleeve 510 on the tree 18 may feature a complementary profile 572 designed to fit into the orientation profile 568 of the orientation sleeve 524 when the alignment sleeve 510 (and consequently tree 18) are brought into a desired alignment with the orientation sleeve 524. The slots 570 may each have different widths so as to only allow mating engagement of the alignment sleeve 510 with the orientation sleeve 524 in a single orientation of the parts relative to each other. The alignment sleeve 510 may rotate until it is brought into this desired orientation. In this orientation, the couplings 518 on the tree 18 will be directly aligned with the couplings 32 on the tubing hanger 14. The slots 570 may be elongated in a vertical direction, as shown, so that the couplings 518 on the tree 18 can be brought into the correct alignment with the tubing hanger couplings 32 first and then be lowered directly downward to form a mating connection.

It should be noted that other types or arrangements of an orientation profile 568 on the orientation sleeve 524 and complementary profile 572 on the alignment sleeve 510 may be utilized in other embodiments. For example, the orientation profile 568 may be a helix and the alignment sleeve 510 may include a pin designed to be received into the helix and directed therethrough until the tree 18 is brought into alignment and a mating connection with the tubing hanger 14.

A general description of a method for operating the tubing hanger alignment device 16 of FIGS. 13-18 will now be described. The tubing hanger 14 may be run in the wellhead 12 through the BOP while the BOP is in place. The plug assembly 512 may then be lowered through the wellhead 12 and into the bore of the tubing hanger 14. The BOP is removed only after the plug assembly 512 is installed, and the plug assembly 512 remains in place until the tree 18 has been landed. After the tree 18 is landed, the plug assembly 512 may be removed and reused.

Figure 14:
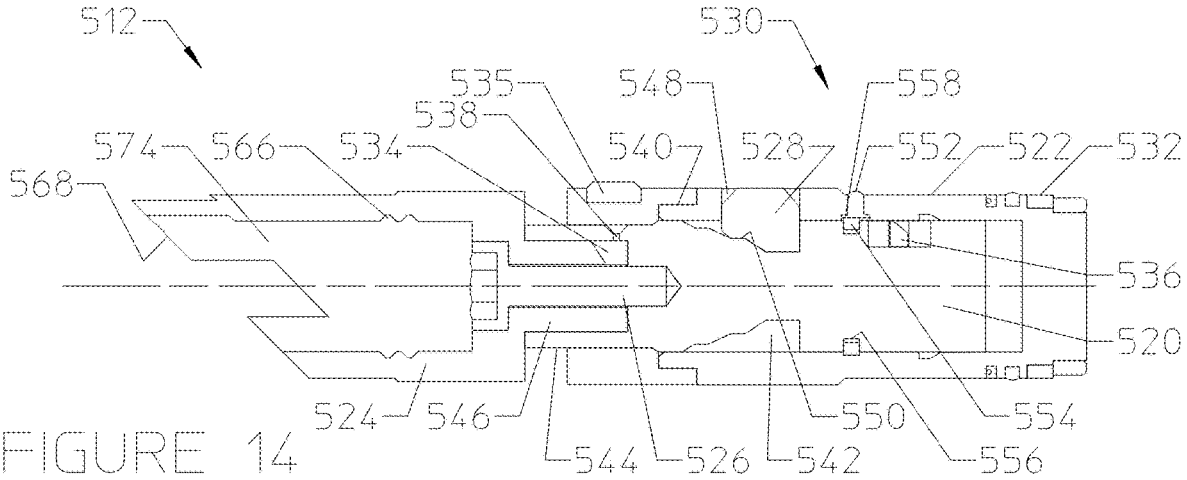
FIG. 14 is a cross-sectional view of a plug assembly used in the tubing hanger alignment device of FIG. 13 in a running position, in accordance with an embodiment of the present disclosure.

FIG. 14 shows the plug assembly 512 during the running operation. As mentioned above, while being run in, the locking mechanism 528 is in the collapsed state, the actuation mechanism 530 is unactuated, and the shear pin 536 is not engaged. A running tool 574 is positioned within the bore of the orientation sleeve 524 and connected to the orientation sleeve 524 via the running/adjustment grooves 566. As the running tool 574 lowers the plug assembly 512 into the tubing hanger 14, the running tool 574 may rotate the plug assembly 512 until it reaches an orientation where the anti-rotation key 535 is positioned in the corresponding slot of the tubing hanger 14.

Figure 15:
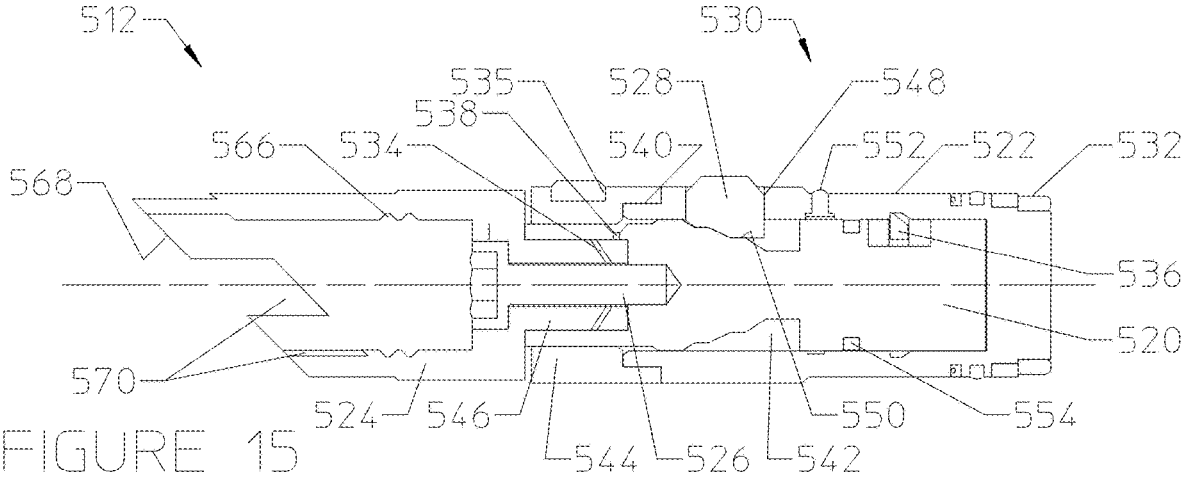
FIG. 15 is a cross-sectional view of the plug assembly of FIG. 14 being locked into a tubing hanger, in accordance with an embodiment of the present disclosure.

Further lowering of the plug assembly 512 will cause the plug assembly 512 to lock into the tubing hanger 14, as shown in FIG. 15. The shoulder 560 on the tubing hanger 14 may press against the actuation button 552, actuating the locking mechanism 528 so that the split ring 554 is received into the locking groove 564 of the tubing hanger 14. The shear pin 536 may spring outward into the recess formed in the outer plug body 522. As a result, the plug assembly 512 is locked in the tubing hanger 14. The seal or packing element 532 may be engaged with the inner diameter of the tubing hanger bore so as to provide a back-up for the downhole safety valve once the BOP is removed. The anti-rotation key 535 located in the slot of the tubing hanger 14 prevents the seal or packing element 532 from rotating.

Figure 16:
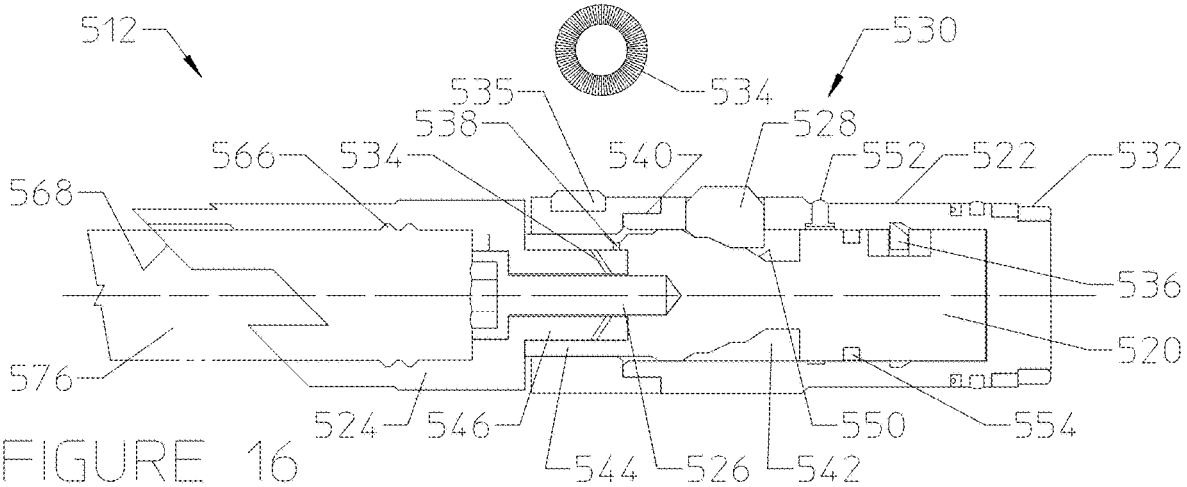
FIG. 16 is a cross-sectional view of the plug assembly of FIGS. 14 and 15 with an alignment sleeve being adjusted, in accordance with an embodiment of the present disclosure.
Figure 17:
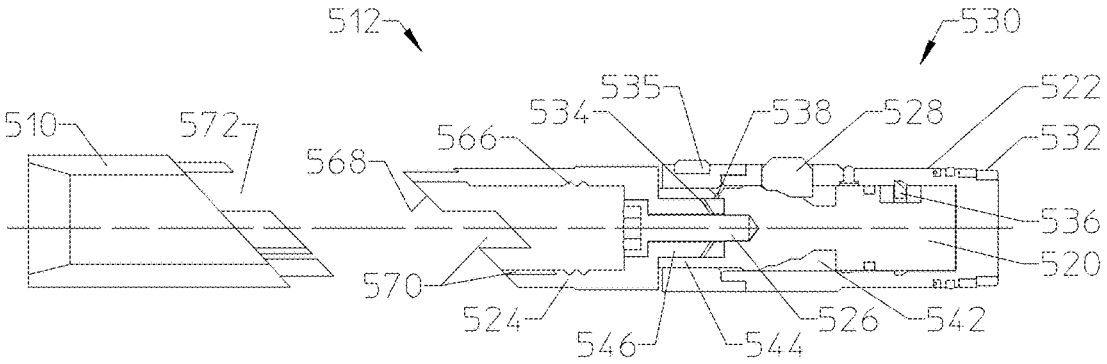
FIG. 17 is a cross-sectional view of a tree component being landed on the plug assembly of FIGS. 14-16, in accordance with an embodiment of the present disclosure.
Figure 18:
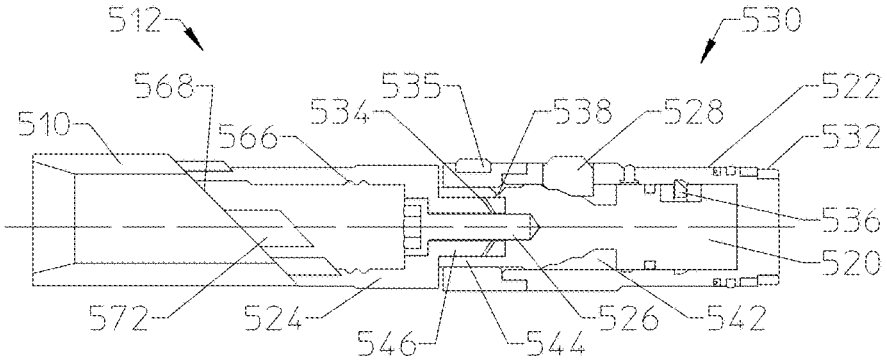
FIG. 18 is a cross-sectional view of the tree component being landed and aligned with the tubing hanger via the plug assembly of FIGS. 14-17, in accordance with an embodiment of the present disclosure.
Figure 19A:
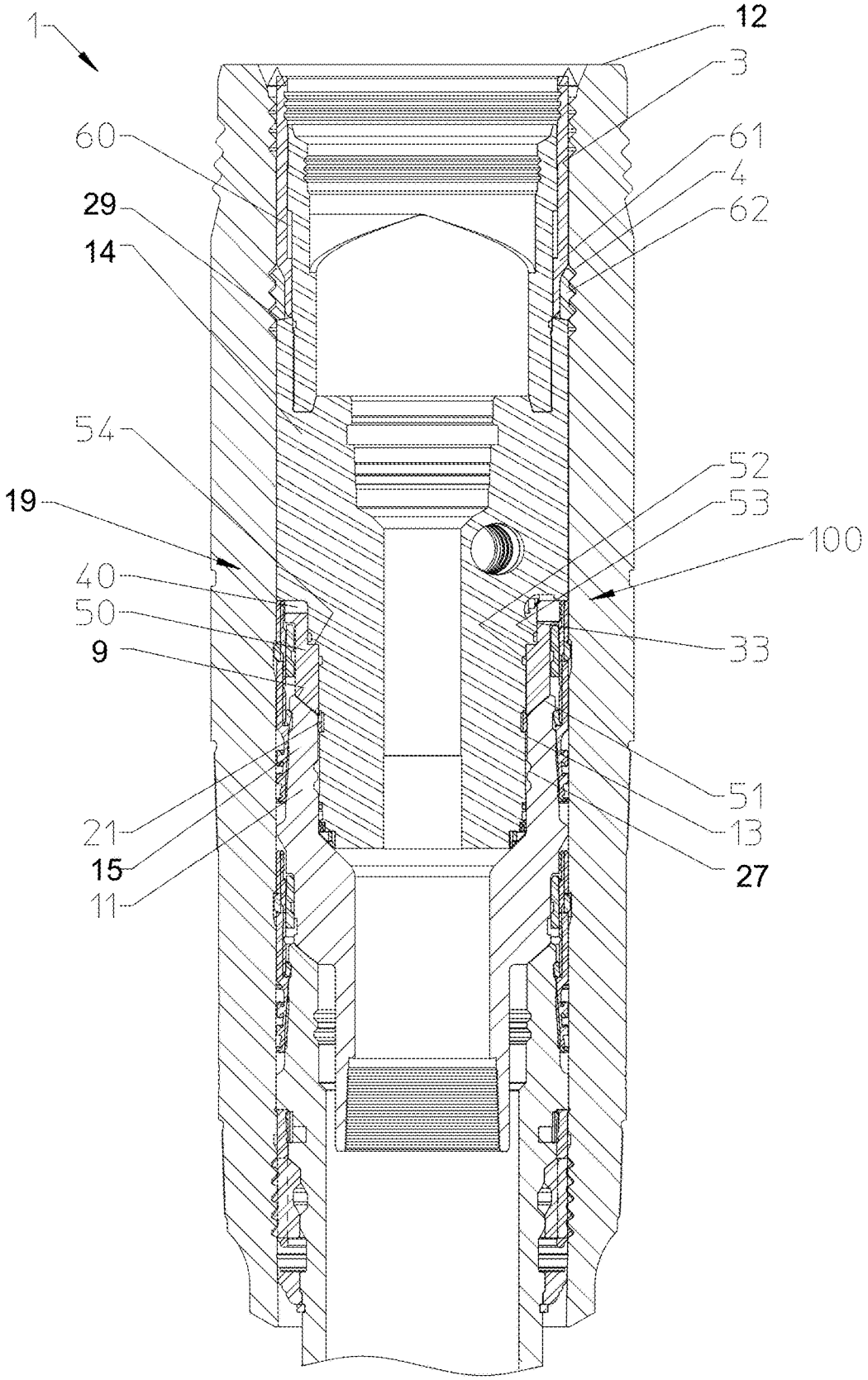
FIG. 19A is a partial cutaway view of a wellhead system having a tubing hanger system, in accordance with an embodiment of the present disclosure.
Figure 19B:
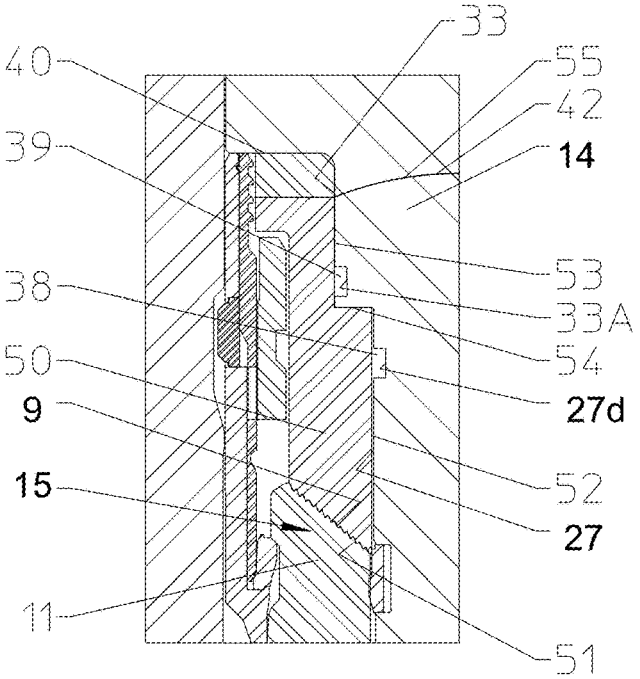
FIG. 19B is a close-up of the partial cutaway view of the wellhead system having the tubing hanger system of FIG. 19A, in accordance with an embodiment of the present disclosure.
Figure 19C:
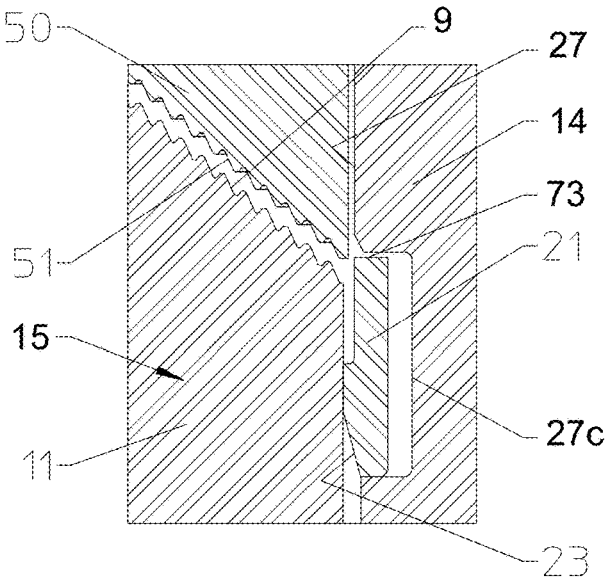
FIG. 19C is a close-up of the partial cutaway view of the wellhead system having the tubing hanger system of FIG. 19A, in accordance with an embodiment of the present disclosure.
Figure 20:
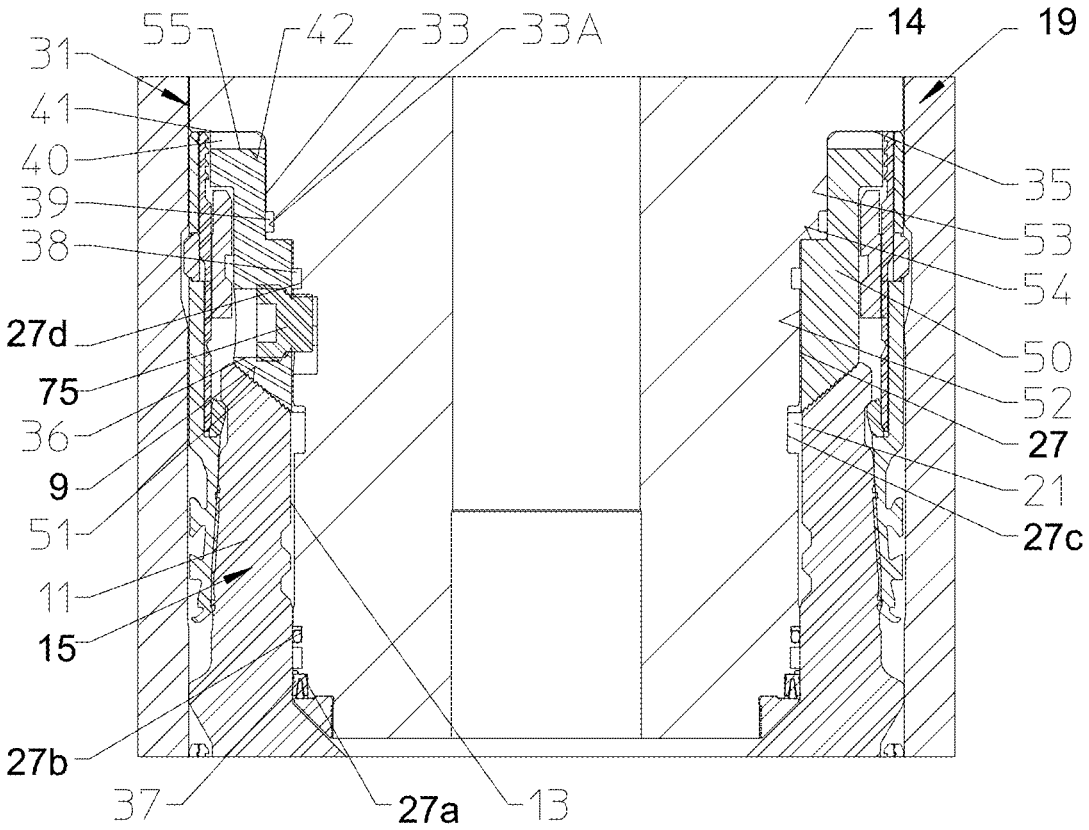
FIG. 20 is a partial cutaway view of the tubing hanger system of FIG. 19A, in accordance with an embodiment of the present disclosure.
Figure 21A:
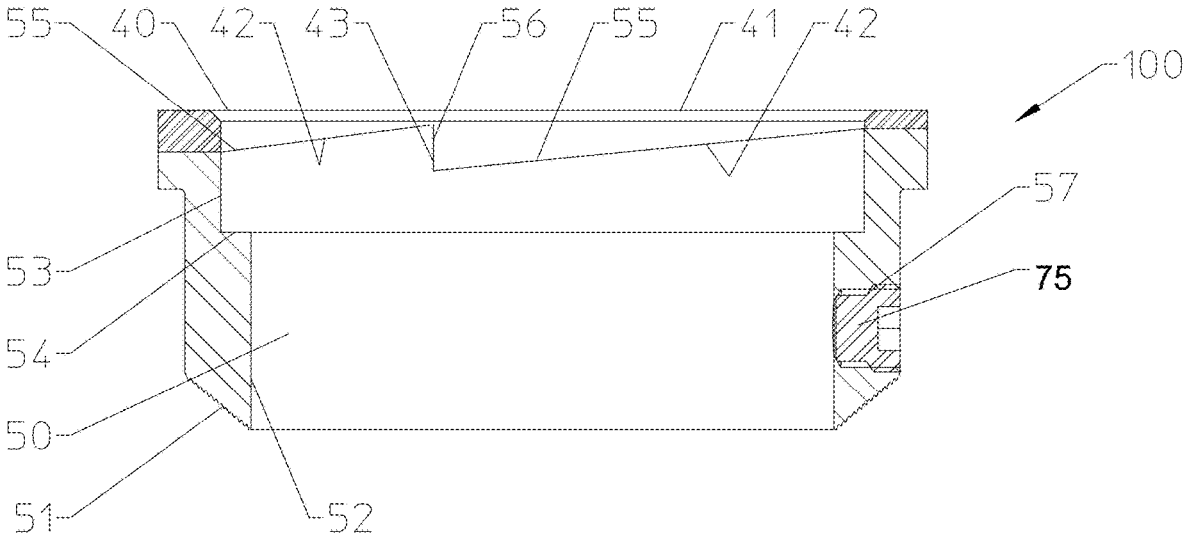
FIG. 21A is a cutaway view of a ramp ring and a piston of the tubing hanger system of FIG. 19A where the ramp ring is disposed in an initial position, in accordance with an embodiment of the present disclosure.
Figure 21B:
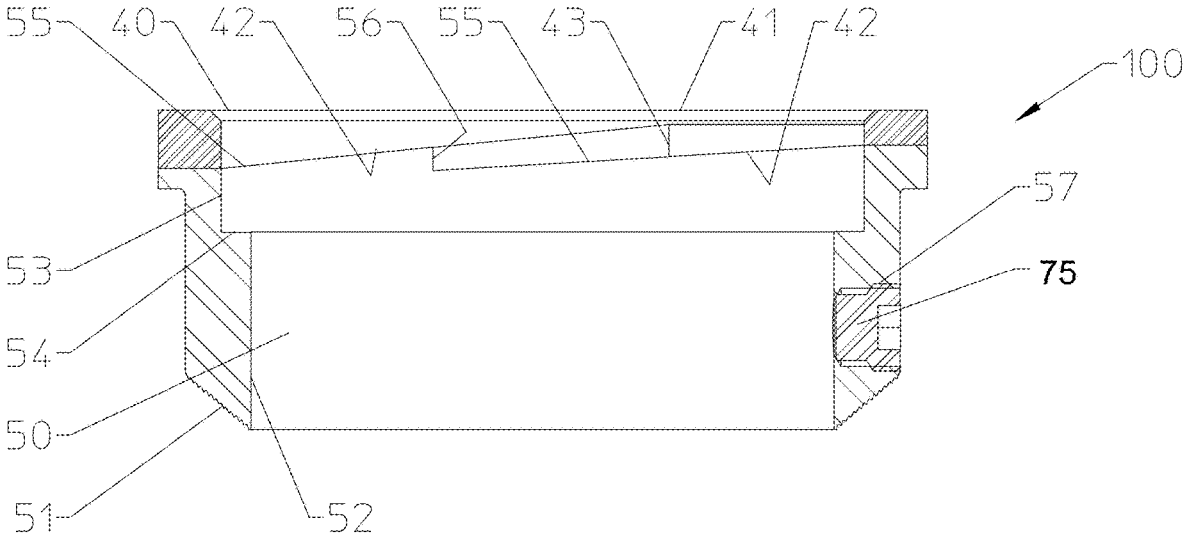
FIG. 21B is a cutaway view of a ramp ring and a piston of the tubing hanger system of FIG. 19A where the ramp ring is disposed in a rotated position, in accordance with an embodiment of the present disclosure.

Once the plug assembly 512 is locked, the BOP may be removed from the wellhead 12. The orientation sleeve 524 may be adjusted relative to the rest of the plug assembly 512, as shown in FIG. 16. An adjustment tool 576, which may or may not be the same as the running tool described above, is positioned within the bore of the orientation sleeve 524 and connected to the orientation sleeve 524 via the running/adjustment grooves 566. As the adjustment tool 576 rotates the orientation sleeve 524 relative to the rest of the plug, the tapered gear/spline 534 guides this rotation to take place in small increments, which can be tracked by an outside tool. Whatever adjustment has been made to place the orientation sleeve 524 in a desired orientation relative to the wellhead, the same rotational adjustment may then be made on the tree 18 (e.g., between the alignment sleeve 510 and other portions of the tree 18). This adjustment of the tree 18 will enable direct connections between the tree couplings 518 and the tubing hanger couplings 32 to be made.

The tree 18 (illustrated just as the alignment sleeve 510 in FIGS. 17 and 18) may then be landed onto the wellhead 12. The alignment of the tree 18 relative to the tubing hanger 14 is guided by the orientation profile 568 on the orientation sleeve 524 interfacing with the complementary profile 572 on the alignment sleeve 510. Once the slots and corresponding legs of these profiles 568 and 572 are matched up, further lowering of the tree 18 onto the wellhead 12 will cause the alignment sleeve 510 to lower vertically through the elongated slots in the orientation sleeve 524, thereby providing a controlled descent of the tree couplings 518 onto the appropriate tubing hanger couplings 32. The tree 18 at this point is landed and the connections between the tree 18 and the tubing hanger 14 are made up.

After the tree is landed, the plug assembly 512 may be removed. The plug assembly 512 may be reusable in different wellheads once it is removed. To remove the plug assembly 512, a retrieval tool may be coupled to the orientation sleeve 524 and used to pull the plug upward. This upward force may cause the spring-loaded shear pin 536 to shear, thereby releasing the inner plug body 520 from its axial position within the outer plug body 522. The inner plug body 520 may be lifted up within the outer plug body 522, causing the sloped surface 550 to move out of the outwardly biasing contact with the locking mechanism 528. The locking mechanism 528 may collapse into the recess in the outer plug body 522, freeing the plug assembly 512 to be extracted from the bore of the tubing hanger 14.

Space-Out Mechanism and Rigidized Seal Assembly

Referring now to FIGS. 19A-21B, certain components of a wellhead system 1 are illustrated according to one or more embodiments of the present disclosure. The illustrated wellhead system 1 may be a subsea wellhead assembly (such as subsea production system 10 previously described above). However, similar techniques may be used in land-based wellhead systems as well. The wellhead system 1 may include the wellhead 12, a casing hanger 15 (or in other embodiments, the casing hangers 26A, 26B previously described above), a tubing hanger system 19, and a locking mechanism 60. The casing hanger 15 may be landed within the wellhead 12. The tubing hanger system 19 may then be landed upon the casing hanger 15 within the wellhead 12. Lastly, the locking mechanism 60 may be landed upon the tubing hanger system 19 within the wellhead 12. The wellhead 12 may include a central bore 3 having locking profile 4 disposed thereon. The locking mechanism 60 may engage the locking profile 4 of the wellhead 12 in order to lock the casing hanger 15, the tubing hanger system 19, and the locking mechanism 60 in place within the wellhead 12 and rigidize the system.

The casing hanger 15 may include a casing hanger body 11 having an upper load shoulder 9 and a radially interior profile 13. The upper load shoulder 9 may be tapered inwards towards the interior profile 13 and ridges may be formed along the upper load shoulder 9. However, one of ordinary skill in the art would understand that in other embodiments, the upper load shoulder may be tapered outwards away from the interior profile or may not be tapered at all. Additionally, one of ordinary skill in the art would understand that in other embodiments, the upper load shoulder may be smooth or curved instead of having ridges.

The tubing hanger system 19 may include the tubing hanger 14 and a space-out mechanism 100. In one or more embodiments, the space-out mechanism may include a ramp ring 40 and a piston 50. However, one of ordinary skill would understand that space-out mechanisms of other embodiments may include a plurality of ramp rings or wedges. The tubing hanger 14, the ramp ring 40, and the piston 50 may be assembled together before being inserted into the wellhead 12 such that the tubing hanger system 19 may be installed in a single trip. The manner in which each of the parts in the tubing hanger system 19 are coupled will be discussed further below. Additionally, the tubing hanger system 19 may be run into the wellhead 12 and disposed such that the tubing hanger 14 seals against the interior profile 13 of the casing hanger body 11 and the piston 50 abuts the upper load shoulder 9 of the casing hanger 15. In one or more embodiments, to ensure that tubing hanger system 19 is properly seated on the casing hanger 15, one or more safety lock mechanisms may be used. The safety lock mechanisms according to one or more embodiments of the present disclosure will be discussed further below.

Still referring to FIGS. 19A-21B, the tubing hanger 14, according to one or more embodiments of the present disclosure, may include a radially exterior profile 31 defined, in part, by a first sealing profile 27, a second sealing profile 33, an upward facing contact surface 29, a downward facing contact surface 35, and an axially extending pin slot 36. The first sealing profile 27 may include a first seal groove 27*a* in which a tubing hanger to casing hanger seal 37 is disposed, a second seal groove 27*b* in which an o-ring may be disposed, a third groove 27*c* in which a retainer ring 21 may be disposed, and a fourth seal groove 27*d* in which a first tubing hanger to piston seal 38 may be disposed. The second sealing profile 33 may include groove 33*a* in which a second tubing hanger to piston seal 39 may be disposed.

Further, the ramp ring 40 of the space-out mechanism 100, according to one or more embodiments of the present disclosure, may include an upper contact surface 41, ramp surfaces 42, and rotational stop surfaces 43. The ramp ring 40 may be disposed adjacent to the tubing hanger 14 such that the ramp ring 40 is positioned about the second sealing surface 33 of the tubing hanger 14 and, at least when the tubing hanger system 19 is run-in and when the tubing hanger system 19 is in a fully locked position, the upper contact surface 41 may contact the downward facing contact surface 35 of the tubing hanger 14. Additionally, in one or more embodiments, a bottom of the ramp ring 40 may have a plurality of ramp surfaces 42 and a plurality of rotational stop surfaces 43. By way of example, in one or more embodiments, the ramp ring 40 may include three ramp surfaces each extending 120° circumferentially about the ramp ring 40. However, one of ordinary skill in the art will understand that in other embodiments, the ramp ring may have a single ramp surface and a single rotational stop surface or any combination of equal numbers of ramp surfaces and rotational stop surfaces that match the number of ramp surfaces and rotational stop surfaces of the piston. Further, in one or more embodiments of the present disclosure, the ramp surfaces 42 may have a constant 3.5° taper. However, one of ordinary skill in the art will understand that in other embodiments the ramp surface may include steps or ridges and/or may have a constant or changing taper in the range of 0.5°-7°. Alternatively, the ramp surface may include any range of angles, surface geometries, and/or coatings that prevent rotation once installed.

Additionally, the piston 50 of the space-out mechanism 100 may include a lower load shoulder 51, a first interior seal surface 52, a second interior seal surface 53, an interior shoulder 54, ramp surfaces 55, rotational stop surfaces 56, and a threaded pin borehole 57. The piston 50 may be disposed adjacent to the casing hanger 15, the tubing hanger 14, and the ramp ring 40 such that piston is positioned about the first sealing surface 32 and the second sealing surface 33 of the tubing hanger 14. Further, the piston 50 may abut the casing hanger 20 on one side and the ramp ring 40 on the other side. Thus, in one or more embodiments, the lower load shoulder 51 may abut the upper load shoulder 9 of the casing hanger 15. As such, the lower load shoulder 51 may be tapered to match the taper of the upper load shoulder 9 of the casing hanger 15 and ridges may be formed along the lower load shoulder 51 to match the ridges of the upper load shoulder 9 of the casing hanger 15. However, as discussed above with regard to the upper load shoulder 9 of the casing hanger 15, one of ordinary skill in the art would understand that in other embodiments, the lower load shoulder may be tapered in a number of ways as long as the taper of the lower load shoulder matches the taper of the upper load shoulder. Additionally, one of ordinary skill in the art would understand that in other embodiments, the upper load shoulder may be smooth or curved instead of having ridges.

Further, the first interior seal surface 52 and second interior seal surface 53 of the piston 50 may be disposed such that when the tubing hanger system 19 is fully assembled, the first tubing hanger to piston seal 38 and the second tubing hanger to piston seal 39 may seal against the first interior seal surface 52 and the second interior seal surface 53 of the piston 50, respectively. Furthermore, when the tubing hanger system 19 is disposed within the wellhead 12 and landed on the casing hanger 15, the first sealing profile 27 of the tubing hanger 14 may sit within the casing hanger 15 such that the tubing hanger to casing hanger seal 37 seals against the interior profile 13 of the casing hanger 15. This sealing profile created between the casing hanger 15, the tubing hanger 14, and the piston 50 may create a piston force that acts in a downward direction against the interior shoulder 54 of the piston 50, which may hold the piston 50 in abutment with the casing hanger 15 in the event that the tubing hanger 14 is shifted in an upward direction. Additionally, in one or more embodiments, the threaded pin borehole 57 of the piston 50 may be aligned with the pin slot 36 of the tubing hanger 14, and an anti-rotation pin 75 may be coupled to the threaded pin borehole 57 such that the anti-rotation pin 75 rests within the pin slot 36. This anti-rotation pin, according to one or more embodiments of the present disclosure, may rotationally couple the piston to the tubing hanger 14 such that the ramp ring 40 may rotate relative to the piston 50 while allowing the tubing hanger 14 to move axially relative to the piston 50 so that any gap that is formed in locking the tubing hanger system 19 and casing hanger 15 to the wellhead 12 may be filled. However, one of ordinary skill in the art would understand that in other embodiments a variety of methods may be used to rotationally secure the piston and the tubing hanger body such that the ramp ring may rotate relative to the tubing hanger body without also rotating the piston.

Furthermore, still referring to FIGS. 19A-21B, the ramp surfaces 55 of the piston 50 may be configured to abut the ramp surfaces 42 of the ramp ring 40 at least when the tubing hanger system 19 is run-in and when the tubing hanger system 19 is in a fully locked position. As discussed above with regard to the ramp surfaces 42 of the ramp ring 40, the ramp surfaces 55 of the piston 50 may be designed in various ways so long as the ramp surfaces 55 match the ramp surfaces 42. By way of example, in one or more embodiments, the piston may include three ramp surfaces each extending 120° circumferentially about the piston 50. However, one of ordinary skill in the art will understand that in other embodiments, the piston may have a single ramp surface and a single rotational stop surface or any combination of equal numbers of ramp surfaces and rotational stop surfaces that match the number of ramp surfaces and rotational stop surfaces of the ramp ring. Further, in one or more embodiments of the present disclosure, the ramp surfaces 55 may have a constant 3.5° taper. However, one of ordinary skill in the art will understand that in other embodiments the ramp surface may include steps or ridges and/or may have a constant or changing taper in the range of 0.5°-7°. One of ordinary skill will appreciate that the ramp surfaces are designed such that the contact between the ramp surfaces is self-locking and compressive forces between the surfaces will not cause the piston and ramp ring to rotate relative to each other once the tubing hanger system is in the fully locked position. Further, the rotational stop surfaces 56 of the piston 50 and the rotational stop surfaces 43 of the ramp ring 40 may be configured to abut each other at least when the tubing hanger system 19 is run in and may prevent the piston and ramp ring from rotating relative to each other in one direction.

Additionally, the locking mechanism 60, according to one or more embodiments of the present disclosure, may include a locking mandrel 61 and locking dogs 62. The plurality of locking dogs 62 may be supported around the locking mandrel 61. The locking mechanism 60 may be run into the wellhead 12 until the locking mechanism 60 abuts the upward facing contact surface 29 of the tubing hanger 14. In one or more embodiments, a bottom surface of the locking dogs 62 may directly abut the upward facing contact surface 29 and may be pushed outward into the locking profile 4 of the wellhead 12 by a compressive force caused by the locking mandrel 61 pushing down on the locking dogs 62. The locking dogs 62 may have ridges disposed on an outer surface that match the locking profile 4 disposed along the central bore 3 of the wellhead 12.

Further, the tubing hanger system 19 may include one or more safety locks to ensure that the system is properly run into the wellhead 12 and features of the system are not activated prematurely. By way of example, in one or more embodiments, a retainer ring 21 may be included in the tubing hanger system 19 so as to make sure that the piston 50 is properly seated upon the casing hanger 15 and the seals of the tubing hanger 14 are set within the piston 50 and the casing hanger 15 as necessary for the system to function properly. The retainer ring 21 may be a split ring disposed within the third groove 27*c* of the tubing hanger 14 and may have an uncollapsed outer diameter that is greater than both the diameter of the interior profile 13 of the casing housing 10 and the first interior seal surface 52 of the piston 50.

Further, in a pre-run-in assembled state, the third groove 27*c* and the retainer ring 21 may be disposed below the lower load shoulder 51 of the piston 50. This disposition of the retainer ring 21 and third groove 27*c* may be such that the lower load shoulder 51 of the piston 50 cannot abut the upper load shoulder 9 of the casing hanger 15 until the retainer ring 21 is collapsed into the third groove 27*c*. The retainer ring 21 may include an upper contact surface 73 and a lower contact surface 23. The lower contact surface 23 may be tapered such that downward forces from the piston 50 and/or tubing hanger 14 during run-in push the tapered lower contact surface 23 into an interior edge of the upper load shoulder 9 of the casing hanger 15 and cause the retainer ring 21 to collapse into the third groove 27*c*. Once collapsed, the outer diameter of the retainer ring 21 may be smaller than the interior profile 13 of the casing hanger 15, allowing the tubing hanger system 19 to properly seat within and against the casing hanger 15. Thus, in one or more embodiments, the retainer ring 21 needs to be collapsed in order for the lower load shoulder 51 of the piston 50 to be able to abut the upper load shoulder 9 of the casing hanger 15. Additionally, various other safety locks may be used in one or more embodiments of the present disclosure.

Figure 22:
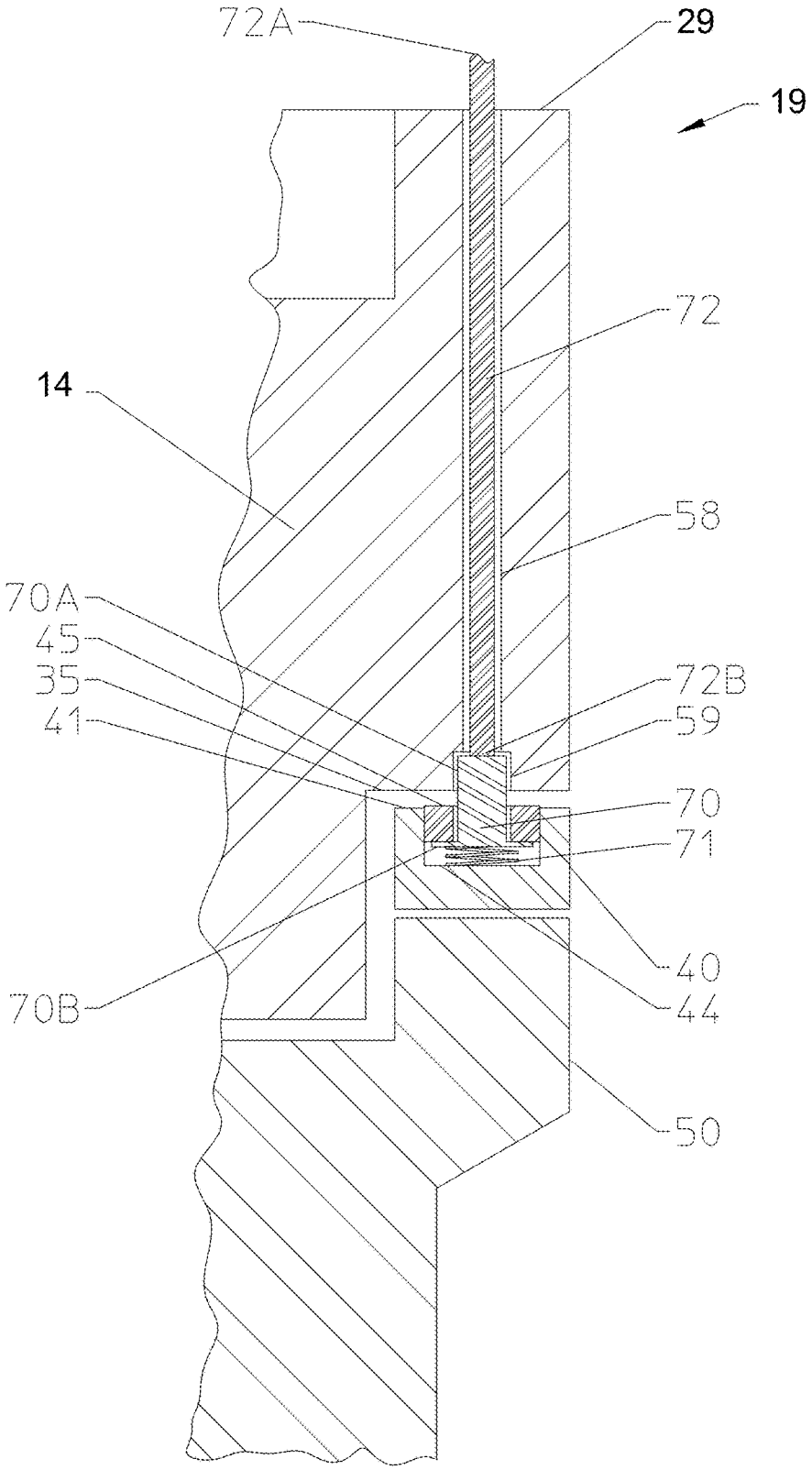
FIG. 22 is a partial cross-sectional view of the wellhead system having the tubing hanger system of FIG. 19A, in accordance with an embodiment of the present disclosure.

Referring now to FIG. 22, another safety mechanism according to one or more embodiments of the present disclosure is illustrated. A spring loaded pin disposed within the ramp ring 40 may be installed during assembly of the tubing hanger system 19 and engage the tubing hanger 14 so as to rotationally lock the ramp ring to the tubing hanger body until the proper time in the tubing hanger system run-in in which the ramp ring must be rotationally actuated in order to take up any axial space created by the installation procedure.

The safety mechanism of the tubing hanger system 19 may include a safety lock pin 70, a safety lock spring 71, and a safety lock rod 72. The safety lock pin 70 and the safety lock spring 71 may be disposed within the ramp ring 40, and the safety lock rod 72 may be disposed within the tubing hanger 14. The ramp ring 40, in one or more embodiments, may include a pin blind hole 44 disposed in an upper contact surface 41 and a pin securing mechanism 45. The safety lock spring 71 may be disposed within the pin blind hole 44 abutting a bottom of the blind hole, and the safety lock 70 pin may be disposed above the safety lock spring 71 in the blind hole such that the safety lock pin 70 is pushed up towards the tubing hanger 14. The safety lock pin 70 may include a safety lock pin body 70*a* and a safety lock pin flange 70*b*, in which the diameter of the safety lock pin flange 70*b* is greater than the diameter of the safety lock pin body 70*a*. The pin securing mechanism 45 may be disposed in the opening of the pin blind hole 44 and may have an inner diameter larger than the safety lock pin body 70*a* but smaller than the diameter of the safety lock pin flange 70*b* such that the safety lock pin 70 is maintained within the pin blind hole 44 while the safety lock pin body 70*a* is able to extend past the upper contact surface 41 of the ramp ring 40.

Additionally, the tubing hanger 14, in one or more embodiments, may include an elongated hole 58 that extends from an upward facing contact surface 29 to a downward facing contact surface 35. Further, a pin counterbore 59 may be sunk into the downward facing contact surface 35 and concentric with the hole 58. An inner diameter of the pin counterbore 59 may be slightly larger than the outer diameter of the safety lock pin body 70*a*, and the pin counterbore 59 may be configured to receive the safety lock pin 70 when the tubing hanger system 19 is assembled before run-in. Further, the safety lock rod 72 may be disposed within the hole 58. The safety lock rod 72 may be longer than the length of the hole 58 and the pin counterbore 59 such that when the safety lock pin 70 extends into the pin counterbore 59, the top end 72*a* of the safety lock rod 72 extends above the upward facing contact surface 29 and when the safety lock rod 72 is compressed down to the upward facing contact surface 29 into the hole 58, the bottom end 72*b* of the safety lock rod 72 is even with or extends slightly below the downward facing contact surface 35.

Further referring to FIG. 22, in one or more embodiments of the present disclosure, when the tubing hanger system 19 is assembled before run-in, the safety lock pin 70 may engage the pin counterbore 59. During the installation of the tubing hanger system 19 within a wellhead housing, installation of a locking mechanism may cause a locking mandrel to compress the safety lock rod 72 into the hole 58, which will cause the bottom end 72*b* of the safety lock rod 72 to push the safety lock pin 70 out of the pin counterbore 59. Once the safety lock pin 70 is removed from the pin counterbore 59, the tubing hanger 14 and the ramp ring 40 will no longer be rotationally locked with respect to each other allowing the ramp ring 40 to rotate relative to the piston 50 along their respective ramp surfaces in order to remove any axial gaps in the tubing hanger system 19 created during the process of locking the tubing hanger system within the wellhead housing.

Figure 23A:
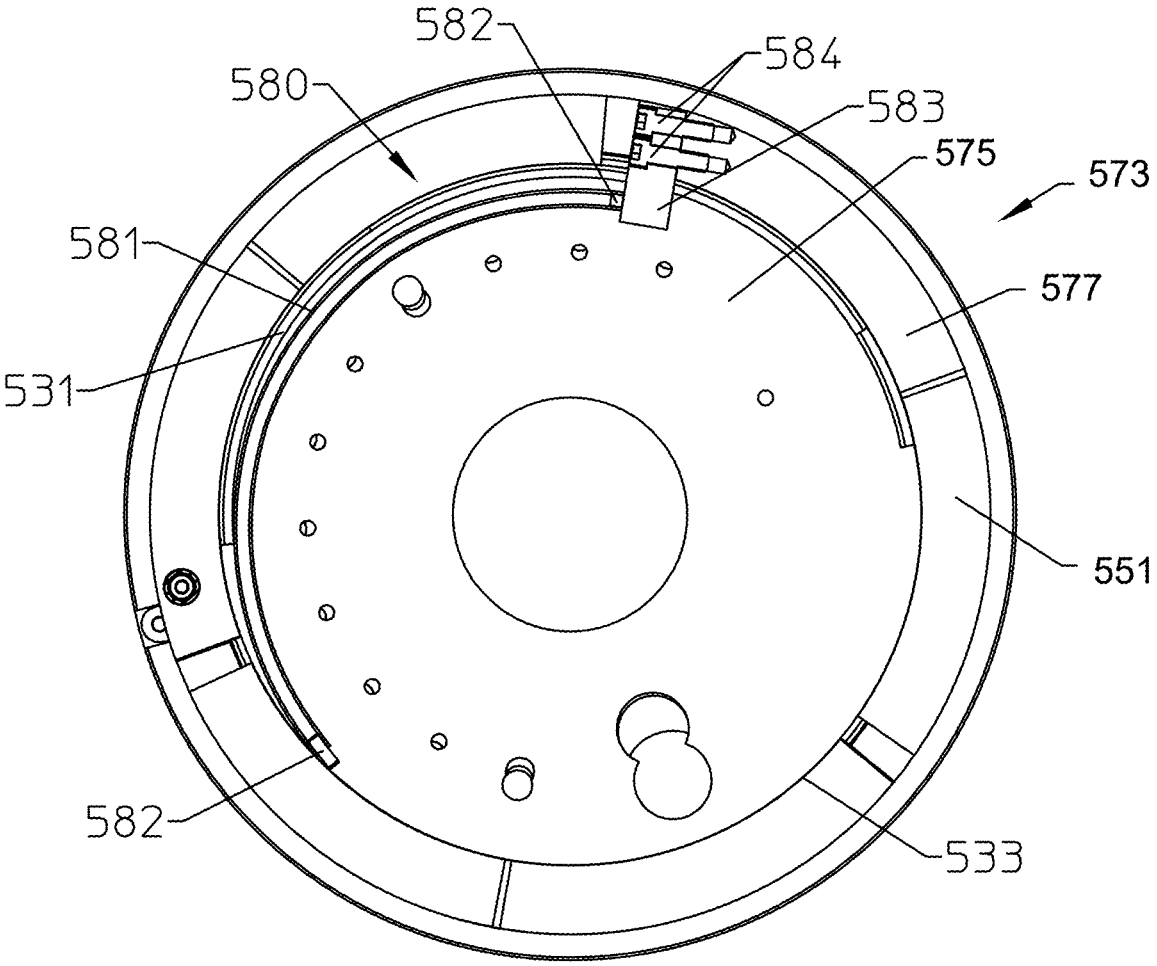
FIG. 23A is a top-down cross-sectional view of a tubing hanger system, in accordance with an embodiment of the present disclosure.
Figure 23B:
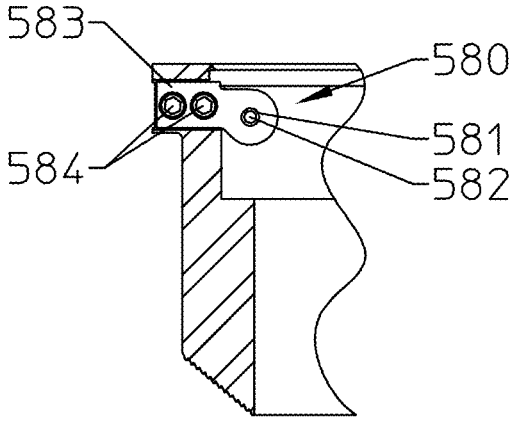
FIG. 23B is a partial perspective view of the tubing hanger system of FIG. 23A, in accordance with an embodiment of the present disclosure.

Referring now to FIGS. 23A and 23B, a tubing hanger system 573, according to one or more embodiments of the present disclosure, is illustrated. As discussed previously, the tubing hanger system 573 may include a tubing hanger body 575 and a space-out mechanism 500 (wherein in certain embodiments, space-out mechanism 500 may be interchangeable with the space-out mechanism 100 of tubing hanger system 19). Further, the space-out mechanism 500 may include a ramp ring 577 and a piston 551. Additionally, in one or more embodiments, the ramp ring 577 of the space-out mechanism 500 may be rotationally coupled to the tubing hanger body 575 by a circumferential spring mechanism 580. The circumferential spring mechanism 580 may be coupled to the ramp ring 577 on a first end and to the tubing hanger body 575 on a second end. The circumferential spring mechanism 580 may include a spring 581, spring connectors 582, a transfer block 583, and bolts 584. The spring 581 may be disposed within a circumferential groove 531 located on the second sealing profile 533 of the tubing hanger body 575. The circumferential groove 531 may be disposed between the downward facing contact surface (not shown) of the tubing hanger body 575 and the fourth seal groove (not shown), which is disposed on the second sealing profile 533 of the tubing hanger body 575. Further, the spring 581 may be directly coupled to the tubing hanger body 575 by a spring connector 582 on a first end of the circumferential groove 531 and may be directly coupled to the transfer block 583 by a spring connector 582 within a distal portion of the circumferential groove 531. The transfer block 583 may be directly coupled to the ramp ring 577 by bolts 584.

In one or more embodiments, when assembling the tubing hanger system 573 before run-in, the circumferential spring mechanism 580 may be preloaded such that when a safety mechanism rotationally locking the tubing hanger body 575 and the ramp ring 577 is disengaged, the space-out mechanism 500 self-actuates to rotate the ramp ring 577 against the piston 551 to extend the space-out mechanism 500 axially and remove any axial gaps that have formed during installation of the tubing hanger system 573 into wellhead housing. When the space-out mechanism 500 is actuated, the rotation of the ramp ring will cause the ramp surface of the ramp ring 577 to bear against and rotate against the ramp surface of the piston 551 and extend the space-out mechanism 500 axially.

By way of example, in one or more embodiments, the space-out mechanism 500 may be configured such that the preload puts the spring 581 in tension and releasing the safety mechanism causes the spring 581 to pull the ramp ring 577 causing it to rotate against the piston 551. However, one of ordinary skill would appreciate that in other embodiments, the spring 581 may be preloaded in compression such that releasing the safety mechanism causes the spring to push the ramp ring 577 causing it to rotate against the piston 551. Additionally, while a single preloaded spring 581 is illustrated in FIGS. 23A and 23B, one of ordinary skill would appreciate that in other embodiments, there may be multiple springs situated in series or in parallel and preloaded in tension, compression, or torsion so as to rotate a ramp surface of the ramp ring 577 against a ramp surface of the piston 551 causing the space-out mechanism to extend axially and fill in any axial gaps created while rigidizing the tubing hanger system and casing hanger within the wellhead housing.

Figure 24A:
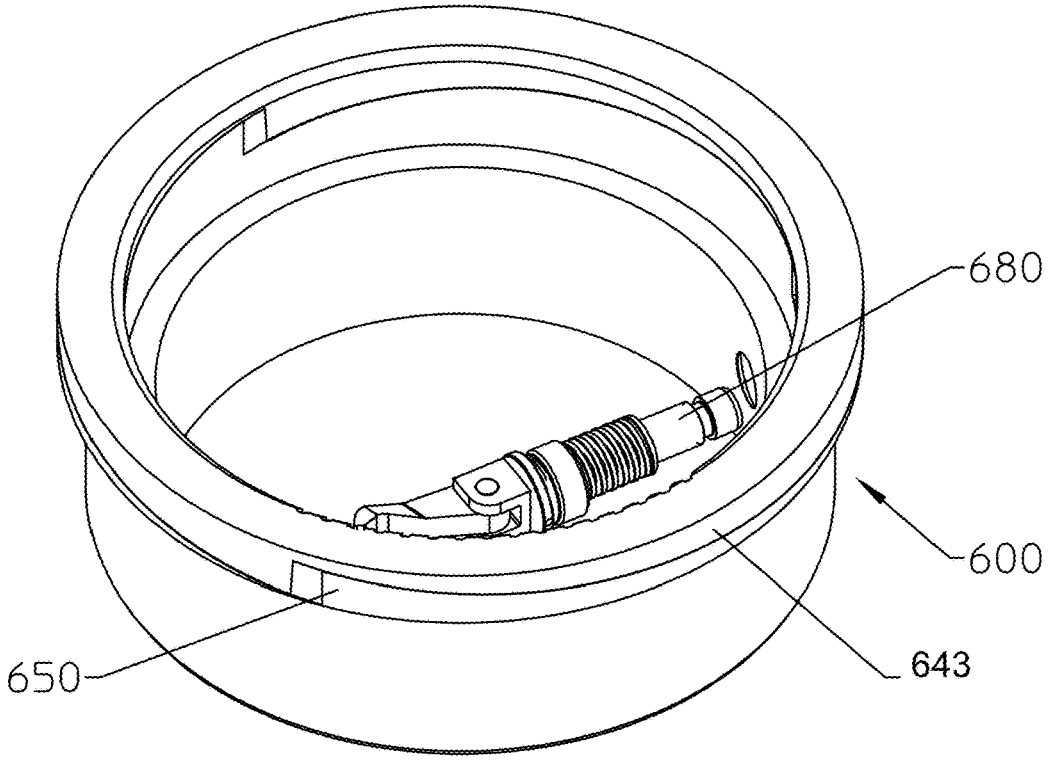
FIG. 24A is an isometric view of a tubing hanger system, in accordance with an embodiment of the present disclosure.
Figure 24B:
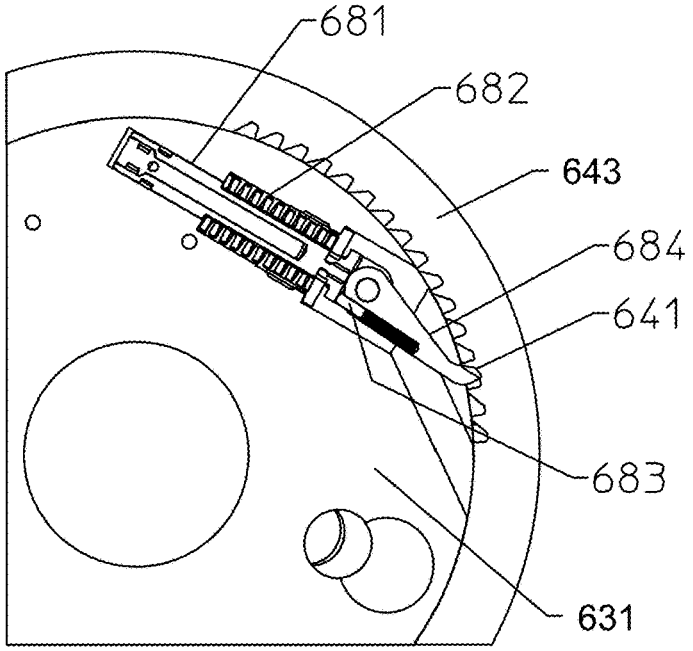
FIG. 24B is a partial top-down cross-sectional view of the tubing hanger system of FIG. 24A, in accordance with an embodiment of the present disclosure.

Referring now to FIGS. 24A and 24B, a tubing hanger system, according to one or more embodiments of the present disclosure, is illustrated. As discussed previously, the tubing hanger system may include a tubing hanger body 631 and a space-out mechanism 600 (wherein in certain embodiments, space-out mechanism 600 may be interchangeable with the space-out mechanism 100 of tubing hanger system 19). Further, the space-out mechanism 600 may include a ramp ring 643 and a piston 650. Additionally, in one or more embodiments, the space-out mechanism may include a ratchet mechanism 680 disposed inside the tubing hanger system that is configured to allow a user to remotely rotate the ramp ring 643 as necessary during run-in and the process of rigidizing the tubing hanger system within the wellhead housing. The ramp ring 643 may include a plurality of inclined grooves 641 disposed circumferentially along its inner diameter. The ratchet mechanism 680 may be configured to engage the grooves 641 of the ramp ring 643 such that each stroke of the ratchet mechanism rotates the ramp ring 643 by the radial distance of a single groove. The ratchet mechanism 680, according to one or more embodiments of the present disclosure, may be a short stroke piston with a ratchet. The ratchet mechanism 680 may include a piston 681, a spring 682, an actuation arm 683, and a lever 684. The piston 681 and the spring 682 may be coaxially disposed with one end of the actuation arm 683 coupled to one end of the piston 681. Further, the other end of the actuation arm may be coupled to the lever 684, which is itself pinned to a non-moving portion of the piston 681, in order to force the lever 684 to rotate about the pinned connection. The piston 681 may be remotely controlled by a user so as to actuate the ratchet mechanism 680 by pulling the actuation arm 683 such that the lever 684 rotates out of the groove it is sitting in and then allowing the lever 684 to rotate back against the edge of a groove under the force of the spring 682, which causes the actuation arm to return the lever to its resting position, such that the lever 684 now engages an adjacent groove; thus, rotating the ramp ring 643, accordingly. Further, as discussed above, rotating the ramp ring 643 causes the ramp ring 643 to shift against the piston 650 to extend the space-out mechanism 600 axially and remove any axial gaps that have formed during installation of the tubing hanger system into the wellhead housing. When the space-out mechanism 600 is actuated, the rotation of the ramp ring will cause the ramp surface of the ramp ring 643 to bear against and rotate against the ramp surface of the piston 650 and extend the space-out mechanism 600 axially.

Figure 25:
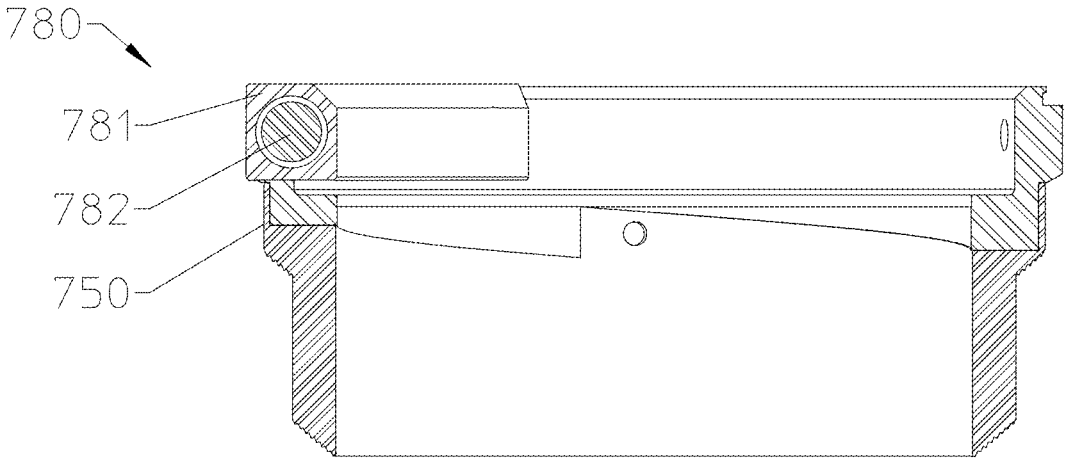
FIG. 25 is an isometric view of a ramp ring rotating mechanism, in accordance with an embodiment of the present disclosure.

Referring now to FIG. 25, a ramp ring rotating mechanism 780, according to one or more embodiments of the present disclosure, is illustrated. A space-out mechanism may include the ramp ring rotating mechanism 780 coupled to a ramp ring. The ramp ring rotating mechanism 780 may include a piston 781 and a curved piston rod 782. In one or more embodiments, the curved piston rod 782 may be 3-D printed. Further, the curved piston rod 782 may be disposed within the piston 781 and extend from the piston 781. An end of the curved piston rod 782 may be coupled to the ramp ring, and actuating the piston 781 may cause the curved piston rod 782 to extend, thus causing the ramp ring to rotate relative to a tubing hanger body and a piston 750 of a tubing hanger system. Further, as discussed above, rotating the ramp ring may cause the ramp ring to shift against the piston 750 to extend the space-out mechanism axially and remove any axial gaps that have formed during installation of the tubing hanger system into a wellhead housing. When the space-out mechanism is actuated, the rotation of the ramp ring may cause the ramp surface of the ramp ring to bear against and rotate against the ramp surface of the piston 750 and extend the space-out mechanism axially.

Figure 26A:
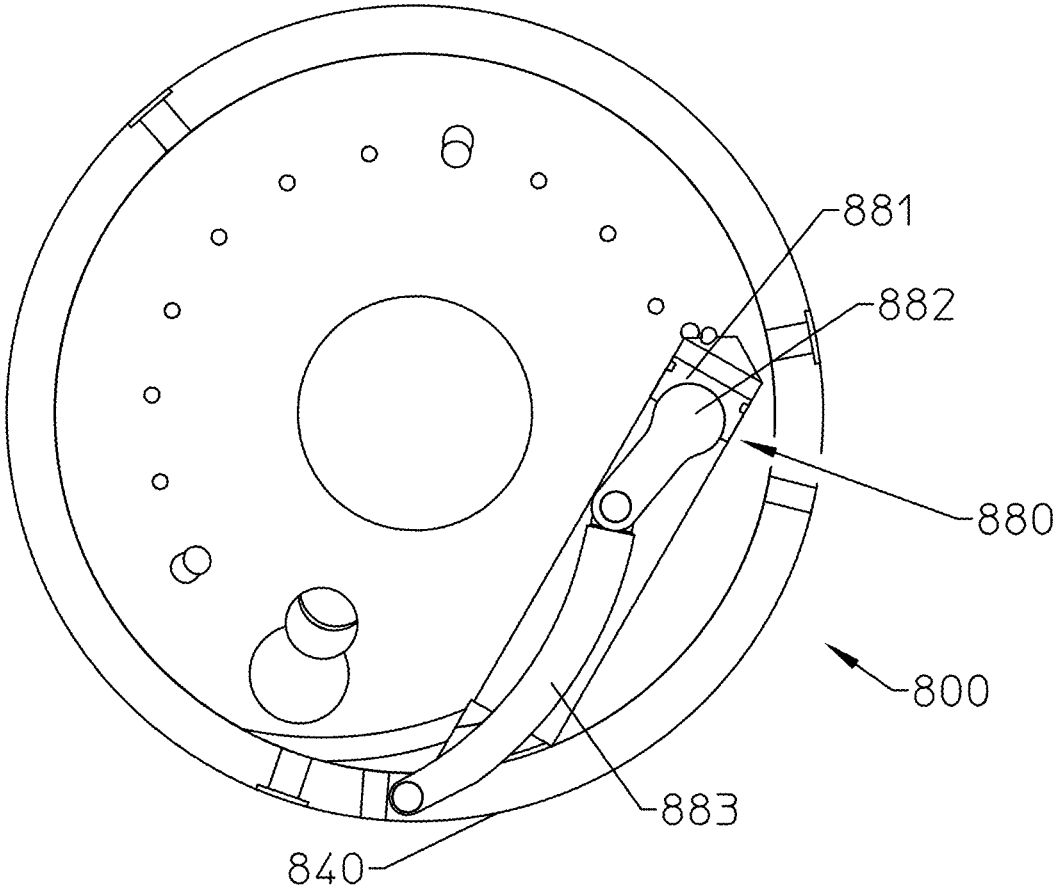
FIG. 26A is an isometric view of a ramp ring rotating mechanism, in accordance with an embodiment of the present disclosure.
Figure 26B:
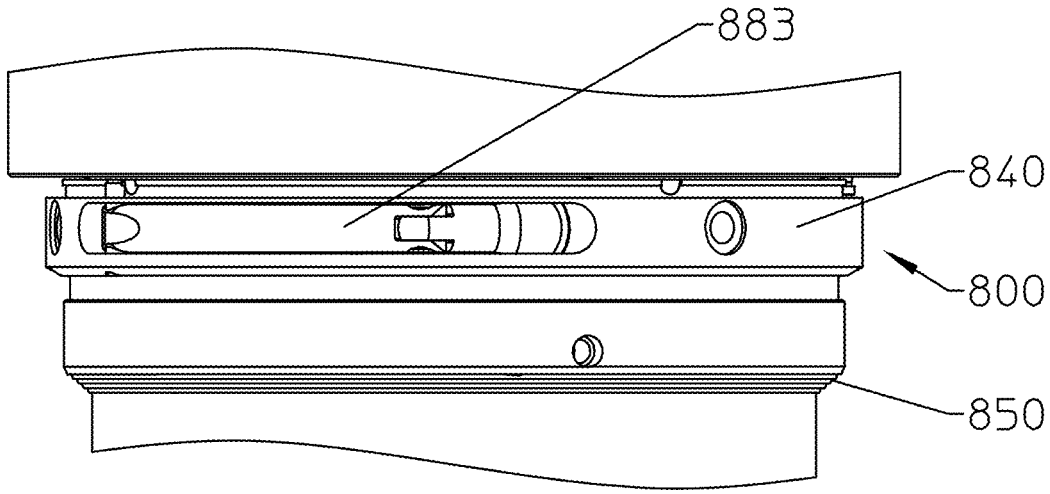
FIG. 26B is a partial perspective view of the ramp ring rotating mechanism of FIG. 26A, in accordance with an embodiment of the present disclosure.

Referring now to FIGS. 26A and 26B, a ramp ring rotating mechanism 880, according to one or more embodiments of the present disclosure, is illustrated. A space-out mechanism 800 may include the ramp ring rotating mechanism 880 coupled to a ramp ring 840. The ramp ring rotating mechanism 880 may include a piston 881, an arm 882, and a slider 883. In one or more embodiments, the arm 882 may be coupled to the piston 881 and may be rotated by way of actuation of the piston 881, which may be operated remotely by a user. An end of the arm 882 may be coupled to a first end of the slider 883, and a second end of the slider 883 may be coupled to the ramp ring 840. In one or more embodiments, the slider 883 may be coupled to the arm 882 and the ramp ring 840 by pins. Further, actuating the piston 881 may cause the arm 882 to rotate, thus causing the slider 883 to rotate about the pinned connection to the arm 882 and rotating the ramp ring 840 relative to a tubing hanger body and a piston 850 of a tubing hanger system. Further, as discussed above, rotating the ramp ring 840 may cause the ramp ring 840 to shift against the piston 850 to extend the space-out mechanism 800 axially and remove any axial gaps that have formed during installation of the tubing hanger system into a wellhead housing. When the space-out mechanism 800 is actuated, the rotation of the ramp ring 840 may cause the ramp surface of the ramp ring 840 to bear against and rotate against the ramp surface of the piston 850 and extend the space-out mechanism 800 axially (wherein in certain embodiments, space-out mechanism 800 may be interchangeable with the space-out mechanism 100 of tubing hanger system 19).

Figure 27A:
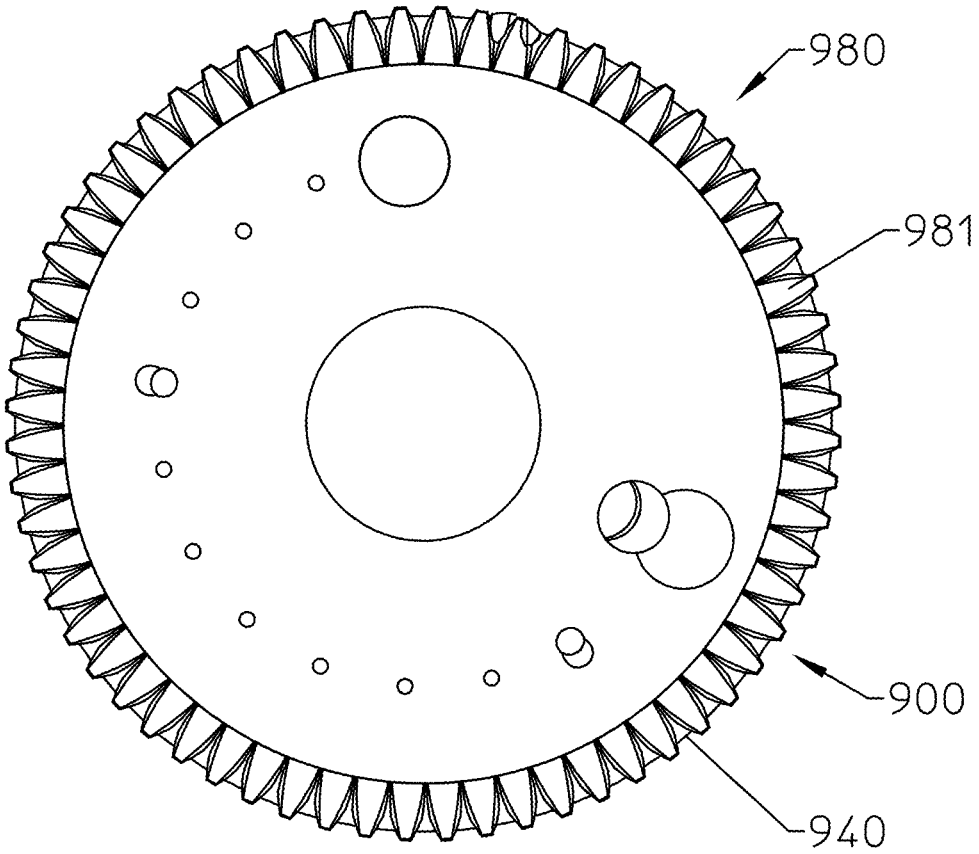
FIG. 27A is an isometric view of a ramp ring rotating mechanism, in accordance with an embodiment of the present disclosure.
Figure 27B:
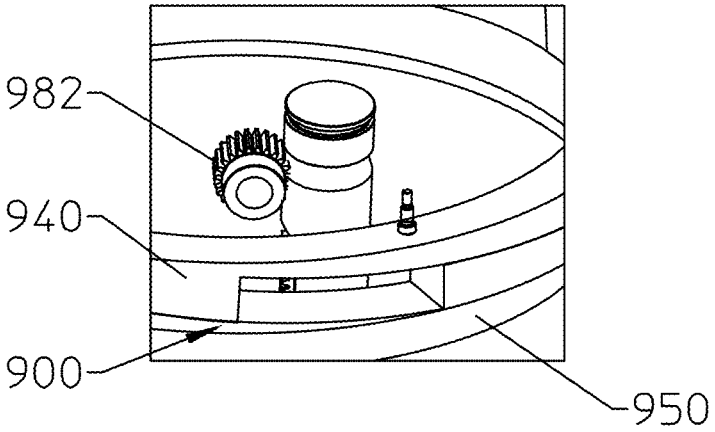
FIG. 27B is a partial perspective view of the ramp ring rotating mechanism of FIG. 27A, in accordance with an embodiment of the present disclosure.

Referring now to FIGS. 27A and 27B, a ramp ring rotating mechanism 980, according to one or more embodiments of the present disclosure, is illustrated. A space-out mechanism 900 may include the ramp ring rotating mechanism 980 coupled to a ramp ring 940. The ramp ring rotating mechanism 980 may be a geared mechanism and may include a curved rack 981 and a pinion 982. In one or more embodiments, the curved rack 981 may be coupled to a ramp ring 940 and the pinion 982. Further, rotation of the pinion 982 may cause rotation of the ramp ring 940 by way of the curved rack 981, and the pinion 982 may be rotated by remote operation by a user. Therefore, in one or more embodiments, rotation of the pinion 982 may cause the ramp ring 940 to rotate relative to a tubing hanger body and a piston 950 of a tubing hanger system. Further, as discussed above, rotating the ramp ring 940 may cause the ramp ring 940 to shift against the piston 950 to extend the space-out mechanism 900 axially and remove any axial gaps that have formed during installation of the tubing hanger system into a wellhead housing. When the space-out mechanism 900 is actuated, the rotation of the ramp ring 940 may cause the ramp surface of the ramp ring 940 to bear against and rotate against the ramp surface of the piston 950 and extend the space-out mechanism 900 axially (wherein in certain embodiments, space-out mechanism 900 may be interchangeable with the space-out mechanism 100 of tubing hanger system 19).

Figure 28:
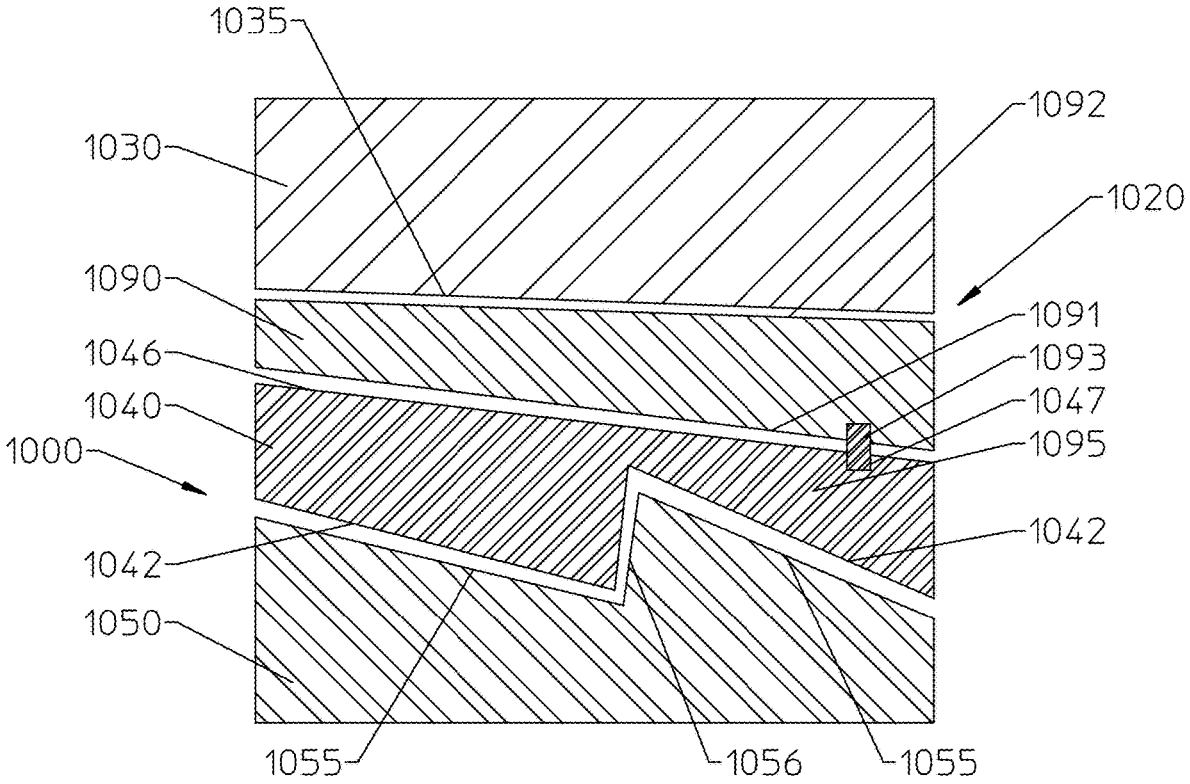
FIG. 28 is a partial cutaway view of a tubing hanger system, in accordance with an embodiment of the present disclosure.

Referring now to FIG. 28, a partial cutaway view of a tubing hanger system 1020, according to one or more embodiments of the present disclosure, is illustrated. The tubing hanger system 1020 may include a tubing hanger body 1030 and a space-out mechanism 1000. The space-out mechanism 1000 may include a first ramp ring 1040, a second ramp ring 1090, and a piston 1050 (wherein in certain embodiments, space-out mechanism 1000 may be interchangeable with the space-out mechanism 100 of tubing hanger system 19). The piston 1050 may include ramp surfaces 1055 and rotational stop surfaces 1056.

Further, the first ramp ring 1040 may include lower ramp surfaces 1042 and an upper ramp surface 1046. The lower ramp surfaces 1042 may contact the ramp surfaces 1055 of the piston 1050, and in one or more embodiments, the ramp surfaces 1042 of the ramp ring 1040 and the ramp surfaces 1055 of the piston 1050 may match in number and taper. By way of example, in one or more embodiments, the ramp ring 1040 may include multiple ramp surfaces 1042 each extending 120° circumferentially about the ramp ring 1040. However, one of ordinary skill in the art will understand that in other embodiments, the ramp ring may have a single ramp surface and a single rotational stop surface or any combination of equal numbers of ramp surfaces and rotational stop surfaces that match the number of ramp surfaces and rotational stop surfaces of the piston. Further, in one or more embodiments of the present disclosure, the ramp surfaces 1042, 1055 may all have a constant 4° taper. However, one of ordinary skill in the art will understand that in other embodiments the ramp surface may include steps or ridges and/or may have a constant or changing taper in the range of 0.5°-7°. Additionally, the upper ramp surface 1046 of the first ramp ring 1040 may have a constant taper. In one or more embodiments, the upper ramp surface 1046 may have a constant taper of 0.5°. However, one of ordinary skill in the art will understand that in other embodiments the ramp surface may include steps or ridges and/or may have a constant or changing taper in the range of 0.5°-7°. Further, a pin blind hole 1047 may be formed on the upper ramp surface 1046.

Furthermore, the second ramp ring 1090 may include a lower ramp surface 1091 and an upper contact surface 1092. The lower ramp surface 1091 of the second ramp ring 1090 may contact and may match the taper of the upper ramp surface 1046 of the first ramp ring 1040. As discussed above, the lower ramp surface 1091 may have a constant taper of 0.5°. However, one of ordinary skill in the art will understand that in other embodiments the lower ramp surface 1091 may include steps or ridges and/or may have a constant or changing taper in the range of 0.5°-7° that matches that of the upper ramp surface 1046 of the first ramp ring 1040. Further, a pin blind hole 1093 may be formed on the lower ramp surface 1091 and may be coaxially aligned with the pin blind hole 1047 of the first ramp ring 1040 during assembly. Further, a shear pin 1095 may be disposed within the aligned pin blind holes 1047, 1093 to rotationally lock the first ramp ring 1040 and the second ramp ring 1090 until a sufficient piston force is applied to either the first ramp ring 1040 or the second ramp ring 1090 to shear the shear pin 1095 when locking and rigidizing the tubing hanger system 1020 within a wellhead housing.

Additionally, the tubing hanger body 1030 may include a downward facing contact surface 1035. The downward facing contact surface 1035 of the tubing hanger body 1030 may contact upper contact surface 1092 of the second ramp ring 1090 at least when the tubing hanger system 1020 is run-in and when the tubing hanger system 1020 is in a fully locked and rigidized position within the wellhead housing.

Figure 29:
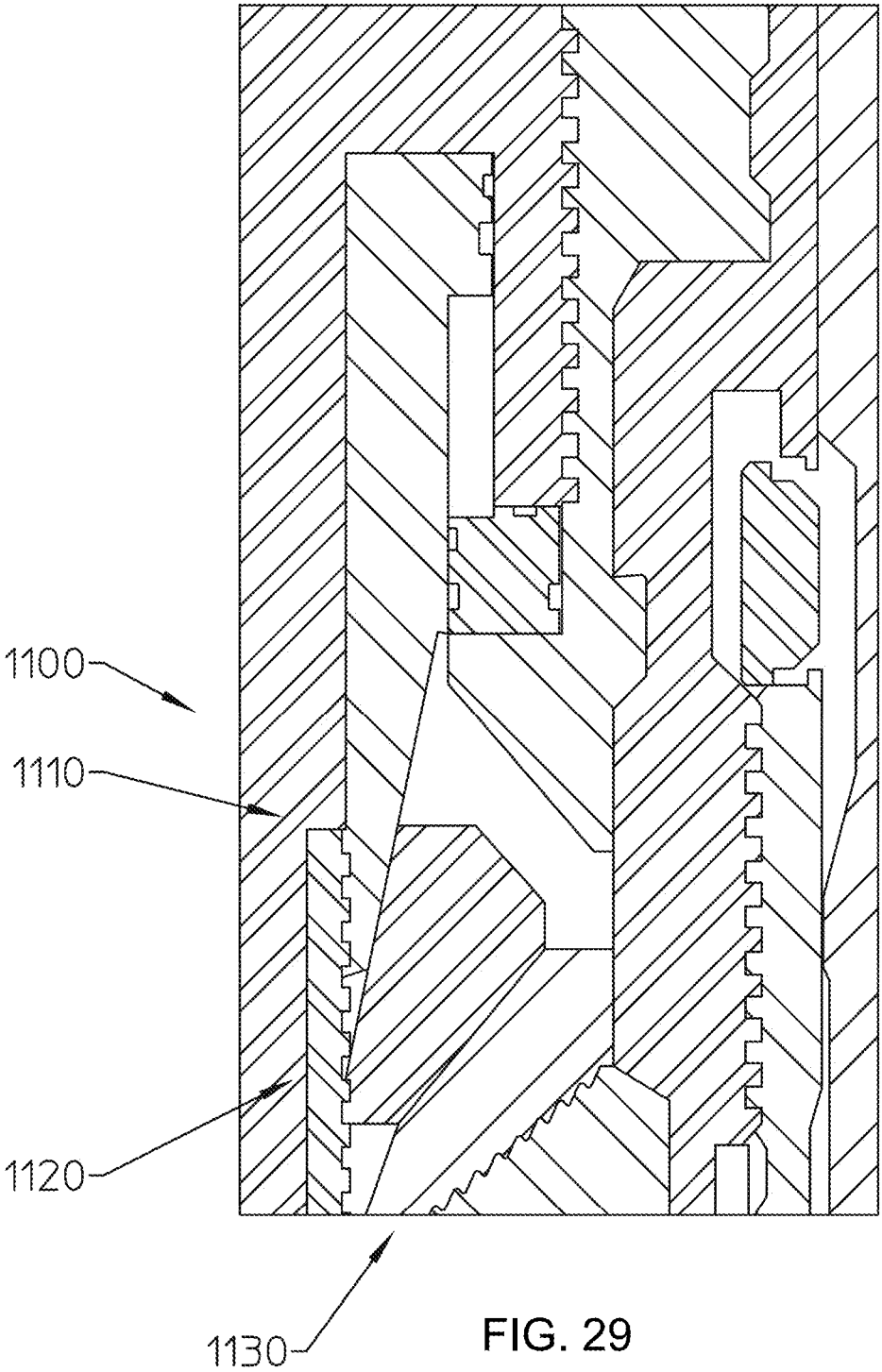
FIG. 29 is a partial cross-sectional view of a tubing hanger locking system, in accordance with an embodiment of the present disclosure.

Referring now to FIG. 29, a tubing hanger locking system 1100, according to one or more embodiments of the present disclosure, is illustrated. The tubing hanger locking system 1100 may include, at least, a piston 1110, locking dogs 1120, and a wedge 1130. The piston 1110, the locking dogs 1120, and the wedge 1130 may be configured and coupled such that the tubing hanger locking system 1100 locks a tubing hanger in place within a wellhead housing and rigidizes a tubing hanger and casing hanger within the wellhead housing.

While one or more embodiments of the present disclosure may include a piston 50, 551, 650, 750, 850, 950, 1050, one of ordinary skill would appreciate that in other embodiments, a space-out mechanism of a tubing hanger system may instead include a lower member, which may be a non-actuating member. However, as discussed above with respect to pistons of one or more embodiments of the present disclosure, the lower member may include, at least, ramp surfaces and rotational stop surfaces and may be configured to interact with a ramp ring in order to lock a casing hanger and a tubing hanger system in place within a wellhead housing and rigidize the system.

It should be understood that the present disclosure contemplates a method to lock and rigidize a tubing hanger system and casing hanger within a wellhead housing. The present disclosure also contemplates a method to assemble a tubing hanger system.

In one or more embodiments of the present disclosure, assembly of the tubing hanger system may include disposing a space-out mechanism about a first sealing profile and second sealing profile of a tubing hanger body. Further, in one or more embodiments where the space-out mechanism includes a ramp ring and a piston, a ramp ring may be disposed about the second sealing profile of the tubing hanger body. Then, in one or more embodiments including a safety mechanism for locking a rotation of the ramp ring relative to the tubing hanger body, the portions of the safety mechanism in the ramp ring and in the tubing hanger body may be aligned and coupled. This may further include disposing a safety lock spring in a pin blind hole, disposing a safety lock pin on top of the safety lock spring in the pin blind hole, and disposing a pin securing mechanism into the opening of the pin blind hole. Further, once the safety mechanism for locking a rotation of the ramp ring relative to the tubing hanger body is properly aligned and the safety lock pin is inserted into the pin counterbore of the tubing hanger body, a safety lock rod may be disposed within an elongated hole in the tubing hanger body. Further, if a space-out mechanism requires a pre-load to be applied to a mechanism configured to rotate the ramp ring relative to the tubing hanger body, the pre-load will be applied before rotationally locking the ramp ring and the tubing hanger body by way of the safety mechanism.

Then, in one or more embodiments, a piston may be disposed about the first sealing profile and the second sealing profile of the tubing hanger body. Once the piston is properly installed such that the seals of the tubing hanger body are properly located within the piston, the piston and the tubing hanger body may be aligned such that the anti-rotation pin may be threaded into the threaded pin borehole of the piston and extend into a pin slot of the tubing hanger body. Additionally, in one or more embodiments, a retainer ring may be disposed within a third groove of the tubing hanger body.

Additionally, in one or more embodiments of the present disclosure, locking and rigidizing a tubing hanger system and casing hanger within a wellhead housing may include running an assembled tubing hanger system into the wellhead housing, landing the tubing hanger system on the casing hanger and sealing a tubing hanger to casing hanger seal of the tubing hanger body against the casing hanger. Landing the tubing hanger system on the casing hanger may further include collapsing a retaining ring into a third groove of the tubing hanger body. Then, in one or more embodiments, a seal test on the tubing hanger to casing hanger seal may be performed. Once the seal test confirms that the seals are properly set, the tubing hanger may be locked. The process of locking the tubing hanger may activate the safety lock rod and engage the locking dogs into their locking profile within the wellhead housing. Then, the tubing hanger body may be lifted to preload the locking mechanism in place within the wellhead housing.

In one or more embodiments, the space-out mechanism may then be actuated, taking up any axial gaps created by lifting on the tubing hanger body and rigidizing the tubing hanger system within the wellhead housing. Actuating the space-out mechanism may further include unlocking a safety mechanism. Unlocking the safety mechanism may include compressing a safety locking rod into an elongated hole of the tubing hanger body and pushing a safety lock pin out of a pin counterbore of the tubing hanger body such that the ramp ring is no longer rotationally locked to the tubing hanger body. Actuating the space-out mechanism may further include moving the piston down to push against the casing hanger, rotating the ramp ring, and filling the gap between the piston and the tubing hanger body. Once the space-out mechanism has been activated to rigidize the tubing hanger body and the casing body within the wellhead housing, the casing hanger seal may be seal tested to ensure that it is still properly sealing. Then, finally, the tubing hanger system may be released.

Space-out mechanisms, as described at length above, may be used in other contexts as well to rigidize wellhead system components by removing any axial gaps in the wellhead system created during the process of landing/locking components of the wellhead system. For example, a space-out mechanism may be used to close out any axial gaps in a connection between a casing hanger and the wellhead housing (e.g., prior to landing a tubing hanger).

In some cases, machining tolerances may give rise to small gaps between a locking mechanism (e.g., lock ring) of a seal assembly and an upper edge of a complementary lock profile of the wellhead when the seal assembly is landed and locked to seal an annulus between the casing hanger and the wellhead. Such gaps may enable the seal assembly located between the casing hanger and the wellhead to move up and down axially in response to pressure differentials. Over time, this motion of the seal may cause undesirable wear on the seal, increasing the chance for failure.

Figure 30:
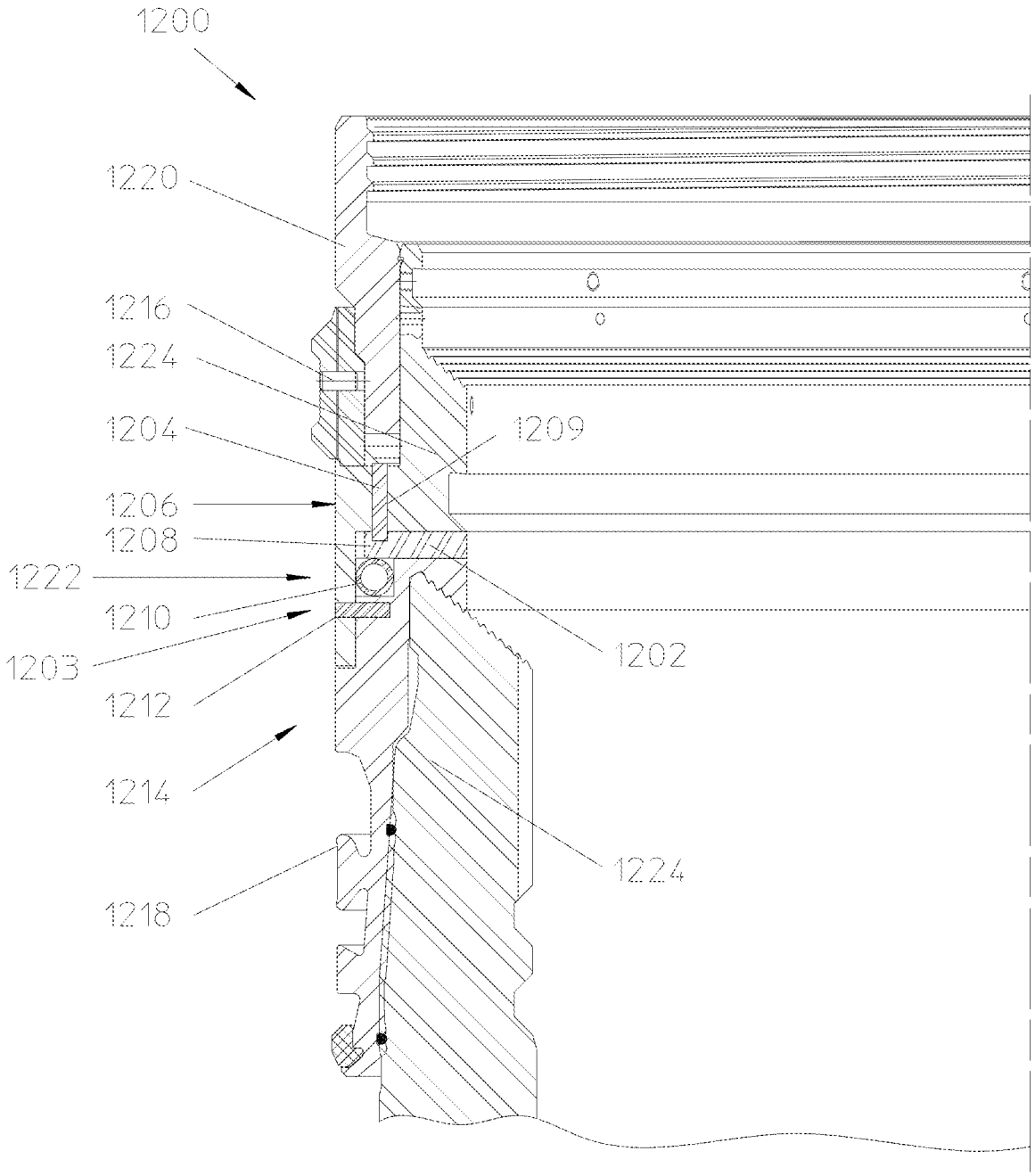
FIG. 30 is a partial cross-sectional view of a seal assembly having enhanced rigidity, in accordance with an embodiment of the present disclosure.

To address this issue, a seal assembly 1200, as depicted in FIG. 30, may be equipped with a space-out mechanism 1222 used to reduce gaps and rigidize the system. The seal assembly 1200 may include an upper body 1206, a lower body 1214, an actuator sleeve 1220, and a locking mechanism 1216. The seal assembly 1200 may first be lowered into a wellhead. Once lowered, the seal assembly 1200 may land upon the casing hanger 1224. Weight may be applied to the seal assembly 1200 via a running tool (not shown); this weight may cause the actuator sleeve 1220 to move downward with respect to the upper body 1206 and the locking mechanism 1216, thereby pushing the locking mechanism 1216 into grooves of the inner diameter profile of the wellhead housing (not shown). Once the actuator sleeve 1220 has moved down, there may remain a gap between the locking mechanism 1216 and the uppermost edge of the grooves. To increase the rigidity of the system, it is desirable to reduce, minimize, or eliminate such a gap.

The seal assembly 1200 of FIG. 30 includes a space-out mechanism 1222, which may be coupled between the upper body 1206 and the lower body 1214 as shown. The upper body 1206 may be coupled to the locking mechanism 1216. The lower body 1214 may land on a landing shoulder of the casing hanger 1224. The lower body may include a seal 1218, which may be rigidized in accordance with teachings of the present disclosure. The space-out mechanism 1222 may be utilized to increase the axial distance between the upper body 1206 and the lower body 1214 in order to ensure that (1) the seal 1218 has landed at the appropriate location; and (2) the locking mechanism 1216 is positioned against the upper edge of the corresponding profile of the inner diameter of the wellhead (not shown).

The space-out mechanism 1222 may include a ramp ring 1202 and an actuation mechanism 1203. The actuation mechanism 1203, in the illustrated embodiment, includes a spring and 1210 and a pressure-actuated release mechanism 1212. The pressure-actuated release mechanism 1212 may be any mechanism suitable to prevent the lower body from descending until a threshold pressure is reached; for example, the pressure-actuated release mechanism 1212 may be a shear pin or other shearable actuation component.

In certain embodiments, the ramp ring 1202 may be configured to rotate relative to the upper body 1206 and the lower body 1214. The ramp ring 1202 may comprise at least one tapered surface, and the upper body 1206 may comprise at least one tapered surface configured to interface with the at least one tapered surface of the ramp ring 1202. The tapered surfaces of the ramp ring 1202 and the upper body 1206 may be complementary. Furthermore, the tapered surfaces of the ramp ring 1202 and the upper body 1206 may be configured to bear against each other to rigidize the system. In certain embodiments, the at least one taper of each of the ramp ring 1202 and the upper body 1206 may have a slope between 0.5° and 7°. The ramp ring 1202 of the space-out mechanism 1222, according to one or more embodiments of the present disclosure, may include a lower contact surface configured to interface with an upper contact surface of the lower body 1214. Additionally, in one or more embodiments, an upper surface of the ramp ring 1202 may have a plurality of ramp surfaces and a plurality of rotational stop surfaces. For example, the ramp ring 1202 may take the form of the ramp ring (e.g., ramp ring 40) shown in FIG. 21A, except that the ramp surfaces and stop surfaces are on the top of the ramp ring instead of the bottom. For example, in one or more embodiments, the ramp ring 1202 may include three ramp surfaces each extending 120° circumferentially about the ramp ring 1202. However, one of ordinary skill in the art will understand that in other embodiments, the ramp ring 1202 may have a single ramp surface and a single rotational stop surface or any combination of equal numbers of ramp surfaces and rotational stop surfaces that match the number of ramp surfaces and rotational stop surfaces of the upper body 1206. Further, in one or more embodiments of the present disclosure, the ramp surface(s) may have a constant 3.5° taper. However, one of ordinary skill in the art will understand that in other embodiments the ramp surface(s) may include steps or ridges and/or may have a constant or changing taper in the range of 0.5°-7°. Alternatively, the ramp surface(s) may include any range of angles, surface geometries, and/or coatings that prevent rotation once installed.

The ramp ring 1202 of the space-out mechanism 1222 may be configured to rotate via the spring 1210 relative to the upper body 1206 and the lower body 1214. In one or more embodiments, the ramp ring 1202 may be rotationally coupled to the lower body 1214 by a circumferential spring mechanism (which may or may not be similar to the circumferential spring mechanism 580 of FIG. 23A) including the spring 1210. The circumferential spring mechanism may be coupled to the ramp ring 1202 on a first end and to the lower body 1214 on a second end. The spring 1210 may be disposed within a circumferential groove (not shown) located on the lower body 1214. Further, the spring 1210 may be directly coupled to the lower body 1214 by a spring connector (not shown) on a first end of the circumferential groove and may be coupled (e.g., via a transfer block, spring connector, and/or bolts) to the ramp ring 1202.

In one or more embodiments, when assembling the seal assembly 1200 before run-in, the circumferential spring mechanism may be preloaded such that when a safety mechanism locking the upper body 1206 to the lower body is disengaged, the space-out mechanism 1222 self-actuates to rotate the ramp ring 1202 against the lower body 1214 to extend the space-out mechanism 1222 axially and remove any axial gaps that have formed during installation of the seal assembly 1200 into wellhead housing. When the space-out mechanism 1222 is actuated, the rotation of the ramp ring 1202 will cause the ramp surface(s) of the ramp ring 1202 to bear against and rotate against the corresponding ramp surface(s) of the upper body 1206 and extend the space-out mechanism 1222 axially.

The pressure-actuated release mechanism 1212 may be a safety mechanism configured to lock the upper body 1206 to the lower body 1214 until a pressure is applied to disengage the pressure-actuated mechanism 1212. The pressure-actuated release mechanism 1212 may be any mechanism suitable to prevent the lower body 1214 from moving with respect to the upper body 1206 until a threshold pressure is reached; for example, the pressure-actuated release mechanism 1212 may be a shear pin. The shear pin may extend between the upper body 1206 and the lower body 1214. The actuation mechanism 1203 of the illustrated embodiment including the spring 1210 and shear pin are purely exemplary—any actuation mechanism for the space-out mechanism 1222 may be used without departing from the scope of the present disclosure. For example, and without limitation, one or more of a spring 1210, shear pin, other pressure-actuated release mechanism 1212, piston, ratchet, rod, spring plate, arm, slider, rack, and pinion may be used for actuation, such as those described at length above with reference to FIGS. 24A-28.

In certain embodiments, the space-out mechanism 1222 may include another safety mechanism according to one or more embodiments of the present disclosure. In particular, a spring-loaded rod 1204 disposed within the ramp ring 40 may be installed during assembly of the seal assembly 1200 and engage the upper body 1206 so as to rotationally lock the ramp ring 1202 to the upper body 1206 until the proper time in the seal assembly run-in sequence in which the ramp ring 1202 should be rotationally actuated in order to take up any axial space created by the installation procedure.

The safety mechanism may be similar to the safety mechanism illustrated in detail in FIG. 22 and described above. The only features of the safety mechanism illustrated in FIG. 30 are the spring-loaded rod 1204 (e.g., safety lock rod 72 of FIG. 22) and the corresponding pin securing mechanism 1208 (e.g., pin securing mechanism 45 of FIG. 22). It will be understood that the safety mechanism of FIG. 30 may also include a safety lock pin (e.g., 70 of FIG. 22) and a safety lock spring (e.g., 71 of FIG. 22) disposed within the ramp ring 1202. The spring-loaded rod 1204 may be disposed within the upper body 1206. The ramp ring 1202, in one or more embodiments, may include a pin blind hole disposed in an upper contact surface thereof with the pin securing mechanism 1208 disposed in the opening of the pin blind hole. Additionally, the upper body 1206, in one or more embodiments, may include an elongated hole 1209 that extends from an upward facing contact surface thereof to a downward facing contact surface thereof. Further, a pin counterbore (not shown) may be sunk into the downward facing contact surface and concentric with the hole 1209. The spring-loaded rod 1204 may be disposed within the hole 1209.

The safety mechanism may function similar to the assembly illustrated in FIG. 22 and described above with reference to FIG. 22. For example, in one or more embodiments of the present disclosure, when the seal assembly 1200 is assembled before run-in, the safety lock pin (not shown) may engage the pin counterbore (not shown). During the installation of the seal assembly 1200 within the wellhead housing, actuation of the locking mechanism 1216 may cause the actuator sleeve 1220 to compress the spring-loaded rod 1204 into the hole 1209, which will cause the bottom end of the spring-loaded rod 1204 to push the safety lock pin out of the pin counterbore. Once the safety lock pin is removed from the pin counterbore, the upper body 1206 and the ramp ring 1202 will no longer be rotationally locked with respect to each other, thereby allowing the ramp ring 1202 to rotate relative to the upper body 1206 (along the respective ramp surfaces) in order to remove any axial gaps in the seal assembly 1200 created during the process of locking and sealing the casing hanger 1224 within the wellhead housing.

The illustrated assembly of FIG. 30 may be utilized in a subsea wellhead system. In certain embodiments, the assembly of FIG. 30 may be utilized by performing a sequence of steps—one exemplary sequence is provided below.

First, the seal assembly 1200 may be landed on the casing hanger 1224 in the wellhead housing (not shown). The actuator sleeve 1220 may then be engaged, thereby extending the locking mechanism in a radially outward direction to lock the seal assembly 1200 to the wellhead and releasing the spring-loaded rod 1204 so that the ramp ring 1202 and the upper body 1206 are rotationally uncoupled. The seal assembly 1200 may then be pulled up via a seal assembly running tool (not shown).

Once the seal assembly 1200 is raised up such that the locking mechanism 1216 is engaged against the top of the inner profile on the wellhead, there may be a gap present between the lower body 1214 and the landing shoulder at the top of the casing hanger 1224. Accordingly, pressurized fluid may be pumped down an annulus between the outer diameter of the stem of the running tool and the inner diameter of the upper body 1206 and lower body 1214. The pressurized fluid may apply pressure to the inner diameter of the seal 1218 at the bottom of the lower body 1214, thereby causing the lower body 1214 to begin to descend. The lower body's movement may actuate the pressure-actuated release mechanism 1212 (e.g., shearing a shear pin), allowing the lower body 1214 to further descend with respect to the upper body 1206. Once the lower body 1214 has descended, the ramp ring 1202 and spring 1210 may automatically facilitate the closing of the gap.

Finally, the casing hanger/seal assembly running tool may be retrieved. The above list of steps should be understood as non-limiting—additional steps may be added or removed without departing from the scope of the present disclosure. Moreover, steps may be executed in a different order without departing from the scope of the present disclosure.

It should be understood that the present disclosure contemplates a method to lock and rigidize a seal assembly and casing hanger within a wellhead housing. The present disclosure also contemplates a method to assemble a seal assembly.

In one or more embodiments of the present disclosure, assembling the seal assembly may include disposing a space-out mechanism between an upper body and a lower body of the seal assembly. Then, in one or more embodiments including a safety mechanism for locking a rotation of the ramp ring relative to the upper body, the portions of the safety mechanism in the ramp ring and in the upper body may be aligned and coupled. This may further include disposing a safety lock spring in a pin blind hole, disposing a safety lock pin on top of the safety lock spring in the pin blind hole, and disposing a pin securing mechanism into the opening of the pin blind hole. Further, once the safety mechanism for locking a rotation of the ramp ring relative to the upper body is properly aligned and the safety lock pin is inserted into the pin counterbore of the tubing hanger body, a spring-loaded rod may be disposed within an elongated hole in the upper body. Further, if a space-out mechanism requires a pre-load to be applied to a mechanism configured to rotate the ramp ring relative to the upper body, the pre-load will be applied before rotationally locking the ramp ring and the upper body by way of the safety mechanism.

Then, in one or more embodiments, a pressure-actuated release mechanism is used to secure the upper body to the lower body in an axial direction, with the ramp ring between a lower edge of the upper body and an upper edge of the lower body.

Additionally, in one or more embodiments of the present disclosure, locking and rigidizing the seal assembly and casing hanger within a wellhead housing may include running an assembled seal assembly into the wellhead housing, landing the seal assembly on the casing hanger and sealing a seal of the seal assembly between the casing hanger and the wellhead housing. The seal assembly may then be locked to the wellhead housing. The process of locking the seal assembly may engage the locking mechanism into its locking profile within the wellhead housing. At the same time, the process of locking the locking mechanism may unlock a safety mechanism by compressing a spring-loaded rod into an elongated hole of the upper body and pushing a safety lock pin out of a pin counterbore of the upper body such that the ramp ring is no longer rotationally locked to the upper body. Then, the seal assembly may be lifted to preload the locking mechanism in place within the wellhead housing.

In one or more embodiments, the space-out mechanism may then be actuated, taking up any axial gaps created by lifting on the seal assembly and rigidizing the seal assembly within the wellhead housing. Actuating the space-out mechanism may further include pressuring down an annulus between the casing hanger and a seal on the lower body to apply a downward force to the lower body, thereby shearing a pressure-actuated mechanism to enable the lower body to move downward with respect to the upper body. Moving the lower body in this manner causes the ramp ring to rotate, filling the gap between the lower body and the upper body. Once the space-out mechanism has been activated to rigidize the seal assembly and the casing body within the wellhead housing, the casing hanger seal may be seal tested to ensure that it is still properly sealing. Then, finally, the seal assembly may be released.

Although the present disclosure and its advantages have been described in detail, it should be understood that various changes, substitutions and alterations can be made herein without departing from the spirit and scope of the disclosure as defined by the following claims.

What is claimed is:

1. A system, comprising:

a casing hanger disposed at least partially in a wellhead;

a tubing hanger positioned at least partially in the wellhead;

a space-out mechanism disposed between the casing hanger and the tubing hanger, wherein the space-out mechanism comprises:

a ramp ring having at least one tapered surface; and a lower member rotationally locked to the tubing hanger and having a tapered surface, wherein the ramp ring is configured to rotate relative to the tubing hanger and the lower member; and a tubing hanger alignment device coupled to a distal end of a tree, wherein the tubing hanger alignment device is configured to couple one or more fluid, electric, or fiber optic lines of the tree with one or more fluid, electric, or fiber optic couplings of the tubing hanger regardless of a relative orientation of the tree to the tubing hanger.

2. The system of claim 1, further comprising a locking mechanism disposed on top of the tubing hanger, wherein the locking mechanism is configured to lock the casing hanger, the tubing hanger, the space-out mechanism, and the locking mechanism in place within the wellhead.

3. The system of claim 1, further comprising a safety mechanism disposed within and between the ramp ring and the tubing hanger, wherein when the safety mechanism is in a locked position, the ramp ring cannot rotate relative to the tubing hanger, and when the safety mechanism is in an unlocked position, the ramp ring can rotate relative to the tubing hanger.

4. The system of claim 1, further comprising a seal assembly landed on the casing hanger, wherein the seal assembly is configured to seal the casing hanger with the wellhead, comprising:

the space-out mechanism; and an upper body having at least one tapered surface configured to interface with the at least one tapered surface of the space-out mechanism, wherein the space-out mechanism is disposed between the upper body and a lower body, and wherein the at least one tapered surface of the ramp ring and the at least one tapered surface of the upper body are configured to bear against each other to rigidize the system.

5. The system of claim 4, wherein the seal assembly further comprises one or more pressure-actuated release mechanisms coupled between the upper body and the lower body configured to constrain the lower body from moving with respect to the upper body until a threshold pressure is reached.

6. The system of claim 1, wherein the tubing hanger alignment device comprises:

a stab body;

a coupler body positioned around the stab body, the coupler body adapted to rotate relative to the stab body;

at least one hydraulic coupling element positioned on the coupler body; and at least one coiled tube positioned around the stab body, the at least one coiled tube being in fluid communication with the at least one hydraulic coupling element and adapted to flex in response to rotation of the coupler body with respect to the stab body.

7. The system of claim 1, wherein the tubing hanger alignment device comprises:

a stab body;

at least one inlet/outlet;

a coupler body positioned around the stab body, the coupler body adapted to rotate relative to the stab body;

at least one hydraulic coupling element positioned on the coupler body; and at least one coiled tube positioned around the stab body, the at least one coiled tube being in fluid communication with the at least one hydraulic coupling element and the at least one inlet/outlet.

8. The system of claim 7, wherein the tubing hanger alignment device further comprises a flange on an end of the stab body, wherein the at least one inlet/outlet is positioned adjacent an upper surface of the flange.

9. The system of claim 1, wherein the tubing hanger alignment device comprises:

an upper body;

a lower body coupled to the upper body, wherein the lower body is configured to rotate relative to the upper body;

a torsional spring disposed in an annular space between the upper body and the lower body;

one or more couplings disposed in the lower body configured to interface with one or more couplings of a second subsea component, wherein, when actuated, the one or more couplings are configured to close a gap defined between a top of the second subsea component and a bottom of the lower body; and at least one inlet/outlet disposed in the upper body configured to interface with the tree.

10. The system of claim 9, wherein the tubing hanger alignment device further comprises a trigger assembly configured to selectively trigger the torsional spring to rotate the lower body relative to the upper body until the one or more couplings on the lower body are aligned with the one or more couplings on the tubing hanger.

11. The system of claim 1, wherein the tubing hanger alignment device comprises:

an alignment body rotatably coupled to the tree and defining one or more electrical or hydraulic galleries in an annular space between the tree and the alignment body, the one or more electrical or hydraulic galleries being located proximate a first end of the alignment body;

one or more couplings proximate a second end of the alignment body opposite the first end; and one or more hydraulic, electric, or fiber optic lines extending through the alignment body between the one or more electrical or hydraulic galleries and the one or more couplings, the one or more hydraulic, electric, or fiber optic lines being coupled to the one or more electrical or hydraulic galleries at one end thereof and coupled to the one or more couplings on the alignment body at an opposite end thereof.

12. The system of claim 11, wherein the tubing hanger alignment device further comprises:

a timing ring coupled to the alignment body, wherein the timing ring comprises one or more keyed features extending therefrom; and a timing hub mounted to the tubing hanger, wherein the timing hub comprises complementary features to receive the one or more keyed features of the timing ring therein.

13. The system of claim 12, wherein the alignment body comprises a helical groove formed in an external surface thereof, wherein the timing ring is coupled to the alignment body via a pin extending from the timing ring into the helical groove.

14. A method, comprising:

running a tubing hanger into a wellhead until the tubing hanger lands on a casing hanger;

locking the tubing hanger to the wellhead;

lifting the tubing hanger;

actuating a space-out mechanism disposed between the tubing hanger and the casing hanger to rigidize the tubing hanger within the wellhead, wherein actuating the space-out mechanism comprises axially displacing the tubing hanger relative to the casing hanger through rotation of a ramp ring, wherein the ramp ring is configured to rotate relative to the tubing hanger and a lower member that is rotationally locked to the tubing hanger;

lowering a tree at least partially into the wellhead, wherein a tubing hanger alignment device is coupled to a distal end of the tree;

orienting one or more couplings of the tubing hanger alignment device to align with one or more couplings on the tubing hanger previously landed in the wellhead; and landing the tree in the wellhead, wherein the tubing hanger alignment device communicatively couples hydraulic, electric, and/or fiber optic lines of the tree with the one or more couplings on the tubing hanger.

15. The method of claim 14, wherein the tubing hanger alignment device comprises:

a stab body;

a coupler body positioned around the stab body, the coupler body adapted to rotate relative to the stab body;

at least one hydraulic coupling element positioned on the coupler body; and at least one coiled tube positioned around the stab body, the at least one coiled tube being in fluid communication with the at least one hydraulic coupling element and adapted to flex in response to rotation of the coupler body with respect to the stab body.

16. The method of claim 15, further comprising:

allowing the coupler body to rotate relative to the stab body while the stab body engages the tubing hanger; and flexing the at least one coiled tube positioned around the stab body in response to rotation of the coupler body.

17. The method of claim 16, further comprising engaging an alignment feature on the coupler body with a complementary alignment feature defined on the tree or on the tubing hanger to urge rotation of the coupler body relative to the stab body.

18. The method of claim 17, wherein one of the alignment feature and the complementary alignment feature is a helical slot and a remaining one of the alignment feature and the complementary alignment feature is an alignment pin.

19. The method of claim 14, further comprising actuating at least one hydraulic coupling of the tubing hanger alignment device to close a gap defined between a top of the tubing hanger and a bottom of the tubing hanger alignment device.

* * * * *